US008814652B2

(12) United States Patent
Harkins et al.

(10) Patent No.: US 8,814,652 B2
(45) Date of Patent: Aug. 26, 2014

(54) BINGO GAME WITH MULTICARD PATTERNS

(75) Inventors: Lisa G. Harkins, Reno, NV (US); Bryan D. Wolf, Reno, NV (US)

(73) Assignee: IGT, Las Vegas, NV (US)

( * ) Notice: Subject to any disclaimer, the term of this patent is extended or adjusted under 35 U.S.C. 154(b) by 1927 days.

(21) Appl. No.: 11/149,828

(22) Filed: Jun. 10, 2005

(65) Prior Publication Data

US 2006/0025199 A1 Feb. 2, 2006

Related U.S. Application Data

(60) Provisional application No. 60/592,410, filed on Jul. 30, 2004.

(51) Int. Cl.
*A63F 3/06* (2006.01)
*G07F 17/32* (2006.01)

(52) U.S. Cl.
CPC ..... *G07F 17/3286* (2013.01); *G07F 17/3293* (2013.01); *G07F 17/32* (2013.01)
USPC ..... 463/19; 463/11; 463/13

(58) Field of Classification Search
USPC ..... 463/11, 13, 19
See application file for complete search history.

(56) References Cited

U.S. PATENT DOCUMENTS 3,628,259 A 12/1971 Kahn
4,156,976 A 6/1979 Mikun
4,157,829 A 6/1979 Goodman et al.
4,332,389 A 6/1982 Loyd, Jr. et al. ..... 463/19
4,335,809 A 6/1982 Wain
4,339,798 A 7/1982 Hedges et al.

(Continued)

FOREIGN PATENT DOCUMENTS

EP 0769769 4/1997
EP 199690 4/2002

(Continued)

OTHER PUBLICATIONS

International Search Report & Written Opinion of the International Searching Authority dated Nov. 1, 2005, for PCT App No. PCT/US2004/029912.

(Continued)

*Primary Examiner* — Lawrence Galka
(74) *Attorney, Agent, or Firm* — Neal, Gerber & Eisenberg LLP

(57) ABSTRACT

The present invention provides methods and devices for providing a bingo game having aspects of a non-bingo game such as a Class III game, preferably on a network of gaming machines. Some implementations of the invention provide a bingo game having aspects of a card game, such as a poker game. Some such implementations include a bingo card display in which areas of a bingo card correspond with playing cards. Some implementations of the invention provide bingo cards having more than one bingo number associated with an area of the bingo card. Other implementations of the invention allow a winning pattern, such as an interim win pattern, to be formed from hits on more than one bingo card. For example, a winning pattern may be formed by hits along a corresponding line of multiple bingo cards being played by a single player. Alternatively, a winning pattern may be formed by hits on the same corresponding area of multiple bingo cards being played by a single player.

23 Claims, 31 Drawing Sheets

(56) References Cited

U.S. PATENT DOCUMENTS 4,365,810 A 12/1982 Richardson ..... 273/237
4,371,169 A * 2/1983 Compton ..... 273/271
4,373,726 A 2/1983 Churchill et al. ..... 463/19
4,448,419 A 5/1984 Telnaes
4,455,025 A 6/1984 Itkis ..... 273/237
4,467,424 A 8/1984 Hedges et al.
4,494,197 A 1/1985 Troy et al.
4,560,171 A 12/1985 Anthony
4,582,324 A 4/1986 Koza et al.
4,624,462 A 11/1986 Itkis ..... 273/237
4,652,998 A 3/1987 Koza et al.
4,669,730 A 6/1987 Small
4,689,742 A 8/1987 Troy et al.
4,743,022 A 5/1988 Wood
4,798,387 A 1/1989 Richardson ..... 273/237
4,805,907 A 2/1989 Hagiwara
4,815,741 A 3/1989 Small
4,817,951 A 4/1989 Crouch et al.
4,842,278 A 6/1989 Markowicz
4,848,771 A 7/1989 Richardson ..... 273/237
4,856,787 A 8/1989 Itkis ..... 273/237
4,982,337 A 1/1991 Burr et al.
5,007,649 A 4/1991 Richardson ..... 463/25
5,011,159 A 4/1991 Fortunato et al.
5,042,809 A 8/1991 Richardson
5,092,598 A 3/1992 Kamille
5,100,137 A 3/1992 Fulton
5,100,139 A 3/1992 Di Bellam
5,145,182 A 9/1992 Swift et al.
5,158,293 A 10/1992 Mullins
5,167,413 A 12/1992 Fulton
5,224,706 A 7/1993 Bridgeman et al.
5,242,163 A 9/1993 Fulton ..... 273/138
5,265,874 A 11/1993 Dickinson et al.
5,275,400 A 1/1994 Weingardt et al.
5,276,312 A 1/1994 McCarthy
5,282,620 A 2/1994 Keesee
5,294,120 A 3/1994 Schultz
5,294,128 A 3/1994 Marquez
5,297,802 A 3/1994 Pocock et al. ..... 463/19
5,324,035 A 6/1994 Morris et al.
5,351,970 A 10/1994 Fioretti ..... 463/19
5,356,140 A 10/1994 Dabrowski et al.
5,393,057 A 2/1995 Marnell, II
5,398,932 A 3/1995 Eberhardt et al.
5,401,023 A 3/1995 Wood
5,407,199 A 4/1995 Gumina
5,482,289 A * 1/1996 Weingardt ..... 273/269
5,489,101 A 2/1996 Moody
5,511,781 A 4/1996 Wood et al.
5,531,448 A 7/1996 Moody
5,542,669 A 8/1996 Charron et al.
5,570,885 A 11/1996 Ornstein
5,584,486 A 12/1996 Franklin
5,588,913 A 12/1996 Hecht ..... 463/19
5,593,161 A 1/1997 Boylan et al.
5,628,684 A 5/1997 Boudec
5,630,754 A 5/1997 Rebane
5,639,088 A 6/1997 Schneider et al.
5,674,128 A 10/1997 Holch et al.
5,678,001 A 10/1997 Nagel et al.
5,707,285 A 1/1998 Place et al.
5,711,715 A 1/1998 Ringo et al.
5,718,431 A 2/1998 Ornstein
5,722,891 A 3/1998 Inoue
5,732,950 A 3/1998 Moody
5,755,619 A 5/1998 Matsumoto et al.
5,762,552 A 6/1998 Vuong et al. ..... 463/25
5,775,692 A 7/1998 Watts et al.
5,779,545 A 7/1998 Berg et al.
5,791,987 A 8/1998 Chen et al.
5,800,269 A 9/1998 Holch et al.
5,816,916 A 10/1998 Moody
5,823,873 A 10/1998 Moody
5,823,874 A 10/1998 Adams
5,833,537 A 11/1998 Barrie
5,833,540 A 11/1998 Miodunski et al.
5,848,932 A 12/1998 Adams
5,851,011 A 12/1998 Lott
5,868,619 A 2/1999 Wood et al.
5,871,398 A 2/1999 Schneier et al.
5,882,258 A 3/1999 Kelly et al.
5,882,260 A 3/1999 Marks et al.
5,944,606 A 8/1999 Gerow
5,949,042 A 9/1999 Dietz, II et al.
5,951,396 A 9/1999 Tawil
5,954,335 A 9/1999 Moody
5,954,582 A 9/1999 Zach
5,976,016 A 11/1999 Moody et al.
5,984,310 A 11/1999 English
5,984,779 A 11/1999 Bridgeman et al.
6,007,066 A 12/1999 Moody
6,007,424 A 12/1999 Evers et al.
6,012,720 A 1/2000 Webb
6,012,981 A 1/2000 Fujioka et al.
6,012,984 A 1/2000 Roseman ..... 463/42
6,017,032 A 1/2000 Grippo et al.
6,024,640 A 2/2000 Walker et al.
6,062,980 A 5/2000 Luciano
6,079,711 A 6/2000 Wei et al. ..... 273/269
6,089,982 A 7/2000 Holch et al.
6,093,100 A 7/2000 Singer et al. ..... 463/13
6,098,985 A 8/2000 Moody
6,120,378 A 9/2000 Moody et al.
6,126,541 A 10/2000 Fuchs
6,126,542 A 10/2000 Fier
6,132,311 A 10/2000 Williams
6,146,271 A 11/2000 Kadlic
6,146,272 A 11/2000 Walker et al.
6,149,156 A 11/2000 Feola
6,149,521 A 11/2000 Sanduski
6,159,095 A 12/2000 Frohm et al.
6,168,521 B1 1/2001 Bunce et al. ..... 463/18
6,174,233 B1 1/2001 Sunaga et al.
6,183,361 B1 2/2001 Cummings et al. ..... 463/18
6,190,255 B1 2/2001 Thomas et al.
6,196,547 B1 3/2001 Pascal et al.
6,203,429 B1 3/2001 Demar et al.
6,210,275 B1 4/2001 Olsen
6,210,276 B1 4/2001 Mullins
6,217,448 B1 4/2001 Olsen
6,220,961 B1 4/2001 Keane et al.
6,241,606 B1 6/2001 Riendeau et al.
6,254,480 B1 7/2001 Zach
6,257,980 B1 7/2001 Santini, Jr.
6,273,424 B1 8/2001 Breeding
6,273,820 B1 8/2001 Haste, III
6,280,325 B1 8/2001 Fisk ..... 463/19
6,280,328 B1 8/2001 Holch et al.
6,309,298 B1 10/2001 Gerow
6,312,334 B1 11/2001 Yoseloff
6,325,716 B1 12/2001 Walker et al.
6,358,151 B1 3/2002 Enzminger et al.
6,368,218 B2 4/2002 Angell, Jr.
6,394,456 B1 5/2002 Long
6,398,645 B1 * 6/2002 Yoseloff ..... 463/19
6,402,614 B1 6/2002 Schneier et al. ..... 463/17
6,419,583 B1 7/2002 Crumby et al.
6,425,824 B1 7/2002 Baerlocher et al.
6,450,885 B2 9/2002 Schneier et al.
6,454,648 B1 9/2002 Kelly et al.
RE37,885 E 10/2002 Acres et al.
6,475,086 B2 11/2002 Zach
6,494,454 B2 12/2002 Adams
6,508,711 B1 1/2003 Ono
6,511,068 B1 1/2003 Sklansky et al.
6,524,184 B1 2/2003 Lind et al.
6,524,185 B2 2/2003 Lind ..... 463/19
6,527,638 B1 3/2003 Walker et al.
6,533,664 B1 3/2003 Crumby
6,537,150 B1 3/2003 Luciano ..... 463/16
6,554,283 B2 4/2003 Vancura et al.
6,569,017 B2 5/2003 Enzminger et al. ..... 463/19
6,575,467 B1 6/2003 Kal

(56) References Cited

U.S. PATENT DOCUMENTS

| | | | | |
|---|---|---|---|---|
| 6,585,266 | B1 * | 7/2003 | Lovell | 273/269 |
| 6,585,590 | B2 | 7/2003 | Malone | |
| 6,599,187 | B2 | 7/2003 | Gerow | |
| 6,607,439 | B2 | 8/2003 | Schneier et al. | |
| 6,609,974 | B2 | 8/2003 | Mead et al. | |
| 6,612,927 | B1 | 9/2003 | Slomiany et al. | |
| 6,619,660 | B2 | 9/2003 | Schaefer et al. | |
| 6,656,044 | B1 * | 12/2003 | Lewis | 463/19 |
| 6,676,126 | B1 | 1/2004 | Walker et al. | |
| 6,685,562 | B1 | 2/2004 | Rantanen | |
| 6,695,695 | B2 | 2/2004 | Angel | |
| 6,722,655 | B1 | 4/2004 | Camero | 273/269 |
| 6,729,621 | B2 | 5/2004 | Moody | |
| 6,729,961 | B1 | 5/2004 | Millerschone | |
| 6,733,385 | B1 | 5/2004 | Enzminger et al. | |
| 6,739,970 | B2 | 5/2004 | Luciano | |
| 6,743,102 | B1 | 6/2004 | Fiechter et al. | |
| 6,749,500 | B1 | 6/2004 | Nelson et al. | |
| 6,780,108 | B1 | 8/2004 | Luciano et al. | |
| 6,802,776 | B2 | 10/2004 | Lind et al. | |
| 6,802,778 | B1 | 10/2004 | Lemay et al. | |
| 6,805,629 | B1 | 10/2004 | Weiss | |
| 6,840,858 | B2 | 1/2005 | Adams | |
| 6,874,784 | B1 | 4/2005 | Promutico et al. | |
| 6,918,831 | B2 | 7/2005 | Nguyen et al. | |
| 6,923,719 | B2 | 8/2005 | Wolf | |
| 6,932,707 | B2 | 8/2005 | Duhamel | |
| 7,059,966 | B2 | 6/2006 | Luciano, Jr. et al. | |
| 7,128,647 | B2 * | 10/2006 | Muir | 463/20 |
| 7,481,707 | B1 | 1/2009 | Luciano et al. | |
| 2001/0036855 | A1 | 11/2001 | DeFrees-Parrott et al. | 463/17 |
| 2001/0046892 | A1 | 11/2001 | Santini, Jr. | |
| 2002/0010013 | A1 | 1/2002 | Walker et al. | |
| 2002/0094869 | A1 | 7/2002 | Harkham | 463/42 |
| 2002/0098882 | A1 | 7/2002 | Lind et al. | |
| 2002/0098883 | A1 | 7/2002 | Packes, Jr. et al. | |
| 2002/0111207 | A1 | 8/2002 | Lind et al. | 463/19 |
| 2002/0113369 | A1 | 8/2002 | Weingardt | 273/269 |
| 2002/0132661 | A1 | 9/2002 | Lind et al. | 463/19 |
| 2002/0155877 | A1 | 10/2002 | Enziminger et al. | |
| 2002/0196342 | A1 | 12/2002 | Walker et al. | |
| 2003/0060257 | A1 | 3/2003 | Katz et al. | |
| 2003/0060261 | A1 | 3/2003 | Katz et al. | |
| 2003/0060276 | A1 | 3/2003 | Walker et al. | |
| 2003/0098544 | A1 | 5/2003 | Tarantino | |
| 2003/0125101 | A1 | 7/2003 | Campo | 463/19 |
| 2003/0127793 | A1 | 7/2003 | Adams | |
| 2003/0144050 | A1 | 7/2003 | Keaton et al. | |
| 2003/0162577 | A1 | 8/2003 | Hamud | |
| 2003/0181231 | A1 | 9/2003 | Vancura et al. | |
| 2003/0190943 | A1 | 10/2003 | Walker et al. | |
| 2003/0216165 | A1 | 11/2003 | Singer et al. | |
| 2003/0228899 | A1 | 12/2003 | Evans | |
| 2003/0236116 | A1 | 12/2003 | Marks et al. | |
| 2004/0023706 | A1 | 2/2004 | Hunter et al. | |
| 2004/0036212 | A1 | 2/2004 | Walker et al. | |
| 2004/0038723 | A1 | 2/2004 | Schneier et al. | |
| 2004/0053675 | A1 | 3/2004 | Nguyen et al. | |
| 2004/0072604 | A1 | 4/2004 | Toyoda | |
| 2004/0072605 | A1 | 4/2004 | Toyoda | |
| 2004/0077400 | A1 * | 4/2004 | Marshall | 463/19 |
| 2004/0132523 | A1 | 7/2004 | Staw | |
| 2004/0142747 | A1 | 7/2004 | Pryzby | |
| 2004/0152503 | A1 | 8/2004 | Lind et al. | |
| 2004/0152505 | A1 * | 8/2004 | Herrmann et al. | 463/16 |
| 2004/0152508 | A1 | 8/2004 | Lind et al. | |
| 2004/0166920 | A1 | 8/2004 | Boyd | |
| 2004/0185932 | A1 | 9/2004 | Lombardo | |
| 2004/0219969 | A1 | 11/2004 | Casey et al. | |
| 2004/0235542 | A1 | 11/2004 | Stronach et al. | |
| 2004/0235555 | A1 | 11/2004 | Yarbrough et al. | |
| 2004/0259621 | A1 | 12/2004 | Pfeiffer et al. | |
| 2004/0266507 | A1 | 12/2004 | Cooper | |
| 2005/0026665 | A1 | 2/2005 | Gerrard et al. | |
| 2005/0037832 | A1 | 2/2005 | Cannon | |
| 2005/0037834 | A1 | 2/2005 | Stern et al. | |
| 2005/0054426 | A1 | 3/2005 | Toyoda | |
| 2005/0059449 | A1 | 3/2005 | Yarbrough | |
| 2005/0059469 | A1 | 3/2005 | Gail et al. | |
| 2005/0059471 | A1 | 3/2005 | Cannon | |
| 2005/0096130 | A1 | 5/2005 | Mullins | |
| 2005/0101387 | A1 | 5/2005 | Wolf | |
| 2005/0167916 | A1 | 8/2005 | Banyai | |
| 2005/0221883 | A1 | 10/2005 | Lind et al. | |
| 2005/0233798 | A1 * | 10/2005 | Van Asdale | 463/19 |
| 2006/0025189 | A1 | 2/2006 | Hollibaugh et al. | |
| 2006/0025198 | A1 | 2/2006 | Gail et al. | |
| 2006/0217176 | A1 | 9/2006 | Walker et al. | |
| 2007/0093286 | A1 | 4/2007 | Marshall | |
| 2007/0135211 | A1 | 6/2007 | Block et al. | |
| 2007/0142113 | A1 | 6/2007 | Walker et al. | |
| 2008/0070663 | A1 | 3/2008 | Losilevsky | |

FOREIGN PATENT DOCUMENTS

| | | |
|---|---|---|
| EP | 1302914 | 4/2003 |
| EP | 1341135 | 9/2003 |
| EP | 1343125 | 9/2003 |
| WO | WO96/18174 | 6/1996 |
| WO | WO 96/18174 | 6/1996 |
| WO | WO01/99067 | 12/2001 |
| WO | WO 01/99067 | 12/2001 |
| WO | WO 03063019 | 7/2003 |
| WO | WO 2004/095383 | 11/2004 |

OTHER PUBLICATIONS

EP Examiner's Communication, dated Jul. 3, 2006, from EP App No. 04783935.2.

EP Examiner's Communication, dated Jul. 3, 2006, from EP App No. 04784071.5.

EP Examiner's Communication, mailed Oct. 25, 2006, from EP App No. 04784069.9.

US Restriction Requirement mailed Jun. 8, 2007, from U.S. Appl. No. 10/931,673.

US Office Action mailed Aug. 20, 2007, from U.S. Appl. No. 10/931,673.

US Office Action mailed Jul. 3, 2007, from U.S. Appl. No. 10/755,982.

International Search Report, mailed Jun. 6, 2007 from International App No. PCT/US2006/048264, 5 pp. including Notification of Transmittal.

Written Opinion of the International Searching Authority mailed Jun. 6, 2007 from International App No. PCT/US2006/048264, 7 pp.

International Search Report and Written Opinion of the International Searching Authority, mailed Jul. 4, 2007 from International Application No. PCT/US2006/047714, 11 pp including Notification of Transmittal.

US Office Action mailed Sep. 21, 2007, from U.S. Appl. No. 10/756,429.

US Office Action mailed Sep. 13, 2007, from U.S. Appl. No. 10/941,606.

US Office Action mailed Jun. 27, 2007, from U.S. Appl. No. 11/026,860.

Examination Report from Related European Patent Application No. 04 778 725.2, dated Oct. 22, 2007, 9 pages.

US Office Action mailed Dec. 21, 2007, from U.S. Appl. No. 11/026,860.

US Office Action mailed Mar. 17, 2008, from U.S. Appl. No. 10/937,227.

US Office Action mailed Sep. 12, 2007, from U.S. Appl. No. 10/969,127.

Aho et al., *Data Structures and Algorithms*, Addison-Wesley, 1983, pp. 13-16, 56-57, 260-261.

Diamonopoly Advertisement by International Gamco, Inc., published 2002. Electronic Pull Tabs Advertisement by 21st Century Gaming, published prior to 2002.

Lucky Times California Lottery Newsletter published 1996. Instant Winner Advertisement by Williams/WMS Gaming, published prior to 2002.

(56) References Cited

OTHER PUBLICATIONS

Play it again Advertisement by International Gamco, Inc., published 2000. International Search Report and Written Opinion of the International Searching Authority dated Jan. 24, 2005, for related PCT Application No. PCT/US2004/029906.
International Search Report and Written Opinion of the International Searching Authority dated Jan. 25, 2005, for related PCT Application No. PCT/US2004/029913.
International Search Report and Written Opinion of the International Searching Authority dated Jan. 24, 2005, for related PCT Application No. PCT/US2004/030093.
International Search Report and Written Opinion of the International Searching Authority dated Feb. 3, 2005, for related PCT Application No. PCT/US2004/030285.
International Search Report and Written Opinion of the International Searching Authority dated Feb. 3, 2005, for related PCT Application No. PCT/US2004/029839.
US Office Action dated Jul. 2, 2009 issued in U.S. Appl. No. 10/925,710.
US Office Action dated Jul. 9, 2008 issued in U.S. Appl. No. 11/026,860.
US Office Action dated Apr. 8, 2009 issued in U.S. Appl. No. 11/026,860.
U.S. Office Action dated Apr. 29, 2008 issued in U.S. Appl. No. 11/031,048.
US Office Action dated Nov. 12, 2008 issued in U.S. Appl. No. 11/031,048.
US Office Action dated Jun. 12, 2009 issued in U.S. Appl. No. 11/031,048.
US Office Action dated Apr. 26, 2010 issued in U.S. Appl. No. 11/031,048.
US Office Action dated Nov. 17, 2008 issued in U.S. Appl. No. 10/937,227.
US Final Office Action dated Jun. 17, 2009 issued in U.S. Appl. No. 10/937,227.
US Office Action dated Jan. 12, 2010 issued in U.S. Appl. No. 10/937,227.
US Examiner Interview Summary Record dated Jan. 24, 2008 issued in U.S. Appl. No. 10/969,127.
US Final Office Action dated Apr. 3, 2008 issued in U.S. Appl. No. 10/969,127.
US Office Action dated Sep. 16, 2008 issued in U.S. Appl. No. 10/969,127.
US Final Office Action dated Apr. 3, 2009 issued in U.S. Appl. No. 10/969,127.
US Pre-Brief Appeal Conference Decision dated Aug. 21, 2009 issued in U.S. Appl. No. 10/969,127.
US Examiner Interview Summary Record dated Sep. 4, 2009 issued in U.S. Appl. No. 10/969,127.
US Office Action dated Dec. 22, 2009 issued in U.S. Appl. No. 10/969,127.
US Examiner Interview Summary Record dated Mar. 31, 2010 issued in U.S. Appl. No. 10/969,127.
Encyclopedia > Suit (cards) NationMaster.com [online], [retrieved on Apr. 7, 2010]. Retrieved from the Internet <URL:http:www.statemaster.com/encyclopedia/Suit-(cards)>, 9 pages.

* cited by examiner

| | ♠ | ♦ | ♣ | ♥ |
|---|---|---|---|---|
| 2 | 37 | 63 | 72 | 36 |
| 3 | 18 | 67 | 73 | 14 |
| 4 | 7 | 8 | 2 | 61 |
| 5 | 51 | 71 | 11 | 32 |
| 6 | 35 | 15 | 47 | 26 |
| 7 | 40 | 43 | 17 | 16 |
| 8 | 44 | 55 | 75 | 10 |
| 9 | 69 | 42 | 19 | 12 |
| 10 | 62 | 57 | 31 | 29 |
| J | 65 | 66 | 60 | 1 |
| Q | 4 | 6 | 22 | 48 |
| K | 58 | 25 | 3 | 34 |
| A | 21 | 56 | 30 | 23 |

70

| | ♦ | ♣ | ♥ | ♠ | ☾ |
|---|---|---|---|---|---|
| 2 | B9 | I14 | N30 | | O40 |
| 3 | B5 | I11 | N26 | G37 | |
| 4 | B10 | | | G32 | |
| 5 | | | N21 | | O44 |
| 6 | | I20 | | G40 | O45 |
| 7 | | I19 | N25 | G34 | |
| 8 | B1 | | N28 | | O48 |
| 9 | B4 | I17 | | G38 | O41 |
| 10 | B2 | I15 | N23 | G39 | O49 |
| J | B6 | I18 | N27 | G36 | O42 |
| Q | B8 | I12 | N24 | G35 | O47 |
| K | B7 | I13 | N29 | G33 | O43 |
| A | B3 | I16 | N22 | G31 | O46 |

42

*Fig. 3D*

| Card | B/ Diamonds | I/ Spades | N/ Hearts | G/ Clubs | O/ Stars |
|---|---|---|---|---|---|
| Ace | 9 | 17 | 32 | 58 | 75 |
| King | 2 | 16 | 45 | 53 | 64 |
| Queen | 11 | 27 | Free | 60 | 72 |
| Jack | 10 | 30 | 31 | 46 | 66 |
| 10 | 6 | 25 | 43 | 49 | 67 |
| 9 | | | | | |
| 8 | | | | | |
| 7 | | | | | |
| 6 | | | | | |
| 5 | | | | | |
| 4 | | | | | |
| 3 | | | | | |
| 2 | | | | | |

1010

| Card | B/ Diamonds | I/ Spades | N/ Hearts | G/ Clubs | O/ Stars |
|---|---|---|---|---|---|
| Ace | 9 | 17 | 32 | 58 | 75 |
| King | 2 | 16 | 45 | 53 | 64 |
| Queen | 11 | 27 | Free | 60 | 72 |
| Jack | 10 | 30 | 31 | 46 | 66 |
| 10 | 6 | 25 | 43 | 49 | 67 |
| 9 | | | | | |
| 8 | | | | | |
| 7 | | | 44 | | |
| 6 | | | | | |
| 5 | | | | | |
| 4 | | | | | |
| 3 | | | | | |
| 2 | | | | | |

*Fig. 10*

1010

| Card | B/ Diamonds | I/ Spades | N/ Hearts | G/ Clubs | O/ Stars |
|---|---|---|---|---|---|
| Ace | 9 | 17 | 32 | 58 | 75 |
| King | 2 | 16 | 45 | 53 | 64 |
| Queen | 11 | 27 | Free | 60 | 72 |
| Jack | 10 | 30 | 31 | 46 | 66 |
| 10 | 6 | 25 | 43 | 49 | 67 |
| 9 | | | | 54 | |
| 8 | | | 37 | | |
| 7 | | | 44 | | |
| 6 | | | | 57 | |
| 5 | | | | | |
| 4 | | | 41 | | |
| 3 | | | | | |
| 2 | | 28 | | | |

*Fig. 12*

1010

| Card | B/ Diamonds | I/ Spades | N/ Hearts | G/ Clubs | O/ Stars |
|---|---|---|---|---|---|
| Ace | 9 | 17 | 32 | 58 | 75 |
| King | 2 | 16 | 45 | 53 | 64 |
| Queen | 11 | 27 | Free | 60 | 72 |
| Jack | 10 | 30 | 31 | 46 | 66 |
| 10 | 6 | 25 | 43 | 49 | 67 |
| 9 | 74 | 29 | 35 | 54 | 68 |
| 8 | 12 | 26 | 37 | 55 | 69 |
| 7 | 14 | 22 | 44 | 59 | 70 |
| 6 | 4 | 48 | 36 | 57 | 62 |
| 5 | 1 | | 39 | 50 | 73 |
| 4 | 8 | 21 | 41 | 47 | 61 |
| 3 | 3 | 23 | | 52 | 63 |
| 2 | 5 | 28 | 42 | 51 | 65 |

*Fig. 14*

1010

| Column/ Card | Diamonds | Spades | Hearts | Clubs | Stars |
|---|---|---|---|---|---|
| O/Ace | 75 | 64 | 72 | 66 | 67 |
| G/King | 58 | 53 | 60 | 46 | 49 |
| N/Queen | 32 | 45 | Free | 31 | 43 |
| I/ Jack | 17 | 16 | 27 | 30 | 25 |
| B/10 | 9 | 2 | 11 | 10 | 6 |
| 9 | | | | | |
| 8 | | | | | |
| 7 | | | | | |
| 6 | | | | | |
| 5 | | | | | |
| 4 | | | | | |
| 3 | | | | | |
| 2 | | | | | |

*Fig. 16*

1010

| Card | B/ Diamonds | I/ Spades | N/ Hearts | G/ Clubs | O/ Stars |
|---|---|---|---|---|---|
| Ace | 6 | 25 | 43 | 49 | 67 |
| King | 10 | 30 | 31 | 46 | 66 |
| Queen | 11 | 27 | Free | 60 | 72 |
| Jack | 2 | 16 | 45 | 53 | 64 |
| 10 | 9 | 17 | 32 | 58 | 75 |
| 9 | | | | | |
| 8 | | | | | |
| 7 | | | | | |
| 6 | | | | | |
| 5 | | | | | |
| 4 | | | | | |
| 3 | | | | | |
| 2 | | | | | |

*Fig. 18A*

BINGO GAME WITH MULTICARD PATTERNS

CROSS-REFERENCE TO RELATED APPLICATIONS

This application claims priority to U.S. Provisional Patent Application No. 60/592,410, entitled "Draw Bingo" and filed Jul. 30, 2004, which is hereby incorporated by reference for all purposes.

This application is related to U.S. patent application Ser. No. 10/937,227, entitled "Bingo Game Morphed to Display Non-Bingo Outcomes" and filed on Sep. 8, 2004, which is hereby incorporated by reference for all purposes.

BACKGROUND OF THE INVENTION

The present disclosure relates to gaming networks and, more particularly, to a gaming network providing a multi-player bingo game.

Gaming in the United States is divided into Class I, Class II and Class III games. Class I gaming includes social games played for minimal prizes, or traditional ceremonial games. Class II gaming includes bingo and bingo-like games. Bingo includes games played for prizes, including monetary prizes, with cards bearing numbers or other designations in which the holder of the cards covers such numbers or designations when objects, similarly numbered or designated, are drawn or electronically determined, and in which the game is won by the first person covering a previously designated arrangement of numbers or designations on such cards. Such an arrangement will sometimes be referred to herein as a "game-winning pattern" or a "game-ending pattern." Class II gaming may also include pull tab games if played in the same location as bingo games, lotto, punch boards, tip jars, instant bingo, and other games similar to bingo. Class III gaming includes any game that is not a Class I or Class II game, such as a game of chance typically offered in non-Indian, state-regulated casinos.

Two basic forms of bingo exist. In traditional bingo, the players purchase cards after which a draw takes place. The first player to achieve a designated pattern wins. In one type of bingo game known as Bonanza Bingo, the draw for the game takes place before the players know the arrangements on their bingo cards. After the draw occurs, the players may purchase cards and compare the arrangements on the cards to the drawn numbers to determine whether predetermined patterns are matched. Play continues in Bonanza Bingo until at least one of the players matches a designated game-winning pattern. Bonanza Bingo may also encompass bingo variations wherein a partial draw is conducted for some numbers (generally fewer than the number of balls expected to be necessary to win the game) prior to selling the bingo cards. After the bingo cards are sold, additional numbers are drawn until there is a winner.

As indicated above, a bingo game is played until at least one player covers a predetermined game-winning pattern on the player's bingo card. The game may also include interim winners of prizes based on matching predetermined interim patterns on the bingo card using the same ball draw. The interim pattern wins do not terminate the bingo game. For interim pattern awards, players covering certain interim patterns may receive an additional award as the game continues. Some exceptional bingo versions may allow bingo draws beyond those needed to achieve the bingo game win so as to pay out interim pattern wins at a desired rate. The game-winning awards are generally pari-mutuel in nature. That is, the bingo win award is based upon the total amount wagered on a given occurrence of the bingo game. However, interim pattern awards typically are not pari-mutuel.

Gaming machines such as slot machines and video poker machines have proven to be very popular. However, many games of chance that are played on gaming machines fall into the category of Class III games, which may be subject to stricter approval and regulation. Many gaming establishments have a limited number of gaming machines for playing Class III games and a greater number of gaming machines for playing Class II games, such as bingo.

As such, it would be desirable to provide a gaming system wherein a Class II game may be played on a gaming machine with at least some of the "look and feel" of a Class III game, such as a slot game or a card game. It would also be desirable to provide variations of existing bingo games to increase player interest.

SUMMARY OF THE INVENTION

The present invention provides methods and devices for providing a bingo game having aspects of a non-bingo game such as a Class III game, preferably on a network of gaming machines. Some implementations of the invention provide a bingo game having aspects of a card game, such as a poker game. Some such implementations include a bingo card display in which areas of a bingo card correspond with playing cards. Some implementations of the invention provide bingo cards having more than one bingo number associated with an area of the bingo card. Other implementations of the invention allow a winning pattern, such as an interim win pattern, to be formed from hits on more than one bingo card. For example, a winning pattern may be formed by hits along a corresponding line of multiple bingo cards being played by a single player (e.g., along the same diagonal line). Alternatively, a winning pattern may be formed by hits on the same corresponding area of multiple bingo cards being played by a single player (e.g., hits on the lower left area of each bingo card).

Preferred implementations provide games with easily recognizable bingo play. Accordingly, some implementations involve a 5×5 bingo card, wherein areas of the bingo card correspond with non-bingo symbols such as playing cards, and 75 randomly chosen numbers for game play. Bingo numbers are also assigned to areas of the bingo card, although these bingo numbers may or may not be displayed on the card. The randomly chosen numbers may be indicated by a "ball drop" involving a predetermined number of balls. Alternative implementations involve other types of bingo cards, including bingo cards with more or fewer areas, and the use of more or fewer than 75 randomly chosen numbers for game play.

However, alternative embodiments use various N×N and N×M bingo cards, wherein N and M are predetermined integers. For example, some implementations use a 4×13 or a 13×4 bingo card, allowing each card of a 52-card deck to be mapped to the bingo card. Other implementations use a mapping of playing cards in a deck having more or fewer than 52 cards. Yet other implementations use a mapping of playing cards in multiple card decks.

Some aspects of the invention provide a method of conducting a bingo game involving a plurality of players. The method includes these steps: forming a plurality of bingo cards by assigning a plurality of areas of each bingo card to corresponding playing card symbols; mapping bingo numbers to areas of the bingo cards, wherein the mapping differs as to at least some areas of each bingo card; providing at least some of the plurality of bingo cards to players; randomly drawing the bingo numbers; indicating hits on each bingo card when a randomly drawn bingo number corresponds with a bingo number on an area of the bingo card; and determining when a player's bingo card achieves a winning pattern of hits. The pattern corresponds to a hand of playing cards.

The playing card symbols may be selected from more than one deck of playing cards. In some implementations, a playing card symbol assigned to an area of a bingo card is revealed to a player only after there is a bingo number is drawn corresponding to the area of the bingo card.

The mapping step may involve mapping more than one bingo number to a selected area of a bingo card. The selected area may be selected by a player or by a gaming system, e.g. by a game server. The selected area may be determined before or after a player receives a bingo card, depending on the implementation. The indicating step may involve indicating when there is a hit on one of the bingo numbers in the selected area.

In some implementations, a corresponding playing card symbol will be displayed in at least a portion of the selected area only after there is a hit on one of the bingo numbers in the selected area. The player may be required to select or discard the corresponding playing card symbol within a predetermined period of time after indicating when there is a hit on a first one of the bingo numbers in the selected area. Some such implementations of the method also include these steps: receiving an indication that the player has selected the corresponding playing card symbol within the predetermined period of time; and including only the selected playing card symbol when determining whether a winning pattern can be formed, in part, from the selected area. According to some implementations, the selected area will be included in a pattern only when there is a hit on all of the bingo numbers in the selected area.

The bingo cards may be, for example, N×N or N×M bingo cards, where N and M are integers. The pattern may be an interim win pattern, a game-winning pattern or a progressive win pattern.

Alternative implementations of the invention provide another method of providing a wagering game. This method includes the following steps: providing B bingo cards to each of a first plurality of players; randomly selecting N bingo numbers; indicating hits in areas of the bingo cards, the areas corresponding to at least one of the N bingo numbers; and determining whether a winning pattern can be formed by combining hits in areas of more than one of the player's bingo cards. The method may include the step of presenting the winning pattern when it is determined that the winning pattern can be formed by combining hits in areas of more than one of the player's bingo cards.

The determining step could involve determining whether a 3-dimensional pattern is formed by combining hits on a plurality of the bingo cards. The indicating step may involve displaying a playing card in each area of the bingo cards where there is a hit.

The winning pattern may be an interim win pattern or a game-winning pattern. The method may include the step of randomly selecting additional numbers until the determining step determines that a game-winning pattern has been formed by combining hits from at least two of a player's bingo cards.

In some implementations, at least one selected area of a bingo card corresponds with more than one bingo number. In some implementations, a selected area will be included in a pattern only when there is a hit on all of the bingo numbers in the selected area.

In some implementations, fewer than B bingo cards are provided to each of a second plurality of players. A first wager may be received from each of the first plurality of players and a second wager may be received from each of the second plurality of players. In some instances, the first wager is greater than the second wager.

The bingo cards may be provided on a display of a gaming machine. The indicating step may involve displaying the areas that form the winning pattern in a manner that is distinct from areas that do not form the winning pattern. The presenting step may involve: making a simulation of dealing playing cards corresponding to the areas that form the winning pattern; and forming a playing card hand display from dealt playing cards.

The step of determining whether a winning pattern can be formed can involve combining hits in various ways, e.g., in a single corresponding area of more than one of the player's bingo cards or along a single corresponding line of more than one of the player's bingo cards.

Yet other methods of providing a wagering game are aspects of the present invention. One such method includes these steps: allowing each of a plurality of players to select a desired number of bingo cards; displaying the selected bingo cards to each player; providing each player with an option of combining hits in areas of more than one of the player's selected bingo cards to form a winning pattern; and determining whether each player has chosen the option. The bingo cards may be displayed on a gaming machine.

The method may also involve these steps: randomly selecting N bingo numbers; indicating hits in areas of the bingo cards, the areas having numbers corresponding to any of the N bingo numbers; and determining, when a player has selected the option, whether an interim win pattern can be formed by combining hits in areas of more than one of the player's bingo cards.

The step of determining whether an interim win pattern can be formed may involve combining hits in a single corresponding area of more than one of the player's bingo cards and/or combining hits along a single corresponding line of more than one of the player's bingo cards. In some implementations, the determining step involves determining whether a 3-dimensional pattern is formed by combining hits on a plurality of the bingo cards.

The indicating step may involve displaying a playing card in each area of the bingo cards where there is a hit. The presenting step may involve displaying the interim win pattern as a hand of playing cards and/or displaying the areas that form the interim win pattern in a manner that is distinct from areas that do not form the interim win pattern.

All of the foregoing methods, along with other methods of the present invention, may be implemented by software, firmware and/or hardware. For example, the methods of the present invention may be implemented by computer programs embodied in machine-readable media. The invention may be implemented by networked gaming machines, game servers and/or other such devices.

For example, some implementations of the invention provide computer software embodied in at least one machine-readable medium. The computer software includes instructions for controlling devices in a gaming network to perform the following steps: form a plurality of bingo cards by assigning a plurality of areas of each bingo card to corresponding playing card symbols; map bingo numbers to areas of the bingo cards, wherein the mapping differs as to at least some areas of each bingo card; provide at least some of the plurality of bingo cards to players; randomly draw the bingo numbers; indicate hits on each bingo card when a randomly drawn bingo number corresponds with a bingo number on an area of the bingo card; and determine when a player's bingo card achieves a winning pattern of hits, the pattern corresponding to a hand of playing cards.

Alternative implementations of the invention provide a gaming network for conducting a bingo game involving a plurality of players. The gaming network includes a game server and a plurality of gaming machines. The game server includes: at least one logic device configured to form a plurality of electronic representations of bingo cards ("bingo cards") by assigning a plurality of areas of each bingo card to corresponding playing card symbols and to map bingo numbers to areas of the bingo cards, wherein the mapping differs as to at least some areas of each bingo card; a random number generator for randomly drawing the bingo numbers; at least one port for providing at least some of the plurality of bingo cards and randomly drawn bingo numbers to gaming machines. Each gaming machine is configured to display the bingo cards, to indicate hits on each bingo card when a randomly drawn bingo number corresponds with a bingo number on an area of the bingo card, to determine when a player's bingo card achieves a winning pattern of hits and to display the winning pattern as a hand of playing cards.

Yet other implementations of the invention provide computer software embodied in at least one machine-readable medium. The computer software includes instructions for controlling devices in a gaming network to perform the following steps: providing B bingo cards to each of a first plurality of players; randomly selecting N bingo numbers; indicating hits in areas of the bingo cards, the areas corresponding to at least one of the N bingo numbers; and determining whether a winning pattern can be formed by combining hits in areas of more than one of the player's bingo cards.

Still other embodiments of the invention provide a gaming network for providing a wagering game. The gaming network includes a game server and a plurality of gaming machines. The game server includes: at least one logic device configured to form electronic representations of a plurality of bingo cards ("bingo cards") and to randomly select N bingo numbers; and at least one port configured for communication with a plurality of gaming machines and for providing multiple bingo cards selected from the plurality of bingo cards to players of each of the plurality of gaming machines. The gaming machines are configured to display the multiple bingo cards, to indicate hits in areas of the multiple bingo cards, the areas corresponding to at least one of the N bingo numbers, and to determine whether a winning pattern can be formed by combining hits in areas of more than one of the player's multiple bingo cards.

These and other features and advantages of the invention will be described in more detail below with reference to the associated drawings.

BRIEF DESCRIPTION OF THE DRAWINGS

FIG. 3D is a schematic illustration of a mapping of bingo numbers to non-bingo symbols according to one example of the present invention.

FIG. 10 illustrates a display when a 1st card is drawn in one example of a game according to the present invention.

FIG. 12 is a mapping chart that illustrates the mapping of drawn cards to their corresponding places on the display of FIG. 11.

FIG. 14 is a mapping chart that illustrates the mapping of drawn cards to their corresponding places on the display of FIG. 13.

FIGS. 15 and 16 illustrate an alternative mapping strategy according to the invention, wherein the columns of a Bingo card are each mapped to a corresponding rank of playing cards.

FIGS. 17 and 18A illustrate another mapping strategy according to the invention, wherein the numbers in a particular column may be mapped to the 10 through ace of a particular suit, but with the playing cards of the alternate game card being arranged such that each row corresponds to a royal flush for a particular suit.

DESCRIPTION OF THE PREFERRED EMBODIMENTS

Figure 1:
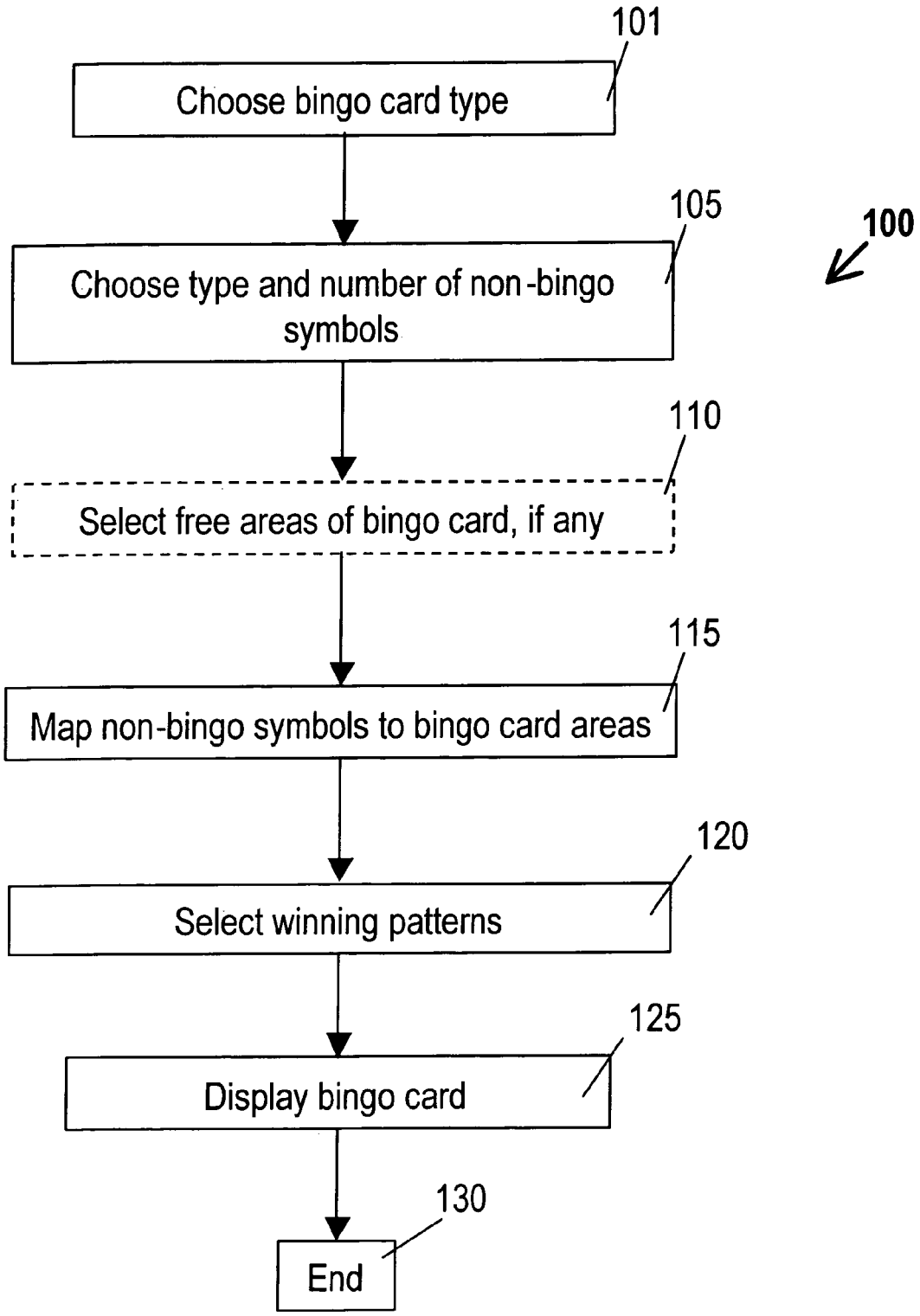
FIG. 1 is a schematic flow diagram illustrating one method for creating bingo cards for the morphed bingo game of the present invention.

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

The present invention provides methods and devices for providing, preferably on a network of gaming machines, a bingo game having aspects of a non-bingo game, such as a card game or a slot game. The non-bingo game may be a Class III game, such as a card game or a slot game.

Some aspects of the present invention provide a primary or base wagering game and/or a secondary or bonus game. In various embodiments, the game includes a bingo game that is displayed on a gaming machine to appear like a slot game, a card game or other game. While adding variety to the display of bingo, the game still falls within the limits of the regulations of Class II gaming for bingo games. The game of the present invention can be implemented, for example, in a gaming device according to game data received from a game server. The gaming device may receive such game data through a dedicated gaming network and/or through a public data network such as the Internet.

Some implementations of the invention provide a bingo game having aspects of a card game, such as a poker game. Some such implementations include a bingo card display in which areas of a bingo card correspond with playing cards. As used herein, the term "bingo card" includes a traditional bingo card having areas populated with bingo numbers, as well as game cards having areas populated with non-bingo symbols, the areas and/or non-bingo symbols corresponding to bingo numbers. Bingo numbers may or may not be displayed on bingo cards of the present invention.

Preferred implementations provide games with easily recognizable bingo play. Accordingly, some implementations involve a 5×5 bingo card, wherein areas of the bingo card correspond with non-bingo symbols such as playing cards, and 75 randomly chosen numbers for game play. Bingo numbers are also assigned to areas of the bingo card, although these bingo numbers may or may not be displayed on the card. The randomly chosen numbers may be indicated by a "ball drop" involving a predetermined number of balls. Alternative implementations involve other types of bingo cards, including bingo cards with more or fewer areas, and the use of more or fewer than 75 randomly chosen numbers for game play.

In some embodiments, a gaming machine displays a game card to the player that includes areas within which playing cards are indicated instead of, or in addition to, bingo numbers. Because poker is a popular card game, much of the following discussion involves a bingo game having attributes of a poker game. However, in other implementations of the invention, the non-bingo game is another type of card game, a slot game, etc.

In some embodiments, a non-bingo game is provided as an option to the bingo player. That is, the bingo player can elect to play a normal version of bingo or play a bingo game having aspects of a non-bingo game.

Within the game of poker, different types of winning hands may be used. That is, in some embodiments illustrated below that are played using a 5×5 bingo card, the Ten, Jack, Queen, King and Ace of the four known suits of cards, plus an additional card suit, are used. The royal flush cards for the four suits and a new fifth suit may be used. In another embodiment, the Two, Three, Four, Five and Six cards can be used. In another embodiment, five cards of a same suit are used. Some bingo cards include one or more "joker" cards that may be used to represent any playing card.

In some embodiment, areas of a bingo card correspond to randomly generated bingo numbers. In some embodiments, the bingo numbers are displayed on the bingo card and in alternative embodiments, the bingo numbers are not displayed on the bingo card. The bingo numbers of the player's card are mapped to or associated with non-bingo symbols that are displayed on the bingo card. Preferably, the non-bingo symbols are associated with the same areas of each bingo card.

In some preferred embodiments, the bingo number corresponding to an area of a player's bingo card is mapped to a playing card symbol that is displayed in that area. For example, if the bingo number nine corresponds to the upper left-hand corner of the bingo card and the upper left-hand corner of the displayed bingo card of the present invention displays the Ten of Diamonds, then the bingo number 9 is mapped to or associated with the Ten of Diamonds on the game card displayed. In that manner, if the bingo number 9 is drawn during the game, the game of the present invention, having mapped that number to the Ten of Diamonds, marks the corresponding Ten of Diamonds spot as a "hit" on the displayed game card of the present invention. Some implementations require a player to mark such hits, e.g., within a predetermined time, or the hits will not count.

The underlying game may be played substantially the same way as a normal game of bingo. However, the player may see non-bingo symbols displayed on the bingo card(s) instead of (or in addition to) seeing bingo numbers. The non-bingo symbols may be playing cards that are arranged according to the rules of a card game, such as poker.

In some implementations wherein a bingo number can be drawn that is not a member of the displayed bingo card, the bingo number may be mapped to a non-bingo symbol that is not displayed on the game card. For example, a card game may involve a 52-card deck and the bingo card may have fewer than 52 areas wherein playing card symbols are displayed. In such implementations, drawn bingo numbers may be mapped to playing card symbols that are not displayed on the bingo card. Such playing card symbols may or may not be shown to the player. If the playing card symbols are shown to the player, they may be displayed, for example, as cards drawn from a deck and placed in a discard pile.

According to some implementations, the isomorphic game of the present invention is won by the first player who obtains a winning hand of cards. That player is the same player who, if playing traditional bingo, would have been the first player to receive hits in a predetermined pattern, e.g., five marked spots in a row, column or diagonally or another suitably predetermined game-winning pattern. The winner wins a suitable prize or credit amount associated with standard bingo gaming, and, in one embodiment, bingo gaming continues as with known bingo, wherein multiple bingo games are played in sequence. Alternative implementations provide for multiple "interim" winners who have hits on their bingo cards that complete other predetermined patterns. Such interim wins may be made without ending the game.

FIG. 1 is a flow chart that illustrates a method of forming bingo cards according to some aspects of the invention. The steps of method 100 may be performed by any convenient computing device and the results are made available to, e.g., a game server. In some implementations, a game server performs some or all of the steps of method 100. Those of skill in the art will appreciate that the steps of the methods described herein, including but not limited to method 100, are not necessarily performed (and in some implementations are not performed) in the order shown. Moreover, some implementations of the methods described herein, including but not limited to method 100, may include more or fewer steps than those shown and/or described.

In step 101, a bingo card type is selected. At this stage, the number of areas (a/k/a "spots," which may be any convenient shape) of the bingo card is selected. As noted elsewhere herein, the present invention encompasses a wide variety of bingo card types, including the number of spots on the bingo card. In some implementations, a traditional 5×5 spot bingo card arrangement is used. However, alternative embodiments use various N×N and N×M bingo cards, wherein N and M are predetermined integers. In step 101, other aspects of the bingo card may also be selected, including overall bingo card layout, the type of lettering used for the card, how many areas of the card will be populated with non-bingo symbols, etc.

In step 105, the type and number of non-bingo symbols are selected in this example. The symbols will be appropriate for a selected non-bingo game. For example if selected non-bingo game is a card game, the non-bingo symbols will be playing card symbols. If the non-bingo game is a slot game, the non-bingo symbols could be symbols typically used in a slot game, such as fruit symbols.

The total number of non-bingo symbols may or may not equal the number of areas of the bingo card corresponding to the non-bingo symbols. For example, some implementations use a 4×13 or a 13×4 bingo card, allowing each card of a 52-card deck to be mapped to the bingo card. Other card game implementations use card decks having more or fewer than 52 cards.

In some implementations, not all bingo card "spots" or areas will correspond to a particular non-bingo symbol, but instead one or more "wild cards" or similar free areas will be arranged on the bingo card (step 110). In some card game implementations, one or more areas of the bingo card will indicate a "Joker" or similar playing card symbol, indicating that the area could correspond to any playing card.

In step 115, a correspondence or "mapping" is made between non-bingo symbols and areas of a bingo card. In preferred embodiments of the invention, the same mapping will be made for all bingo cards used for a particular game, such that all players of a particular game will be presented with the same arrangement of non-bingo symbols on the bingo card. However, as described elsewhere herein, each player's card will preferably have a different mapping between bingo numbers and the areas of the bingo card and/or the associated non-bingo symbols.

At least one, and preferably more than one, winning pattern is also selected for the bingo cards (step 120). Some preferred implementations include a game-winning pattern (e.g., a pattern such as that associated with a conventional bingo game) and other patterns for "interim wins" that correspond with the non-bingo game. For example, completing a row, column or diagonal of a bingo card could win a game, but completing other patterns could entitle a player to a lesser prize. A progressive pattern may also be established. Details of some such implementations will be discussed further below.

Figure 3A:
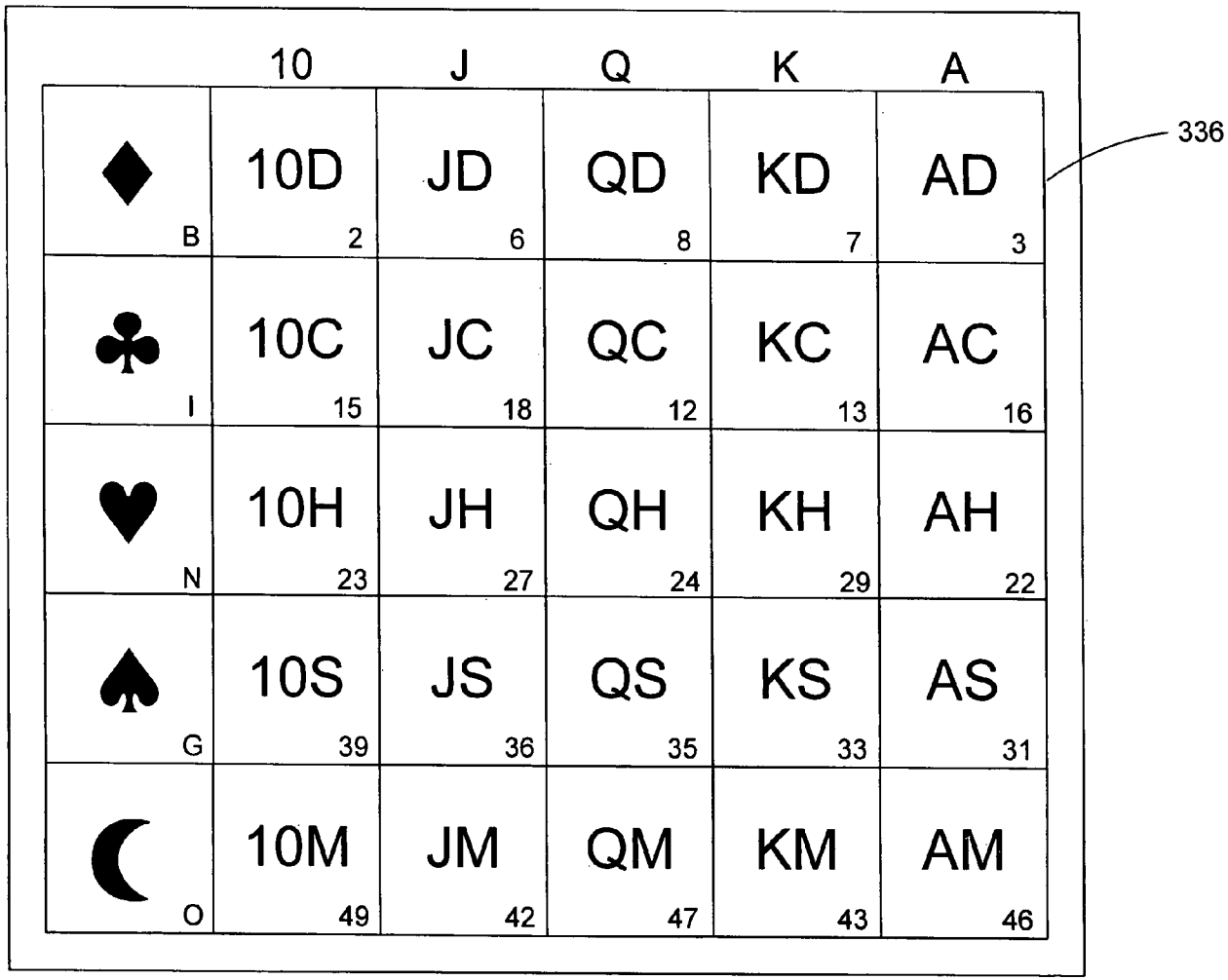
FIG. 3A is an elevation view of a display device illustrating one embodiment of a bingo card of the present invention.
Figure 3B:
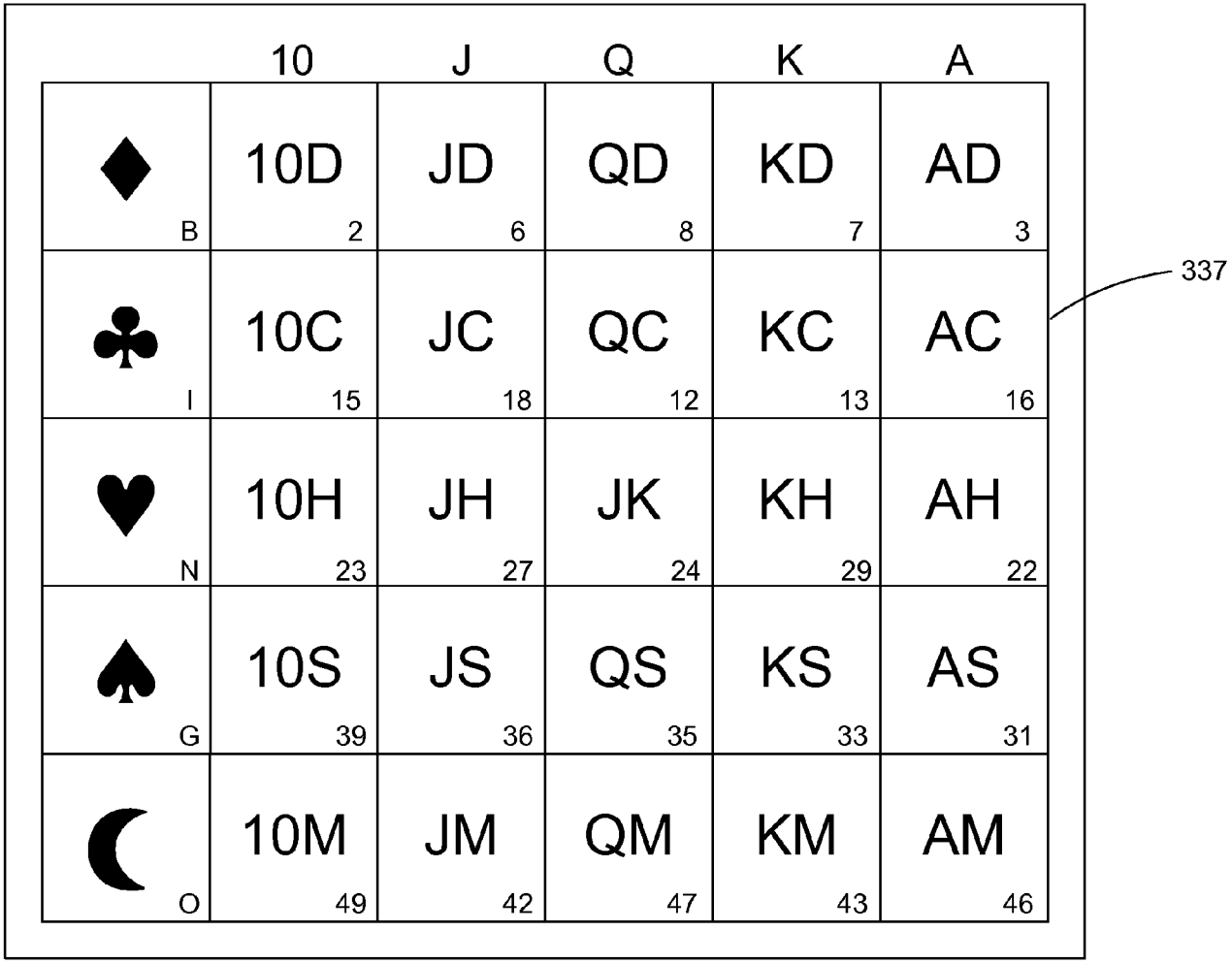
FIG. 3B is an elevation view of a display device illustrating another embodiment of a bingo card of the present invention.
Figure 3C:
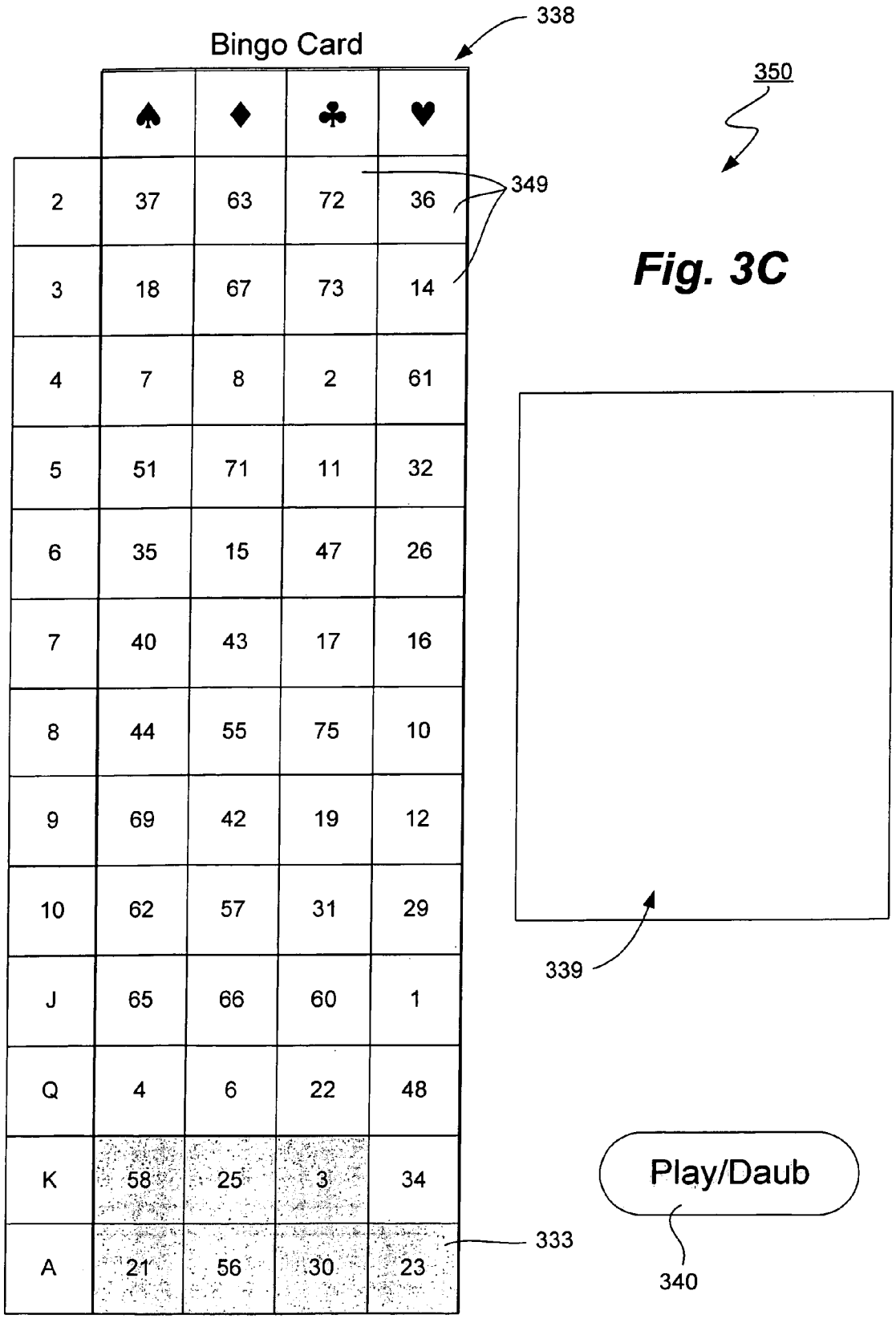
FIG. 3C illustrates an alternative display, including a bingo card, for implementing some aspect of the present invention.

In step 125, the bingo card is displayed with non-bingo symbols indicated on the bingo card. Some exemplary bingo card displays are illustrated in FIGS. 3A-3C, which are described below. The game-winning pattern and the progressive pattern (if any) may or may not be displayed on the bingo card. However, if the game provides for various interim win patterns, these interim win patterns are preferably not all displayed on the bingo card.

In this example, the non-bingo symbols are displayed in areas of the bingo card. Within the set of card game implementations, there are various alternative ways that playing cards may be indicated according to the present invention. For example, the rows may indicate playing card suits and the columns may indicate playing card values, or vice versa. According to such implementations, the individual areas of the bingo card may or may not indicate a playing card symbol, but will still be associated with an individual playing card.

Figure 2:
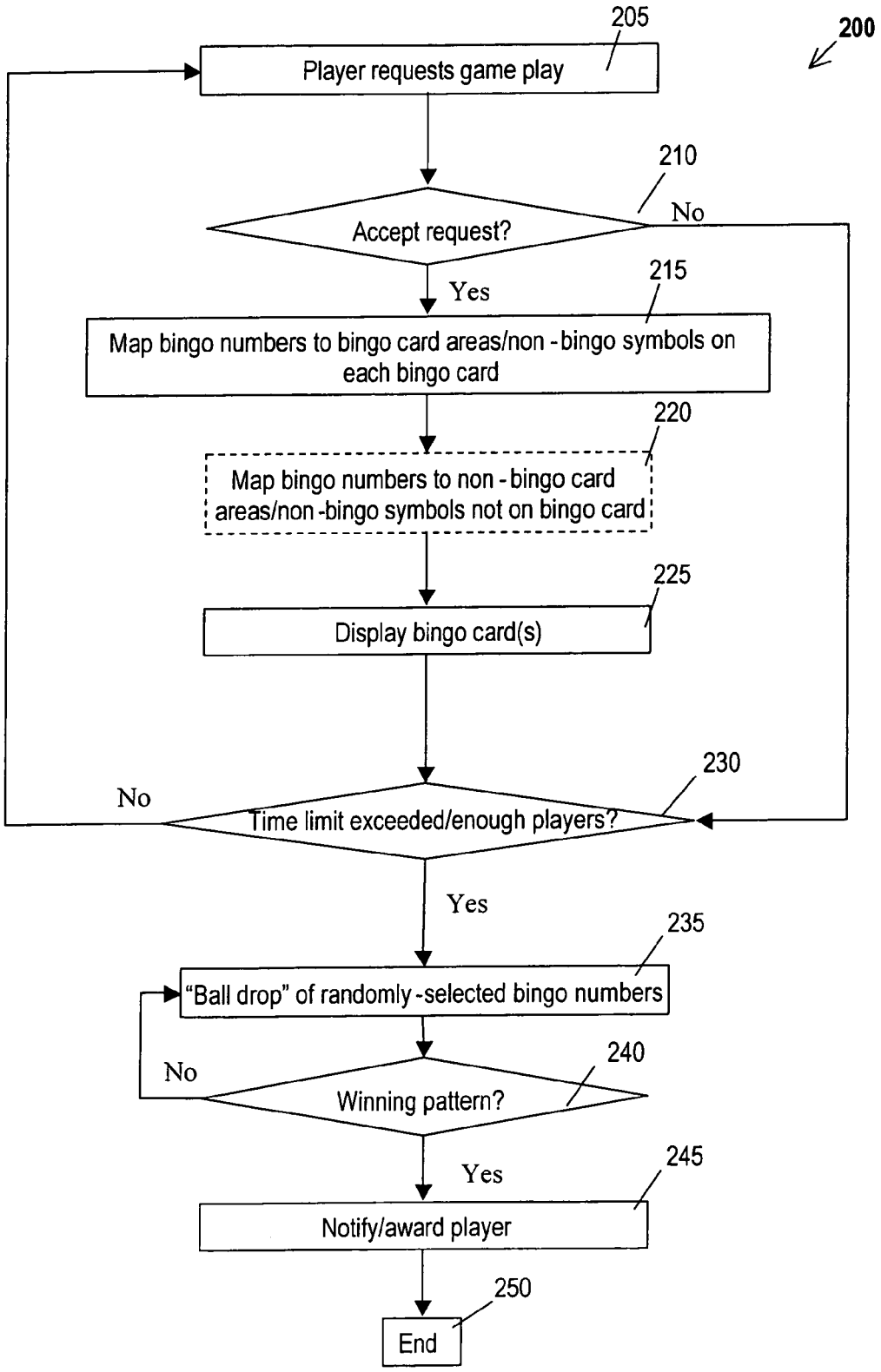
FIG. 2 is a schematic flow diagram illustrating one embodiment for playing a game according to the present invention.

FIG. 2 is a flow chart that outlines some methods 200 of providing games according to the present invention. In some preferred implementations, the steps of method 200 are performed by devices in a gaming network: for example, some steps of method 200 may be performed by one or more gaming machines and some steps may be performed by a game server. Those of skill in the art will appreciate that the steps of method 200 need not be performed (and in some implementations are not performed) in the order shown. Moreover, some implementations of method 200 may include more or fewer steps than those shown in FIG. 2.

In step 205, a player requests game play. For example, the player may insert a payment document into a gaming machine and select a game according to the present invention. The gaming machine would then send a request to a game server for a bingo card appropriate for the selected game. In this example, the bingo card layout, the non-bingo symbol arrangement, etc., have already been established according to method 100 or otherwise.

In preferred implementations, only one type of bingo card is available for a particular game. However, in some implementations, the player is provided different bingo card options, even for a particular selected game. For example, the player would be able to select "Poker" and also to select from a variety of N×N or N×M bingo card layouts for playing poker, e.g., 5×5 or 4×13. For implementations in which players competing in the same game may choose different card layouts, the winning patterns should be selected such that the size of the card and the shape of the pattern do not matter. If two players playing differently sized bingo cards are competing to complete patterns that may be different shapes, but have the same number of spots, they both have the same chances of winning.

In step 210, it is determined whether the request should be accepted. For example, a game server may authenticate the request to determine whether the request originated from a trusted source, such as a known gaming machine. If the request is not accepted, the method proceeds to step 230. In some implementations, the player (or the gaming machine) may be provided with one or more additional chances to submit an acceptable request. If a request is accepted, the method proceeds to step 215.

In this example, individual bingo cards are created in response to individual player requests to play a game. Accordingly, in step 215, bingo numbers are randomly mapped to areas and/or non-bingo symbols of a bingo card for the selected game. In alternative implementations, a number of bingo cards may be prepared in advance instead of waiting for a player to request a bingo card. It will be appreciated that a tangible bingo card may or may not be created, according to the implementation. For example, in some preferred implementations a game server may actually prepare an electronic representation of a bingo card.

In some implementations, the number of available bingo numbers will exceed the number of areas on a bingo card to which the bingo numbers will be mapped. For example, if a conventional 5×5 bingo card is used for displaying selected playing cards of a 52-card deck, not all playing cards of the deck will be represented on the bingo cards. Therefore, in optional step 220, bingo numbers may be mapped to non-bingo symbols (in this example, playing card symbols) that are not indicated on the bingo cards used for game play.

The bingo card is then displayed to the player (step 225). In some implementations (e.g., if the bingo numbers are indicated on the card), the player may be allowed to select a different bingo card. Moreover, some implementations of the invention allow a player to play multiple bingo cards during the same game. However, in the present example, the player does not have these options.

In step 230, it is determined whether the game should begin. For example, a game server may wait for a predetermined time for additional players to request the game prior to initiating game play. Alternatively, or additionally, the game server may require that a minimum number of players request the game before initiating game play. The minimum number and/or predetermined time may vary, e.g., according to the date and/or time of day. For true bingo, at least 2 players must play a game.

After play is initiated, a "ball drop" of randomly selected bingo numbers is made (step 235). At least some aspects of the "ball drop" are indicated to the players, either directly or indirectly. As one example of an "indirect" method, the players may only know when there is a "hit" or correspondence between the bingo number and an area/bingo card symbol on their bingo card(s). For example, when there is a hit, part or all of the area may be displayed differently. In some implementations, a mark may appear in the area, such as an "X" or an "O." In other implementations, a non-bingo symbol in the area will be displayed differently (e.g., with higher contrast, brighter, in color or with different colors) after there is a hit.

In some examples of "direct" methods, bingo numbers and/or non-bingo symbols may be displayed to the players whether or not there is a hit. In some implantations, for example, bingo numbers and/or non-bingo symbols are displayed in a separate portion of a display screen or on a different display screen of a gaming machine. Hits are also indicated on the bingo card and/or elsewhere. Some such examples are described below.

In step 240, it is determined (e.g., by the game server) whether a prize-winning pattern has been completed on a bingo card of any player. The prize-winning pattern may be a game winning pattern or an "interim win" pattern. If no prize-winning pattern has been completed, the ball drop continues. If a prize-winning pattern has been completed, the winner is notified and a prize awarded (step 245). In some implementations, a player is required to "daub" a pattern (e.g., within a predetermined time) in order to claim a prize. In other implementations, the player is not required to daub and/or the gaming machine will automatically daub. If the pattern was an "interim win" pattern, the ball drop continues. If the pattern was a game-winning pattern, the game ends. In some implementations, a player who completes an interim win may choose to continue play and try for a game-winning pattern. In some such implementations, choosing to continue play may require the player to reject the award for the interim win or to pay an additional fee for continued play.

FIG. 3A is an elevation view of a display device illustrating one embodiment of a bingo card of the present invention. Bingo card 336 may be displayed, for example, on a display device of a gaming machine. In an alternative embodiment, card 336 is displayed in a live bingo game at a casino or bingo hall. Here, the card can appear on one of a plurality of video monitors provided at the casino or hall or on a large video monitor or display along with other bingo cards.

Bingo card 336 is used somewhat differently from conventional bingo cards. In conventional bingo, the cards all appear differently from one another, as each card contains bingo numbers in different areas of the bingo card. In preferred implementations of the present invention, the bingo cards for each player do not appear to be different, but instead indicate the same arrangement of non-bingo symbols. In FIG. 3A, exemplary bingo numbers corresponding to the areas and non-bingo symbols of bingo card 336 are indicated for reference. However, these bingo numbers are not displayed in all implementations of the invention.

Each card preferably has a different mapping between the displayed non-bingo symbols and bingo numbers. For example, a player using bingo card 336 will receive a "hit" on the Ten of Diamonds if a bingo number 2 is drawn. However, some or even all other players may not have a hit indicated for the Ten of Diamonds when a 2 is drawn. Instead, those players are required to have the bingo number drawn that is matched to their Ten of Diamonds in order for that card to be hit.

In this example, bingo card 336 includes the four standard card suits, namely, Diamonds, Clubs, Hearts and Spades. Because this implementation is using a 5×5 bingo card, a fifth card suit is also used: as shown by bingo card 336, the fifth card suit is the suit of Moons or Half-Moons.

On bingo card 336, the card suits are each associated with one of the letters of bingo. Here, the suit of Diamonds is associated with the letter "B." The suit of Clubs is associated with the letter "I." The suit of Hearts is associated with the letter "N." The suit of Spades is associated with the letter "G." The suit Moons is associated with the letter "O." Those associations can be determined and varied randomly or fixed.

While standard playing cards are shown in the illustrated embodiment, it should be appreciated that any type of cards or symbols other than bingo numbers can be used. For example, instead of five different card suits for a 5×5 bingo card, the game could use five different slot symbols or any other type of convenient non-bingo symbols. Once non-bingo symbols are chosen to be associated with the different areas of the bingo card, members from each of those sets or suits are selected to form a winning sub-set or hand.

In this example, the Ten, Jack, Queen, King and Ace of each suit are used to form the winning subsets or hands of the overall set. That is, the Two through Nine cards of each suit still exist but are not part of the displayed bingo card 336. Those numbers may instead be matched to bingo numbers that are drawn but which do not appear on bingo card 336. As noted elsewhere herein, in some embodiments all cards shown on a bingo card may belong to the same suit.

In some preferred implementations, when the player daubs a card goes to the spot to which it is mapped. However, each area of the bingo card does not necessarily map to an unique card. In some implementations, for example, 2 or more spots can map to the same card. Thus, the player's bingo card may have, e.g., 5 spots that could map to the King of Diamonds. In some such implementations, the player will not know which spot on the bingo card (in this example, which King of diamonds) maps to the drawn card until he or she daubs. Such implementations further increase player anticipation and excitement. In other implementations having non-unique card mappings, the player may choose one spot among 2 or more spots on the bingo card corresponding to the drawn card. For example, the player may select the spot by touching a corresponding portion of a display screen. In yet other implementations having non-unique card mappings, the spot on the bingo card is chosen as soon as the card is drawn.

Bingo card 336 illustrates that each row of cards forms a royal flush, while each column of cards forms five of a kind. It is preferred that the winning patterns make sense from the standpoint of a non-bingo game, such as poker in this example. Accordingly, the diagonal lines of five cards each form an Ace-high straight. Other possible winning poker combinations include two pair, a full house, a straight and four of a kind. Some of these hands may be designated as "interim win" patterns for game play. Whenever the player obtains such patterns on a bingo card, it also appears that the player achieves a prize-winning poker hand. In that way, the underlying bingo game appears as a poker game. However, the spots that form a game-winning hand need not be contiguous: any pattern having the proper number of spots may be mapped to a poker hand. Moreover, as noted elsewhere herein, the present invention is not limited to the use of 5×5 bingo cards: the bingo cards used may have varying numbers of areas/spots, according to various implementations of the invention.

For illustrative purposes, bingo card 336 also illustrates the player's natural bingo numbers, i.e., from a bingo draw, in the lower right-hand corner of each square. In the row of "B" or Diamonds numbers, the player has drawn the two, six, eight, seven and three. In the row of "I" or Clubs numbers, the player has drawn the fifteen, eighteen, twelve, thirteen and sixteen. In the row of "N" or Hearts numbers, the player has drawn the twenty-three, twenty-seven, twenty-four, twenty-nine and twenty-two. In the row of "G" or Spades numbers, the player has drawn the thirty-nine, thirty-six, thirty-five, thirty-three and thirty-one. In the row of "O" or Moon numbers, the player has drawn the forty-nine, forty-two, forty-seven, forty-three and forty-six. Those drawn numbers are the numbers that would appear in a natural or normal bingo game on a natural or normal bingo card.

In conventional bingo, the middle square, or free space, is provided automatically to the player. The morphed bingo game of the present invention may or may not employ a similar feature. That is, the game and gaming device of the present invention could automatically provide the Queen of Hearts to each of the players. In such a case, that card is not mapped to one of the players' natural bingo numbers. In an alternative embodiment, the Queen of Hearts is not provided to the player and is instead mapped to a natural drawn bingo number provided in the middle position on the bingo card 336.

Standard bingo uses fifteen different numbers per letter. That is, numbers one through fifteen are typically associated with letter "B", the numbers sixteen through thirty are associated with the letter "I", etc. However, games according to the present invention are in no way constrained by this convention: bingo numbers may or may not be associated with a letter and any convenient range of bingo numbers may be used. For example, in some embodiments illustrated in the present invention, the game associates ten numbers with each suit instead of fifteen. It should be appreciated that other ranges of numbers could alternatively be used. In some implementations, thirteen numbers, one corresponding to each card of a suit of a standard deck of playing cards, are used for each suit displayed on the bingo card.

FIG. 3B is an elevation view of a display device illustrating an alternative embodiment of a bingo card of the present invention. Bingo card 337 is quite similar to bingo card 336. However, bingo card 337 includes a joker symbol ("JK") as a free area or "wild card."

FIG. 3C illustrates display 350 that includes another exemplary bingo card of the present invention. Display 350 includes 4×13 bingo card 338. In this example, the areas 349 of bingo card 338 correspond with playing cards of a standard 52-card deck. Here, no playing card symbols are displayed in the areas, yet each area indicates a different playing card, according to the row and column of each area 349. In this example, the corresponding bingo numbers are displayed in each of areas 349. Darkened area 333 indicates a game-winning pattern, which is also a progressive pattern in this example.

Display 350 also includes area 339 for directly indicating random numbers (sometimes referred to herein as "ball drop" numbers or the like) that are displayed during game play. Area 339 may display, for example, numbered balls, non-bingo symbols with or without numbers, etc. In this example, display 350 includes "Play/Daub" button 340, which allows a player to give daub (or other) commands when appropriate.

FIG. 3D illustrates a data structure in an area of a memory device (such as a memory device accessible to a game server), which indicates one exemplary mapping between bingo numbers and non-bingo symbols according to some aspects of the present invention. This mapping may take place, for example, in steps 215 and 220 of method 200, or in similar steps of a comparable method. In this example, the steps are performed by a game server in response to a player's approved request for playing a game.

A map 70 illustrates each of the associations between bingo numbers and playing cards on game card 336 of FIG. 3A. The bingo values B2, B6, B8, B7, B3, I15, I18, I12, I13, I16, N23, N27, N24, N29, N22, G39, G36, G35, G33, G31, O49, O42, O47, O43 and O46 are randomly selected. The game server then maps those bingo numbers to match the playing cards of game card 336. In the illustrated embodiment, the game matches the above drawn bingo numbers to the Ten through Ace of Diamonds, Ten through Ace of Clubs, Ten through Ace of Hearts, Ten through Ace of Spades, and Ten through Ace of Moons, respectively.

Table 70 also illustrates that the server maps the bingo numbers that were not drawn for the player to playing cards that are not part of the game card 336. Because there are thirteen playing cards per suit, and only ten numbers per bingo letter in this example, each suit will have three non-matched playing card values. As stated above, in one alternative embodiment, a game server provides thirteen numbers per bingo letter and therefore matches each of the playing card numbers. Again, the bingo numbers used for implementing the present invention need not be associated with the letters B, I, N, G and/or O.

In the illustrated embodiment using table 70, the game server maps the remaining "B" numbers, namely, B9, B5, B10, B1 and B4 randomly and respectively to the playing cards of the Two of Diamonds, Three of Diamonds, Four of Diamonds, Eight of Diamonds, and Nine of Diamonds, respectively. The non-drawn bingo numbers I14, I11, I20, I19 and I17 are mapped randomly and respectively to the playing cards of the Two of Clubs, Three of Clubs, Six of Clubs, Seven of Clubs, and Nine of Clubs. The non-drawn bingo numbers N30, N26, N21, N25 and N28 are mapped randomly and respectively to the Two of Hearts, Three of Hearts, Five of Hearts, Seven of Hearts and Eight of Hearts. The non-drawn bingo numbers G37, G32, G40, G34 and G38 are mapped randomly and respectively to the playing cards of the Three of Spades, Four of Spades, Six of Spades, Seven of Spades and Nine of Spades. The non-drawn bingo numbers O40, O44, O45 and O48 are mapped randomly and respectively to the player cards of the Two of Moons, the Five of Moons, the Six of Moons, the Eight of Moons and the Nine of Moons, respectively.

The game cards for traditional bingo games typically include a 5×5 array of numbers from the range of 1-75 as described above. In order to potentially appeal to a broader audience of casino patrons, it may be desired to configure the multi-player bingo games such that the game cards use varying symbols and/or arrays for the playing the bingo game and displaying the outcome of the bingo game. In some implementations, the numbers of the traditional bingo game card may be replaced with playing cards in order to at lease loosely simulate a poker game. Some such exemplary methods will be described in detail with reference to FIGS. 4 through 18.

Figure 4:
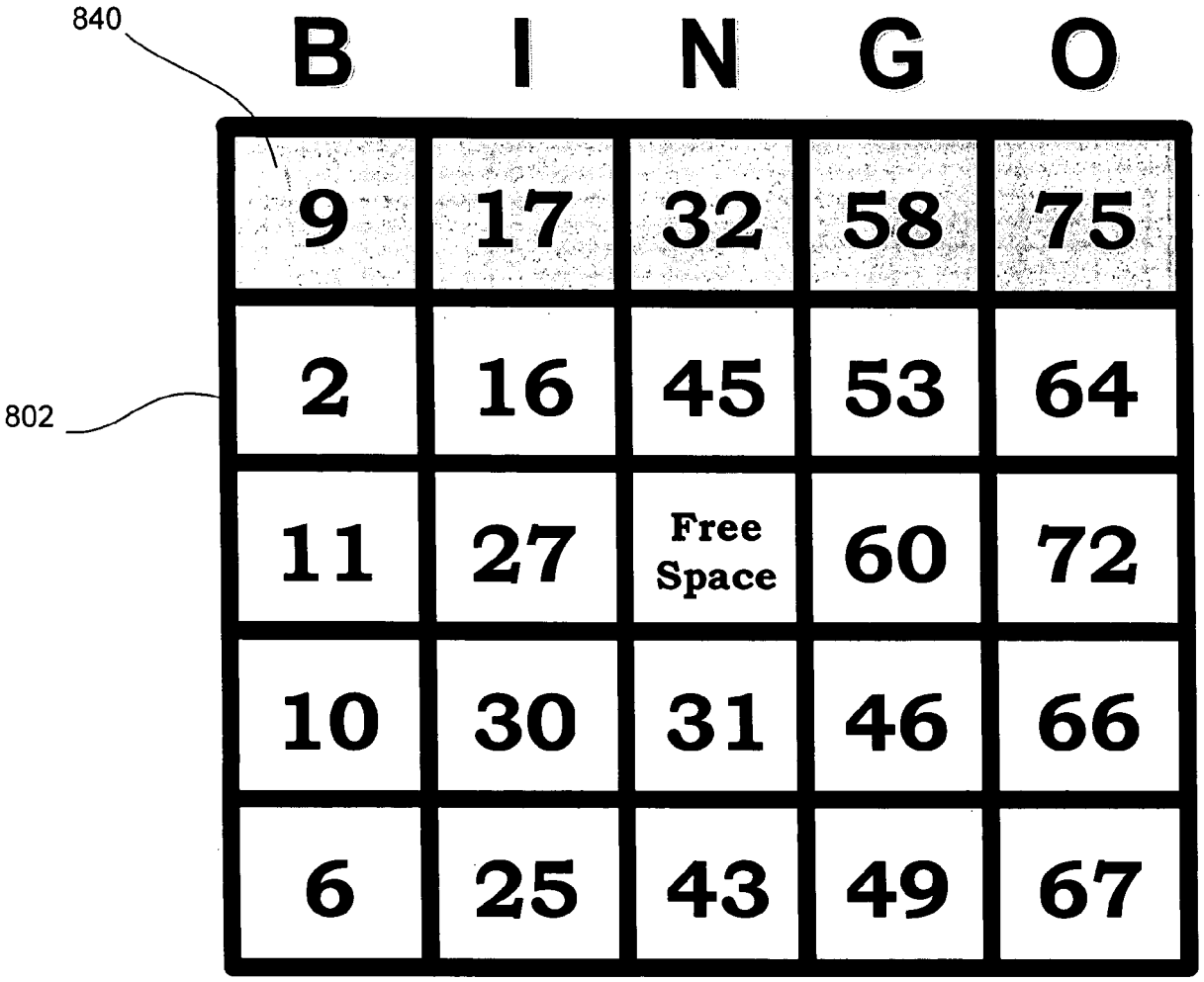
FIG. 4 illustrates an exemplary Bingo card for implementing some aspects of the invention.

FIG. 4 illustrates a traditional bingo card 802 that will be used as a reference for some of the following discussion. The traditional bingo game card may be assigned to or selected by the player, and then have the numbers of the bingo game card mapped to playing cards arranged on a poker bingo game card. After the numbers are mapped to the poker bingo game cards, the poker bingo game card may be displayed to the player during the occurrence of the bingo game. The bingo numbers may be randomly drawn in the same manner as the traditional bingo game.

If the drawn number matches a number on a player's bingo game card and, consequently, a playing card to which the number is mapped, the corresponding playing card of the poker bingo game card may be marked to signify the match. If the drawn number does not match a number on the player's bingo game card, no playing cards are marked. Numbers may be drawn until a pattern is matched on a player's poker bingo game card corresponding to an "interim win" pattern and/or a predetermined game-winning pattern on the bingo game card. If necessary, the player may then daub the poker bingo game card to claim the game-winning prize. Various embodiments and variations of games morphed to display bingo game outcomes will now be described more fully.

For the purpose of illustration, the bingo game card 802 for the first player previously described and shown in FIG. 4 may be the underlying bingo game card for a player playing a game morphed to display a bingo game outcome. The illustrated bingo game card 802 for the first player, which is a traditional bingo game card, was previously described as having a 5×5 array of numbers, with the numbers in the first or "B" column selected from the range of 1 to 15, the numbers in the second or "I" column selected from the range of 16-30, the numbers in the third or "N" column selected from the range of 31-45, and with the center square being a "Free Space," the numbers in the fourth or "G" column selected from the range of 46-60, and the numbers in the fifth or "O" column selected from the range of 61-75. In addition, the predetermined game-winning pattern 840 for the occurrence of the multi-player bingo game, which in this example is matching the five numbers across the top row of the bingo game card 802, may be highlighted on the bingo game card 802 for those players opting to have the bingo game card 802 displayed for the outcome of the occurrence of the bingo game.

Players of the multi-player bingo game may be offered the option of displaying the outcome of the occurrence of the bingo game on an alternate card using symbols other than numbers. In one embodiment, an alternate bingo game card 1000 illustrated in FIG. 5 may include a 5×5 array of images representing playing cards 1002. The game card 1000 presents a simple alternative mapping strategy wherein the columns of numbers of the bingo game cards 802 may be replaced with columns of suited playing cards. The playing card images 1002 may be arranged with one suit corresponding to each column of the bingo game card 802 so that each playing card image 1002 in a column of the game card 1000 has the same suit.

In this example, the suit of diamonds corresponds to the first or "B" column, and the suits of spades, hearts, clubs, and an additional suit of stars may correspond to the "I," "N," "G," and "O" columns, respectively, of the game card 802. The additional suit, which may be any suit desired by the designers of the multi-player bingo game, may be added to facilitate a one-to-one correspondence between the numbers of the bingo game card 802 and the playing card images of the game card 1000. Within each column, the game card 1000 may include images of the ace, king, queen, jack and ten of the corresponding suit arranged in descending order of rank of playing cards. Arranged in this way, each column includes the playing cards necessary for a royal flush for the corresponding suit, and each row includes five of a kind (e.g., five aces across the first row). Further, each diagonal line of the array includes the cards necessary for an ace-high straight with one card from each of the five suits.

In the multi-player bingo game described above, each player for an occurrence of the bingo game preferably has an unique bingo game card 802 and, consequently, a unique chance of matching the game-winning and interim patterns, and has an unique display of a bingo game card 802 at the corresponding gaming unit 20. When the alternate game card 1000 is used by the players, the players may each have a similar (or identical) initial display of the alternate game card 1000 at the gaming unit 20, but the uniqueness of the players' entries and chances of matching the game-winning and interim patterns may be retained by mapping the numbers of the players' bingo game cards 802 to the playing card images 1002 of the alternate game cards 1000. In the present embodiment, the bingo game may implement a one-to-one mapping of the numbers of the bingo game cards 802 to the playing card images 1002 of the alternate game cards 1000.

Figures 5, 6:
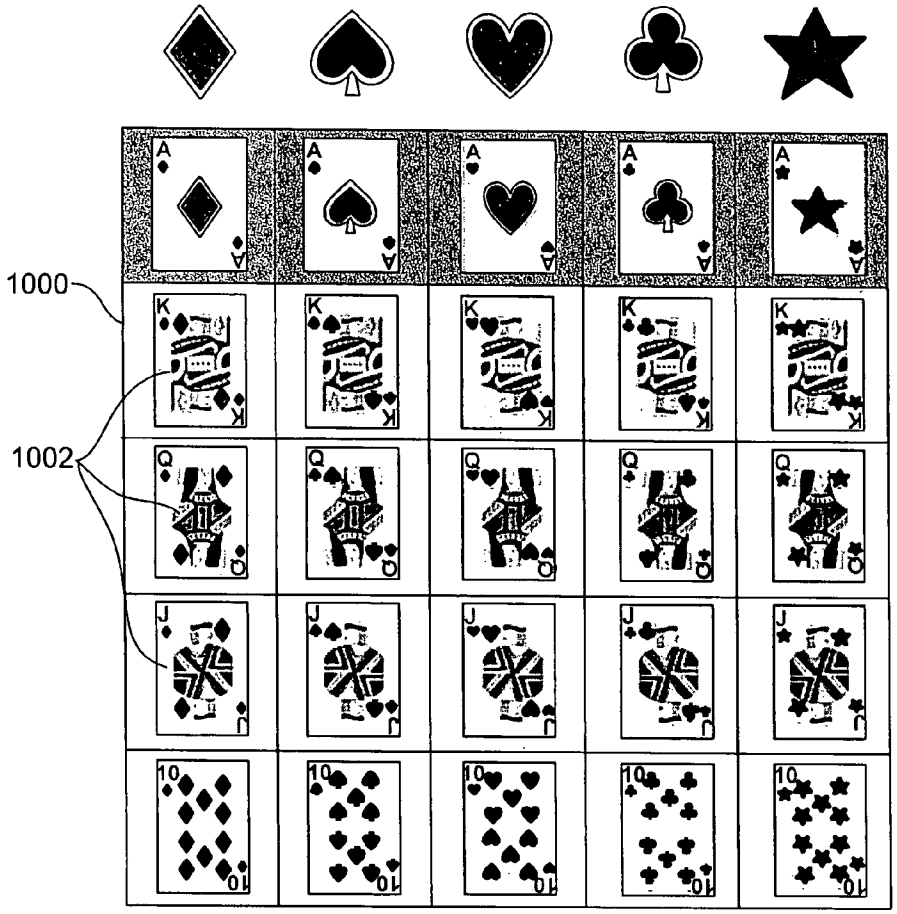
FIG. 5 illustrates an exemplary Bingo card for implementing alternative aspects of the invention.
FIG. 6 is a mapping chart that illustrates the mapping of the numbers of the Bingo card of FIG. 4 to their corresponding playing card images of the alternate Bingo card of FIG. 5.

A mapping chart 1010 shown in FIG. 6 illustrates the mapping of the numbers of the bingo game card 802 of FIG. 4 to their corresponding playing card images 1002 of the alternate game card 1000 of FIG. 5. The left-most column of the mapping chart 1010 may list the playing cards of a traditional deck of cards in descending order of rank, with the following columns representing the columns "B," "I," "N," "G" and "O" of the game card 802 and corresponding suits of the game card 1000. In the mapping chart 1010, each number of bingo game card 802 is entered in the appropriate location for the playing card occupying the same row and column as the number.

For example, the number "9," which is in the first row and first column of the game card 802, is entered at the location corresponding to the ace of diamonds, which is in the first row and first column of the game card 1000. The remaining numbers and the "Free Space" in the center of the game card are mapped to the playing cards in the same manner.

Much of the following discussion indicates that a gaming machine performs certain functions and a game server or other network device performs other functions. However, in alternate implementations, these steps may be allocated differently. For example, a game server or other device in a gaming network may perform functions (e.g., mapping functions) that are described below as being performed by a gaming machine.

In this example, a gaming machine may store records with the combinations of numbers and playing cards, e.g., in program memory, RAM, or other convenient memory. During the occurrence of the bingo game as the numbers are drawn (and, for example, transmitted by a game server to participating gaming machines), the mapping chart 1010 may be used to determine the playing card of the game card 1000, if any, corresponding to the drawn number, such that the matching playing card may be marked on the game card 1000. In this way, despite that fact that the same game card 1000 may be displayed to each player at the corresponding gaming unit 20, each game card 1000 may be marked in a unique manner corresponding to the numbers of the player's underlying bingo game card 802.

When the alternative game cards 1000 are offered to the players, the multi-player bingo game may still proceed in a similar manner as previously described. As an example, the multi-player bingo game may be configured to execute the routine 760 of FIGS. 17A and 17B of U.S. Provisional Application No. 60/503,161, entitled "Gaming Network with Multi-Player Bingo Game (Methods for Presentation of Bingo Outcomes in Gaming)," which is incorporated by reference herein for all purposes. In that example, the numbers are drawn one at a time and transmitted to the players' gaming machines for comparison to the players' game cards 802. The overall flow of the routine 760 may remain the same with modifications at various steps in the process to allow for the use of the alternate game cards 1000 and mapping chart 1010.

Figure 7:
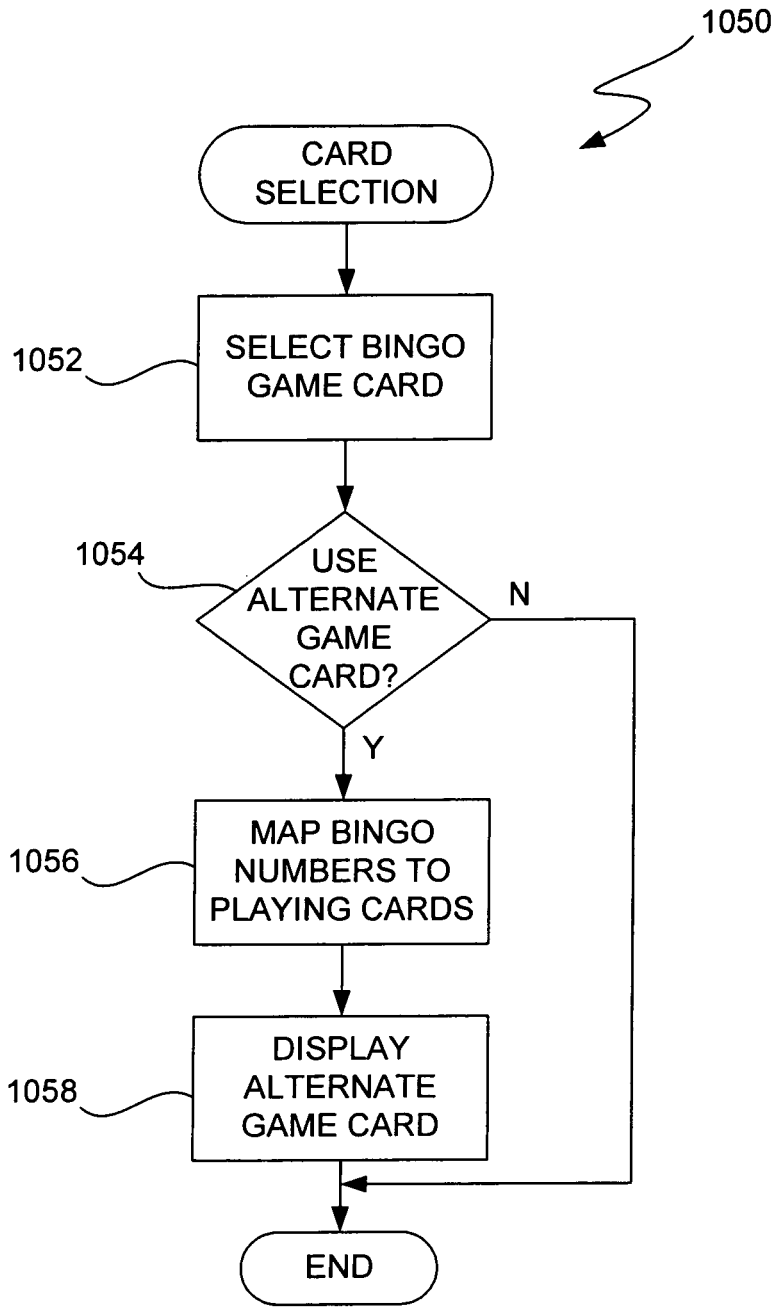
FIG. 7 is a flow chart that provides an outline of some aspects of the invention.

One modification may occur, for example, at blocks 702 and 708, wherein the players enroll in an occurrence of the multi-player bingo game. As previously described, the enrollment process for a player may include depositing currency or other value at a gaming machine, selecting or having the gaming machine select a bingo game card for use in the bingo game, selecting a wager amount for the occurrence of the bingo game, and touching the play button at the gaming machine to notify a network device (such as a game server) of the requested enrollment of an additional player.

Where the alternate game card 1000 is available to display the outcome of the bingo game, the enrollment process may be modified to include the game card selection routine 1050 shown in FIG. 7. When a player enrolls in an occurrence of the bingo game, control may pass to a block 1052 wherein a bingo game card is selected for use by the player. As previously described, the bingo game card may be automatically selected for the player (e.g. by the gaming machine or by a game server), or the player may be able to select another desired bingo game card to use. Once the bingo game card is selected for the player, the routine 1050 may pass to a block 1054 wherein the player may have the option of displaying and using an alternative game card, such as the game card 1000 of FIG. 5.

To inform the player of the option to display an alternate game card, the gaming machine may, for example, display a prompt at the display device, or include an appropriately labeled button or other input device, to allow the player to elect to display the alternative game card. If the player does not want to use an alternate game card as signified by the appropriate input at the gaming machine, the game card selection routine may end and the enrollment process may continue. If the player elects to display the alternate game card during the occurrence of the bingo game, control may pass to a block 1056 wherein the numbers of the bingo game card may be mapped to the playing cards on the alternate game card in the manner described above. The mapping may be performed, for example, by a game server, by the gaming machine, or by another device. Corresponding combinations of bingo numbers and playing cards (and/or bingo card areas) may be stored in memory for use during the occurrence of the bingo game. Control may then return to the enrollment process and the alternate game card 1000 may be displayed to the player at a display of a gaming machine at a block 1058.

The routine 1050 is one example of a card selection routine usable during the enrollment process for the multi-player bingo game, and other selection routines are contemplated as having use with the alternate game cards. For example, the multi-player bingo game may be configured such that all players will have a non-traditional game card such as the poker game card 1000 displayed and used during the bingo game. In such implementations, the election to use the alternate game card at block 1054 may be unnecessary. Further, the selection routine 1050 may be configured to prompt the players to elect to use an alternate game card before selecting a traditional bingo game card, with the bingo game card being selected and mapped automatically if the player elects to display the alternate game card.

Still further, instead of generating a bingo game card and then mapping the bingo game card to the symbols on the alternate game card, the process may forego having a separate bingo game card selection step and instead randomly select numbers for each of the playing cards of the alternate game card. For example, the controller may randomly select a number between 1 and 15 and assign the number to the ace of diamonds, select a second number from the remaining numbers between 1 and 15 and assign the number to the king of diamonds, and so on until all the playing cards have an assigned number. Additional methods for performing the mapping process will be apparent to those skilled in the art and are contemplated as having use with the present invention.

Figure 8:
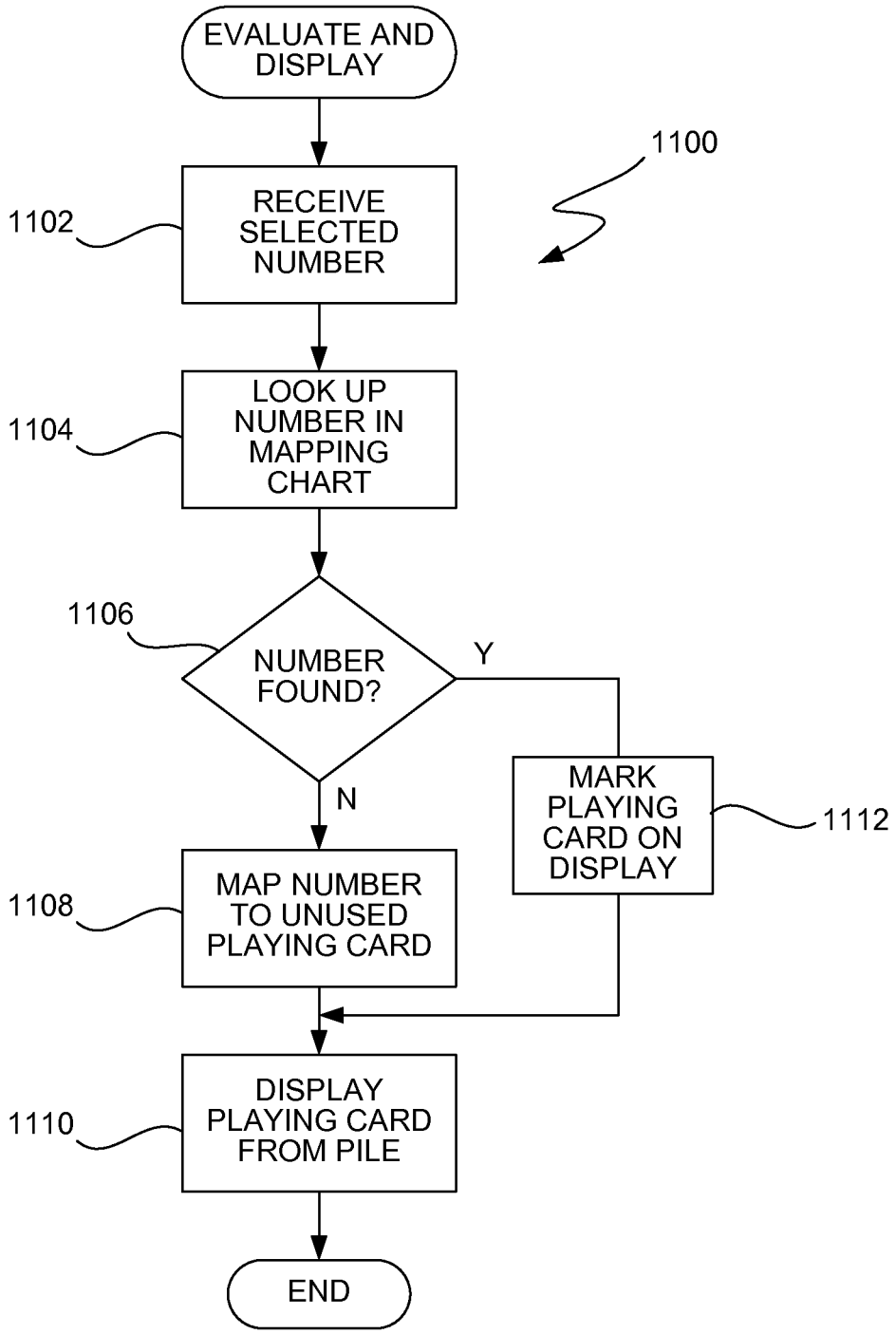
FIG. 8 is a flow chart that provides an outline of other aspects of the invention.

Once the players are enrolled and the bingo game cards are mapped to the alternate game cards, the routine 760 may proceed as previously described until the bingo cards are evaluated at block 720 and the outcome is displayed at block 722. FIG. 8 illustrates a combined card evaluation and outcome display routine 1100 that may be executed at a gaming machine displaying the alternate bingo card 1000. For purposes of illustration, the numbers may be drawn in the same order as shown in FIGS. 6-15 of U.S. Provisional Application No. 60/503,161 and discussed in the accompanying text. After a drawn number selected and transmitted by a game server is received at a gaming machine at a block 1102, control may pass to a block 1104 wherein the gaming machine may perform a look-up of the mapping chart 1010 stored in memory for an entry corresponding to the drawn number. If the drawn number is not found in the mapping chart at a block 1106, control may pass to a block 1108 wherein the drawn number may be mapped to one of the remaining unused playing cards from the deck.

A controller of the gaming machine may be configured with any appropriate algorithm for serially or randomly selecting one of the remaining playing cards to be matched to the drawn number for the occurrence of the bingo game. As one example, the controller may be configured to continue to match the number ranges for the columns of the traditional bingo game cards with playing cards within the corresponding suit on the alternate game cards. In the previously illustrated draw/ball drop, the first drawn number, 44, may not be found in the mapping chart of FIG. 6 because the number 44 was not found on the player's bingo game card 802. Consequently, there is no match on the bingo game card 802 and, correspondingly, on the alternate game card 1000.

In order to enhance the game experience of the player, it may be desired to map a playing card to the drawn number in order to display the ball draw to the player in a manner consistent with the theme of the game. The number 44 is within the range from 31-45 corresponding to the "N" column of the bingo game card 802 and, consequently, the hearts column of the alternate game card 1000. The controller may be programmed to select one of the unused hearts, presently the 2 through 9 of hearts, to correspond to the number 44. In the example, the controller may randomly select the 7 of hearts from the available playing cards for association with the number 44. Once selected, the controller may update the mapping chart as shown in FIG. 10 to indicate that the 7 of hearts corresponds to the number 44 and to prevent remapping of the 7 of hearts to another number at least as long as other playing cards remain unmapped and unused.

Figure 9:
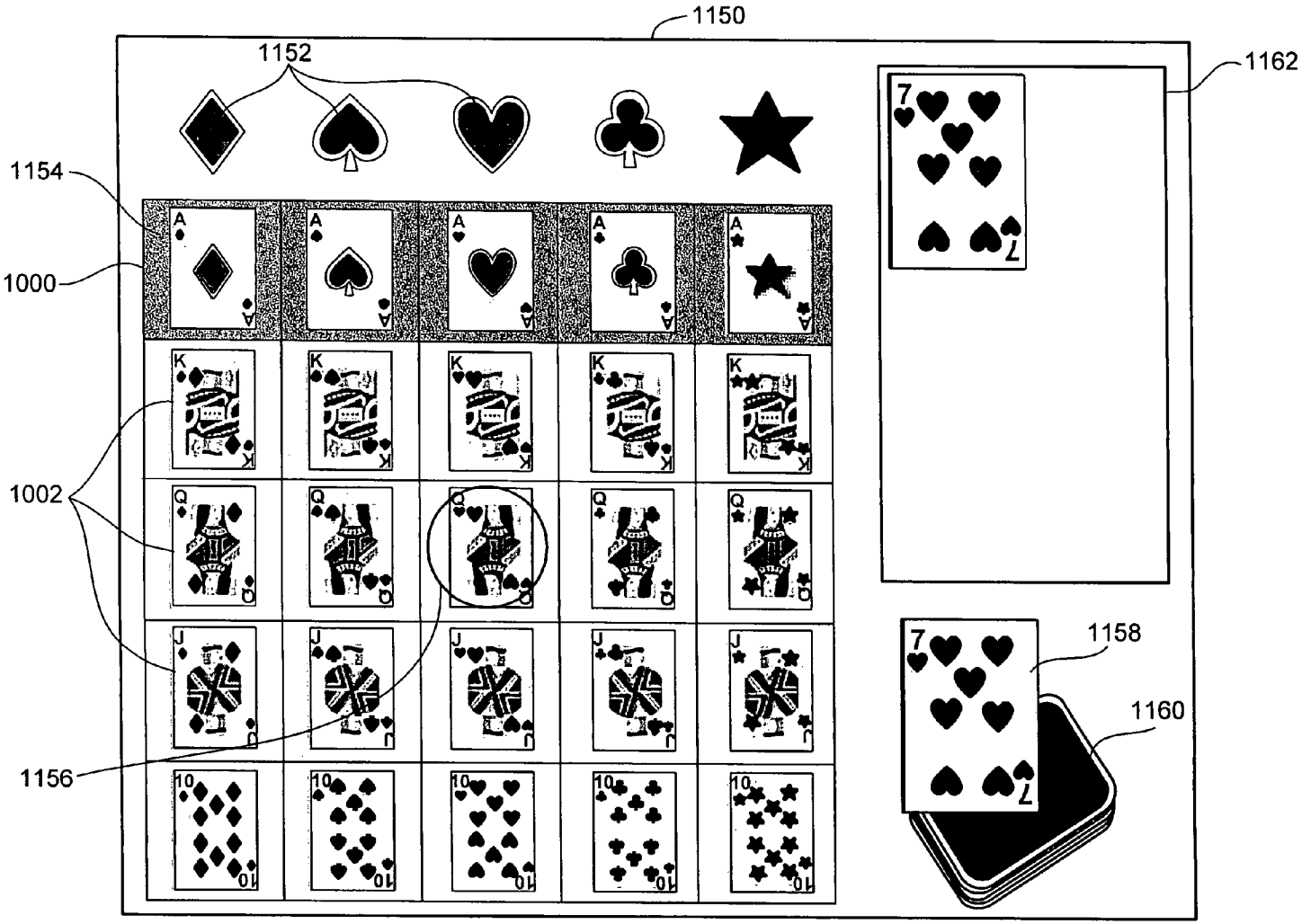
FIG. 9 is a mapping chart that illustrates the mapping of drawn cards to their corresponding places on the display of FIG. 10.
Figure 11:
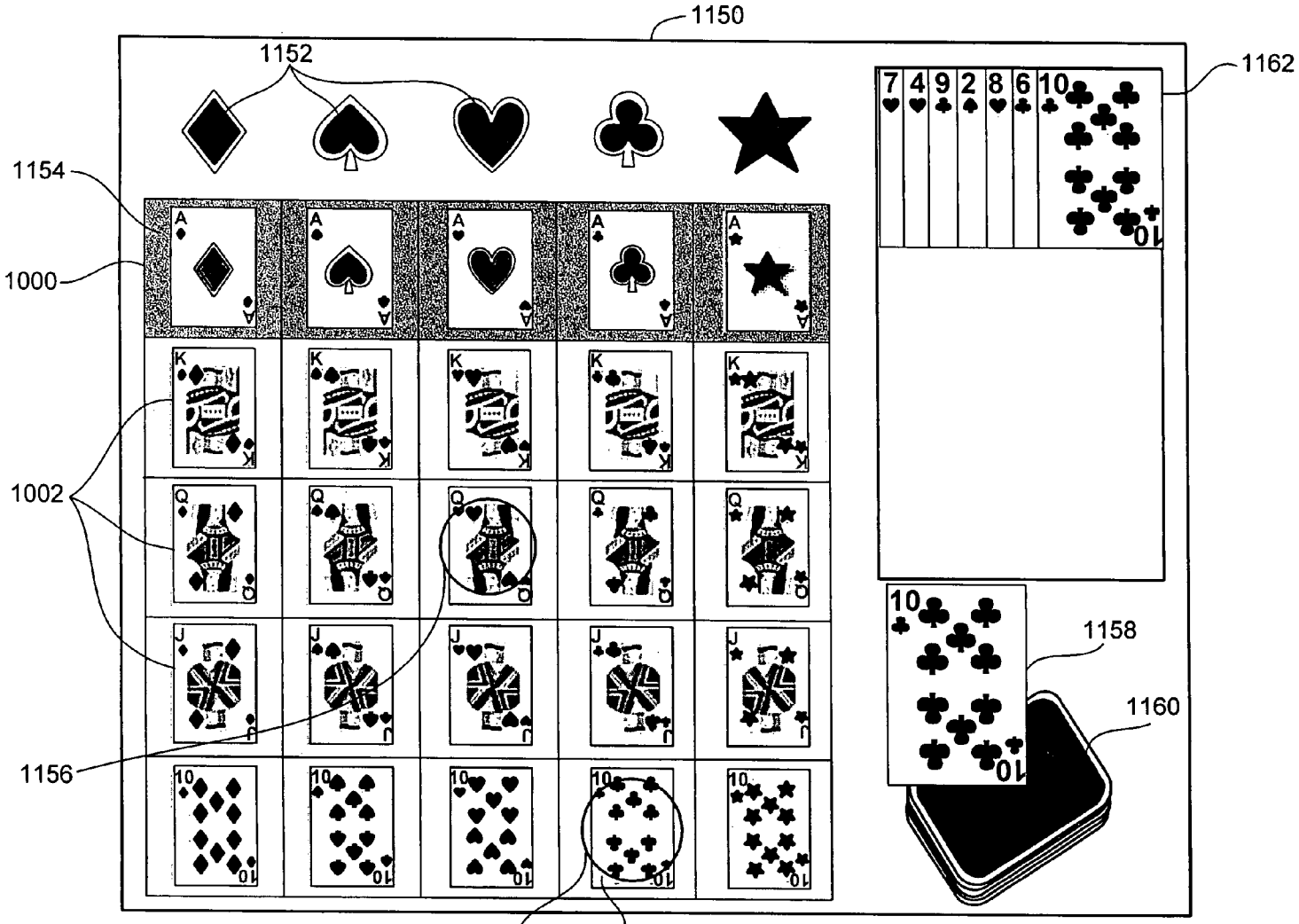
FIG. 11 illustrates a display when a 7th card is drawn in one example of a game according to the present invention.

After the drawn and previously unused number 44 is mapped to the 7 of hearts, control may pass to a block 1110 wherein the display at the gaming machine may be updated to display that the 7 of hearts is been selected from the available playing cards. FIG. 9 illustrates one embodiment of an alternative game card display 1150 that may be displayed at the gaming machine for a player electing to use the alternate game card 1000. The display 1150 may illustrate the players' alternate game card 1000 with the array of playing cards 1002 having the corresponding suit symbols disposed above the columns of the array. The game-winning pattern 1154 may be highlighted on the game card 1000 by shading the appropriate locations within the array of playing cards 1002, and matched playing cards 1002 may be identified via appropriate marks 1156 displayed at the locations of the matched playing cards 1002. In the illustrated example, the queen of hearts corresponds to the free space at the center of the game card 802 of FIG. 4 and, consequently, is displayed with mark 1156 at the outset of the occurrence of the bingo game.

The display 1150 may further include displays relating to the currently drawn playing card and to the playing cards that have been drawn up to the current point in the occurrence of the bingo game. In this example, the current playing card 1158 is displayed in a manner simulating the drawing of the current playing card 1158 from the top of a deck of playing cards 1160. At the same time, the playing card may also be displayed along with previously selected playing cards in a playing card draw area 1162 similar to the game ball draw area 812 previously described. As the game proceeds, the display of the current playing card 1158 may be updated to display the playing card corresponding to the most recently selected number, while the card draw area 1162 may be updated to display the playing cards corresponding to the numbers selected up to a given point in the occurrence of the bingo game. Playing cards that correspond to "hits" on the bingo card may be displayed differently (e.g., brighter, higher contrast, larger, more colorful) from cards that are not hits.

Returning to FIG. 8, if the controller 100 of a gaming machine determines that a selected number is found in the mapping chart 1110, control may pass to a block 1112 wherein the playing card 1102 corresponding to the selected number may be updated on the display 1150 with a mark 1156 to indicate that the playing card 1002 has been matched. For example, referring to FIGS. 11 and 12, the playing card draw area 1162 indicates that the following playing cards have been displayed to the player at the display 1150; 7 of hearts, 4 of hearts, 9 of clubs, 2 of spades, 8 of hearts, 6 of clubs, and 10 of clubs. The mapping chart 1010 in FIG. 12 further illustrates that the first six selected numbers, 44, 41, 54, 28, 37, and 57, respectively, that were not found in the mapping chart 1010 at block 1106 of FIG. 8, were mapped to unused playing cards at block 1108, and displayed in the playing card draw area 1162.

As the numbers are mapped, the controller of the gaming machine may store records relating to the map to numbers and the corresponding playing cards. When the number 49 is received at the gaming machine at block 1102 of FIG. 8, a look up is performed for the number 49 among the stored records for the mapping chart 1010 at block 1104. The number 49 may be found at block 1106 and control may pass to the block 1112, wherein the display 1150 may be updated such that a mark 1156 is displayed at the 10 of clubs 1164 of the alternate game card 1000. Additionally, the current playing card 1158 and the card draw area 1162 are updated to display the 10 of clubs as the currently selected playing card.

Figure 13:
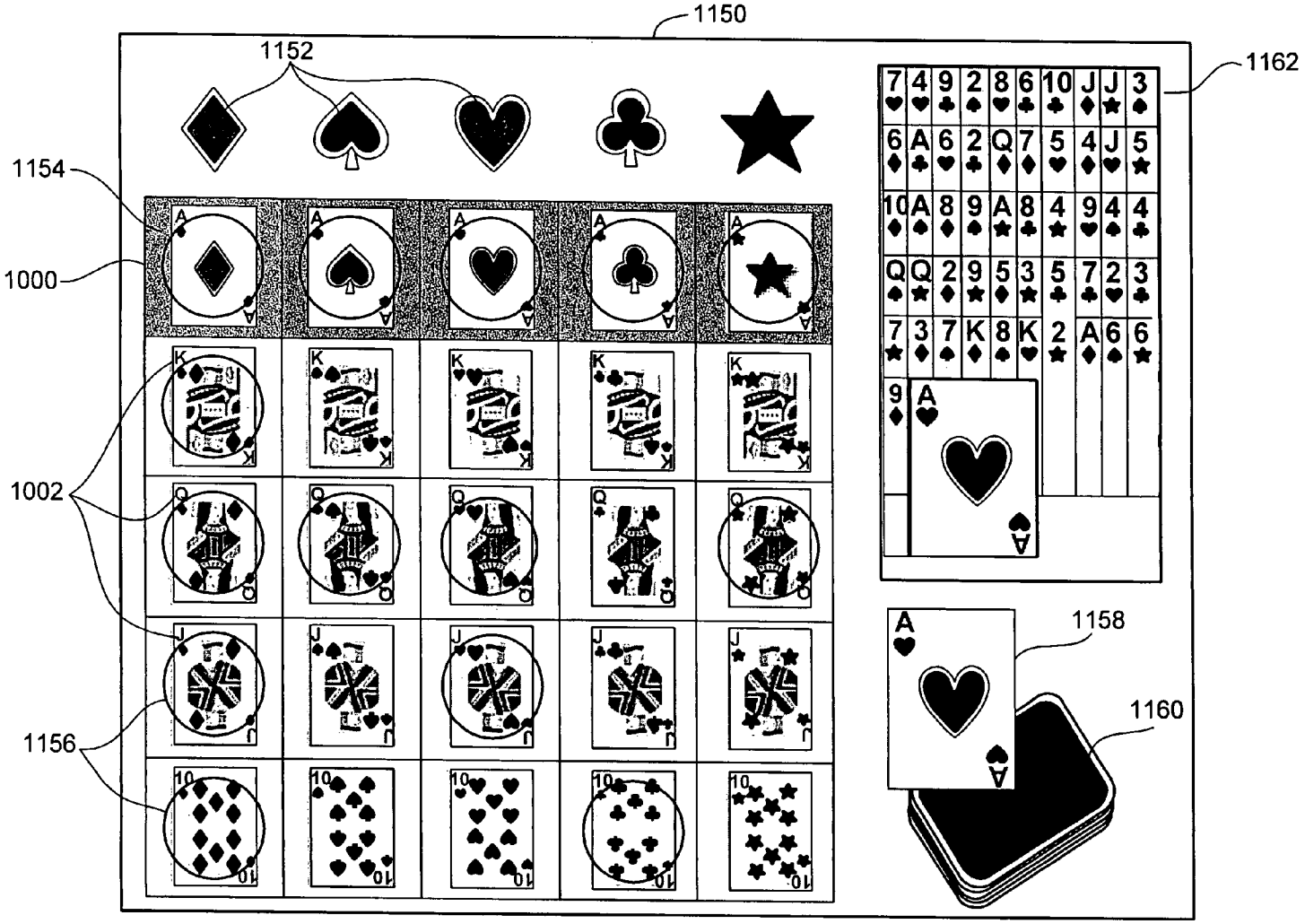
FIG. 13 illustrates a display when a 52nd card is drawn in one example of a game according to the present invention.

As the bingo game continues and numbers are selected and transmitted to the gaming machines, the gaming machines look up the selected numbers in the mapping chart 1010 and, if a match is found, mark the corresponding playing cards 1002 on the alternate game card 1000 until one of the players matches the game winning pattern 1154. As illustrated in FIGS. 13 and 14, 52 numbers were selected until the player matched the game-ending pattern 1154 on the alternate game card 1000. At this point, the player may win the occurrence of the bingo game or may be required to daub to accept the bingo game win in a similar manner as previously described. As the occurrence of the game progressed, numbers not previously found in the mapping chart 1010 were mapped to the unused playing cards, with records for numbers and corresponding playing cards being generated and stored as reflected in the mapping chart 1010. During the course of the occurrence of the bingo game, the unused playing cards in a given suit may be mapped to selected numbers such that there are no remaining unused playing cards for that suit.

In the illustrated example, once numbers were matched to each of the unused cards in the clubs and stars suits, at block 1108 of FIG. 8 the gaming machines may be configured to randomly select one of the remaining unused cards of a different suit in order to complete the draw such that, in most occurrences, it may not be necessary to reuse playing cards or create additional ranks of playing cards to complete the draw. For example, as shown in FIG. 14, by the time the number 48 was selected, selected numbers from the range of 46 through 60 may have been mapped to the 2 through ace of clubs such that no clubs were available to map to the number 48. With no clubs available, the controller of the gaming machine may have been configured to select one of the remaining unused playing cards from the other suits to which to map the number 48, in this case the 6 of spades. Similarly, upon finding no unused stars when the number 74 was selected, the gaming machine may have randomly selected to 9 of diamonds to which to map the number 74.

In the event that all of the available playing cards are mapped to selected numbers, the gaming machines may be configured to reuse playing cards, to use additional non traditional ranks of playing cards to complete the draw, or to display other indicia indicative of the selection of additional numbers that did not match numbers on the players bingo card to which the alternate game card 1000 is mapped. After the occurrence of the bingo game is complete, and the same player or another player enrolls in a subsequent occurrence of the bingo game, the mapping chart 1010 may be reset with the numbers 2 through 9 of each suit available for mapping to selected numbers and, if necessary, the 10 through ace of each suit may be remapped to the numbers of the players bingo game card if a different bingo game card is selected for the subsequent occurrence of the bingo game.

In the previous example, the numbers on the bingo game card 802 were mapped to the playing cards on the alternate game card 1000 such as there is 1 to 1 correspondence between the columns of the bingo game card 802 and the playing card suits of the alternate game card 1000. However, those skilled in the art will understand that alternate mapping strategies may be implemented for matching the numbers of the bingo game card 802 to the playing cards of the alternate game card 1000.

Figure 15:
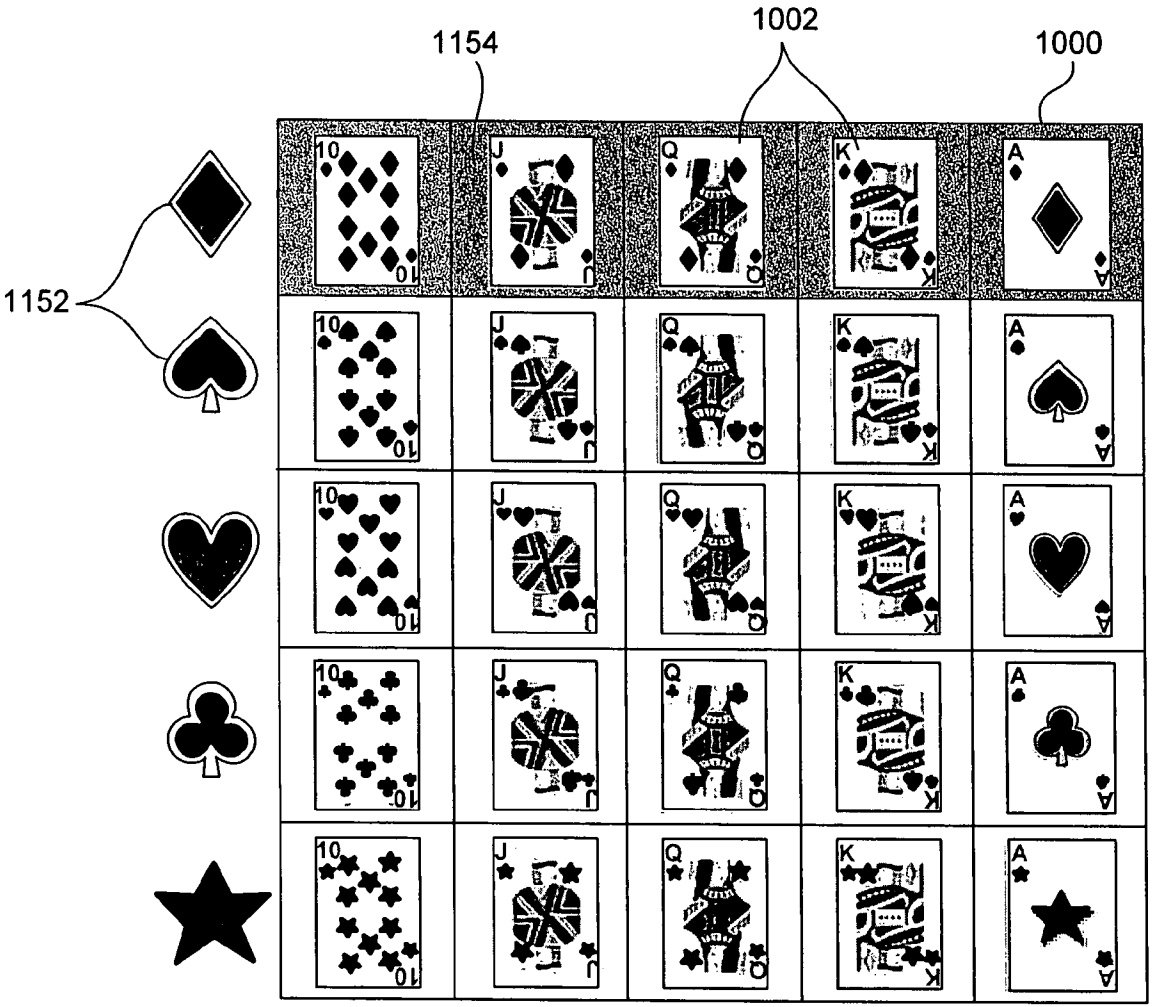

For example, FIGS. 15 and 16 illustrate a mapping strategy wherein the columns of the bingo game card 802 may each be mapped to a corresponding rank of the playing cards on the alternate game card 1000. In this example, the numbers in the "B" column of the bingo game card 802 may be mapped to corresponding playing cards 1002 representing the 10 of each suit. Similarly, the "I," "N," "G," and "O" columns may be mapped to jacks, queens, kings, and aces, respectively, such that each row of the alternate game card 1000 displays the cards for a royal flush of the corresponding suit with the cards in ascending order from 10 through ace, and with each column having five of a kind of the corresponding card rank. This mapping strategy is further illustrated in the mapping chart 1010 of FIG. 16, which may be stored, for example, by the gaming machine during the occurrence of the bingo game.

Figure 17:
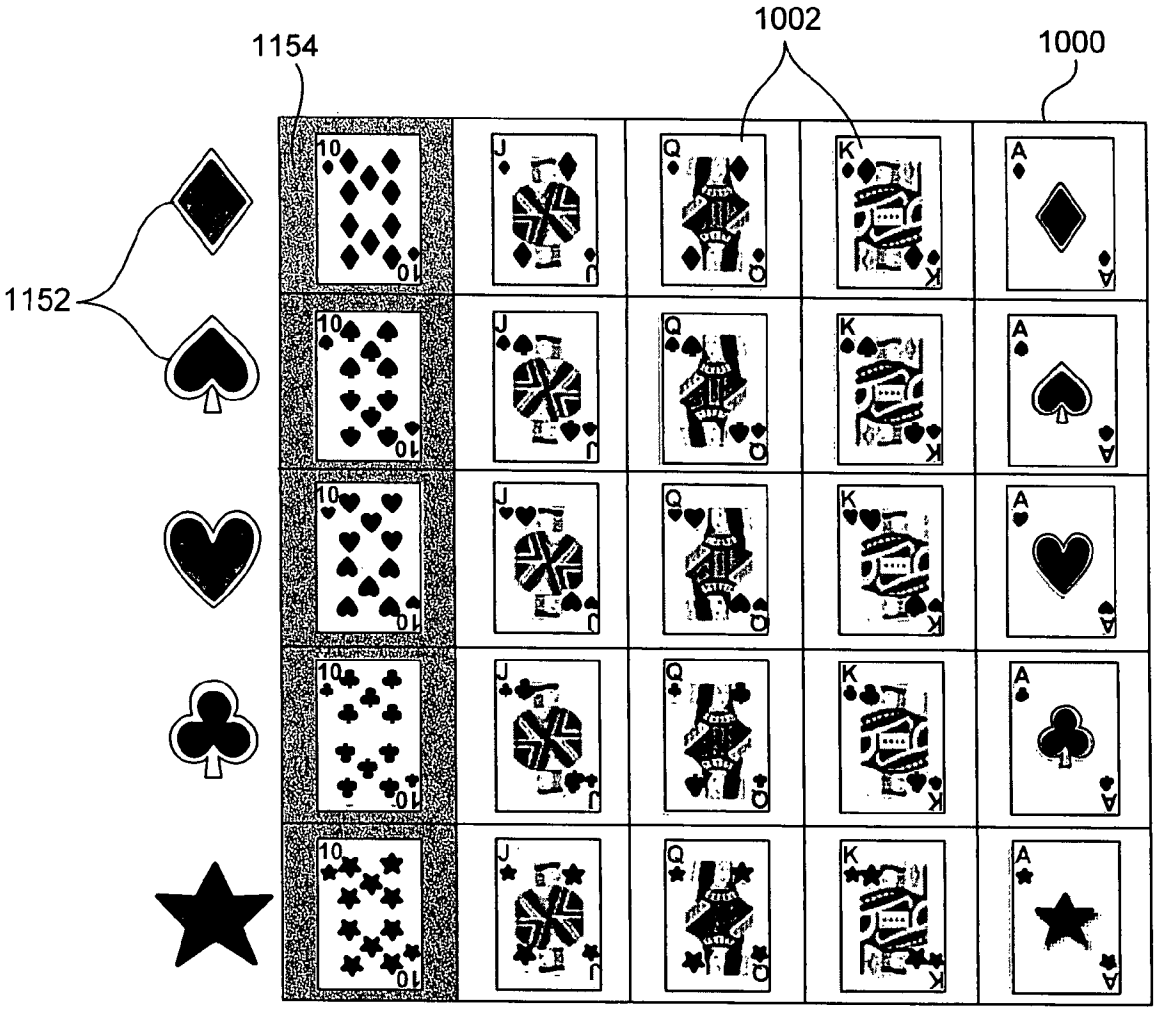

In a further alternate mapping strategy illustrated in FIGS. 17 and 18A, the numbers in a particular column may be mapped to the 10 through ace of a particular suit, but with the playing cards of the alternate game card 1000 being arranged such that each row corresponds to a royal flush for a particular suit. Mapped in this manner, the rows and columns of numbers of the bingo game card 802 may be transposed during the mapping process such that each column of the bingo game card 802 may map to a corresponding row of the alternate game card 1000.

For example, in the game card 802 of FIG. 4, the 9 in the upper left hand corner of the bingo card 802 maps to the 10 of diamonds in the upper left hand corner of the alternate game card 1000, while the 6 in the lower left corner of the bingo card 802 maps to the ace of diamonds in the upper right hand corner of the alternate game card 1000, and the number 75 in the upper right hand corner of the bingo game card 802 maps to the 10 of stars in the lower left hand corner of the alternate card 1000. The remaining numbers are similarly transposed during the mapping of the bingo game card 802 to the alternate game card 1000 as illustrated in FIG. 18A. With the transposition of the rows and columns of the bingo game card 802 in this mapping strategy, it may also be desired to transpose the game winning pattern 840 consisting of the five numbers in the top row of the bingo game card 802 into the game winning pattern 1154 on the alternate game card 1000 consisting of five of a kind of 10's in the first column of the alternate game card 1000.

Figure 18B:
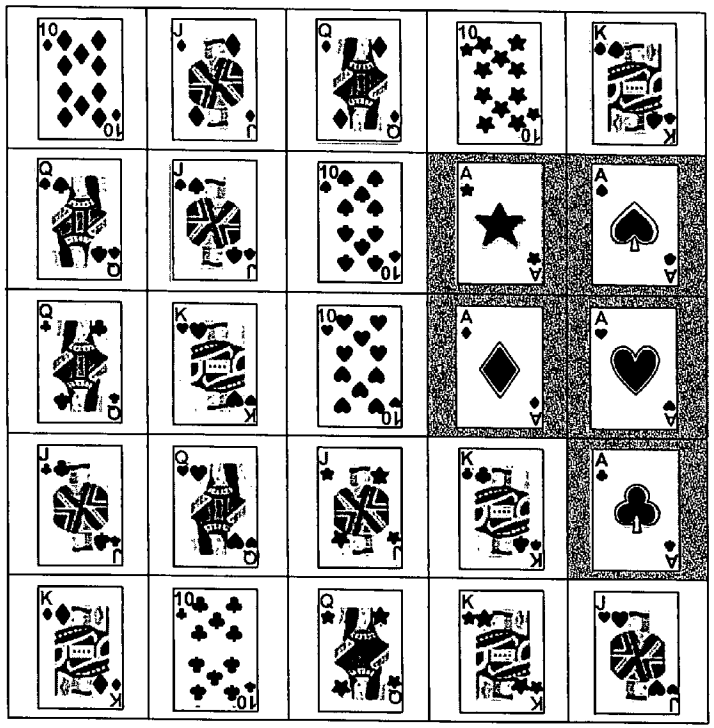
FIG. 18B is an alternate game card according to some implementations of the invention.
Figure 18C:
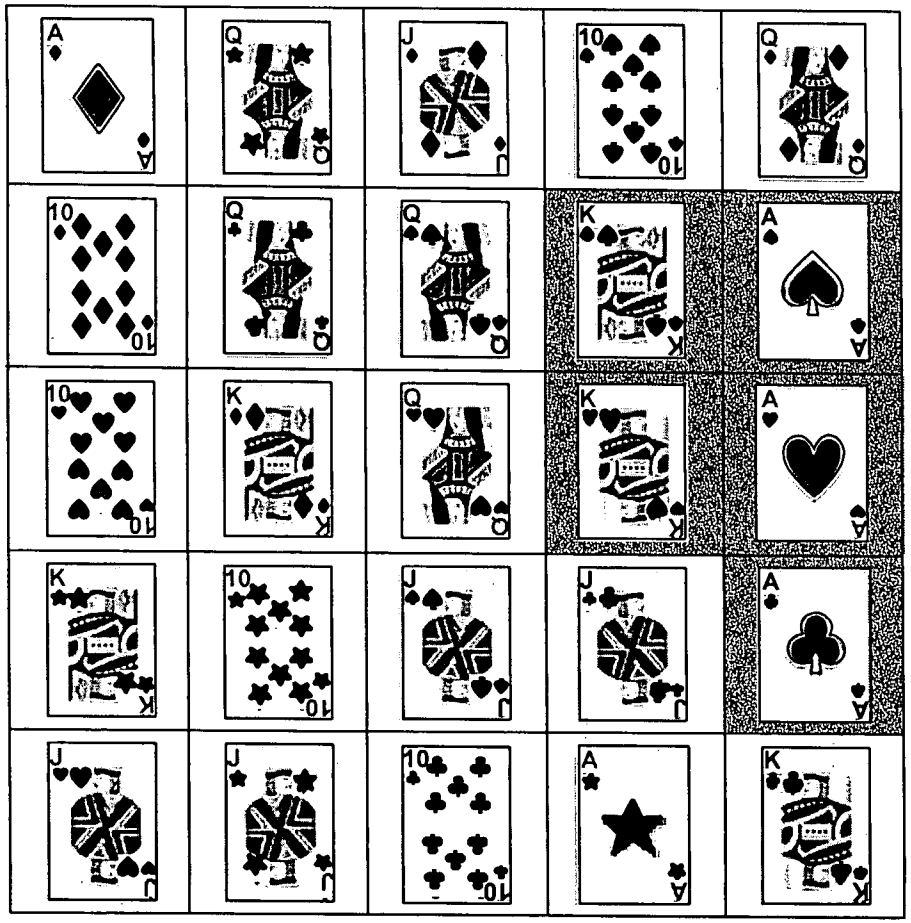
FIG. 18C is an alternate game card according to some implementations of the invention.

FIGS. 18B and 18C illustrate other embodiments of alternate game card 1000, in which game-winning pattern 1800 is not a complete row, column or diagonal. Game-winning pattern 1800 corresponds with a poker hand of 5 aces in FIG. 18B. Game-winning pattern 1800 corresponds with a poker hand of a full house, aces high, in FIG. 18C. Unlike some other embodiments, the playing cards in these embodiments of alternate game card 1000 are not organized such that rows or columns of the card correspond with a particular card or suit. Similarly, the game-winning pattern does not correspond to a completed row, column or diagonal.

In some implementations, all players of a particular game would have a bingo card, e.g., as shown in either 18B or 18C. The bingo numbers corresponding to each area/playing card symbol would preferably be different, as noted above, and all players would be playing for the same game-winning pattern and hand of cards. In alternative implementations, all players play for the same game-winning pattern, but the game-winning pattern may correspond to a plurality of card hands on various bingo cards. For example, one player of a game could have a bingo card as shown in FIG. 18B and another player in the same game could have a bingo card as shown in FIG. 18C. Each player is playing for the same game-winning pattern and has the same chance of winning. However, the potentially game-winning hand of cards is not the same on each bingo card.

While several alternate mapping strategies are described and illustrated herein, those skilled in the art will understand that other mapping strategies may be used to match the numbers of the bingo game card 802 to playing cards of the alternate game card 1000 or to other configurations of alternate game cards.

In the previously described embodiment, each occurrence of the bingo game may include some players using bingo game cards 802, while the remaining players may use the alternate game cards 1000. However, the gaming machines and the multi-player bingo game (i.e., a game provided by a game server) may be configured such that all of the game cards used in a given occurrence of the multi-player bingo game may be either the standard bingo game card 802 or the alternate game cards 1000. In one embodiment, the multi-player bingo game may be configured such that players electing to display the alternate game card 1000 may be grouped together separately from players electing to use the standard bingo card 802 at the time the player elects to use the alternate game card 1000 at blocks 1052, 1054 of FIG. 7.

When the first player enrolls in an occurrence of the multi-player bingo game at block 702 of FIG. 17A and elects to use either the bingo game card 802 or the alternate game card 1000, additional players enrolling at block 708 and electing to use the same game card 802, 1000 as the first enrolling player may be added for the same occurrence of the game until the enrollment timer expires at block 710. At the same time, additional players enrolling at block 708 an electing to use the game card 802, 1000 not selected by the first enrolling player may be placed in a different occurrence of the multi-player bingo game with other later enrolling players electing to use the other game card 802, 1000 until the expiration of the enrollment timer for the other occurrence of the multi-player bingo game. As a further alternative, the gaming units 20 may segregated into groups offering the multi-player bingo game and displaying either the bingo game card 802 or the alternate game card 1000, and not allowing players to elect between the game cards 802, 1000.

In further alternative embodiments, the alternative game cards 1000 may be generated without the necessity of mapping the alternate game cards 1000 to underlying bingo game cards 802. For example, each occurrence of the multi-player bingo game may use a random draw of numbers from the range of 1 through 75, but with numbers from that range being mapped directly to the playing cards 1002 of the alternate game card 1000 instead of first selecting a bingo game card 802 for the player for the occurrence of the game. In one implementation, the range of numbers 1 through 75 may be subdivided into ranges corresponding to suits or ranks of cards in a similar manner as the numbers are grouped for the columns of the traditional bingo card 802, with numbers within the groups being randomly selected to map to the playing cards on the alternate game card 1000 within the corresponding suit or rank. Alternatively, the selection of numbers from within the range of 1 through 75 may be completely random such that any number from the range may be mapped to any of the playing cards 1002 on the alternate game card 1000 for a given occurrence of the game.

It will further be understood that for implementations of the multi-player game that did not use an underlying bingo game card 802 for mapping to the alternate game card 1000, the random number draw or other random selection mechanism may be appropriately sized to correspond to the number of individual playing cards that may be displayed during the course of the multi-player game using the alternate game card 1000. Still further, the alternate game card 1000 may be configured as desired for the implementation of the multi-player game. For example, the alternate game card 1000 may consist of an array of four rows by five columns, with each row corresponding to one of the suits of a traditional deck of playing cards, and with the five playing cards in each row being randomly selected from the thirteen available playing cards within each suit. Of course, other configurations of the alternate game card 1000 will be apparent to those skilled in the art as having use with the multi-player game according to the present invention.

The bingo cards illustrated above further show the same game-winning pattern 1154 used on the alternate game card 1000 as the game-winning pattern 840 used on the bingo game card 802. However, the game winning patterns used on the alternate game card 1000 may be varied as desired to further enhance a poker theme for the multi-player game. For example, the multi-player game may be configured such that predetermined traditional poker hands may be used as the game winning patterns for the multi-player game. Consequently, in some implementations any matched pattern constituting four of a kind, five of a kind, a royal flush and the like may constitute a game-winning pattern on the alternate game card 1000.

If desired, particularly in implementations where an occurrence of the game may include some players using the alternate game card 1000 and other players using traditional bingo cards 802, the poker hands constituting game-winning patterns may be selected such that the probability of matching the game-winning pattern on the alternate game card 1000 is approximately equal to the probability of matching the game-winning pattern on the traditional bingo game card 802. For games utilizing only the alternate game card 1000, the game-winning pattern may be varied between occurrences of the game and be randomly determined, or otherwise determined in order to implement a desired game play strategy for the multi-player game.

Games utilizing the alternate game card 1000 may also offer interim awards for matching predetermined interim patterns in a similar manner as discussed above. As with the game winning patterns, players may receive interim pattern awards for matching the same patterns as players playing the bingo cards 802. Alternatively, as with the game-winning patterns, the interim patterns for the alternate game card 1000 may be selected to correspond to predetermined poker hands having approximately the same probability of being matched during the occurrence of the game as corresponding interim patterns for the bingo game card 802. Still further, the interim patterns for the alternate game card 1000 may be selected independently of the interim patterns for the bingo game cards 802 to match predetermined poker hands that result in gaming awards to achieve a desired payout rate for the multi-player game.

Each area of the bingo card does not necessarily map to an unique card. In some implementations, for example, 2 or more spots can map to the same card. Thus, the player's bingo card may have, e.g., 5 spots that could map to the King of diamonds. In some such implementations, the player will not know which spot on the bingo card (in this example, which King of diamonds) maps to the drawn card until he or she daubs. Such implementations further increase player anticipation and excitement. In other implementations having non-unique card mappings, the player may choose one spot among 2 or more spots on the bingo card corresponding to the drawn card. For example, the player may select the spot by touching a corresponding portion of a display screen. In yet other implementations having non-unique card mappings, the spot on the bingo card is chosen as soon as the card is drawn.

Some implementations of the invention allow players an option of combining "hits" from more than one bingo card for the purpose of determining a winning pattern, such as an interim win pattern or a game-winning pattern. This feature will sometimes be referred to herein as "layering" of bingo cards or the like. Some layering implementations allow hits to be combined from multiple bingo cards even for a progressive win.

Figure 19A:
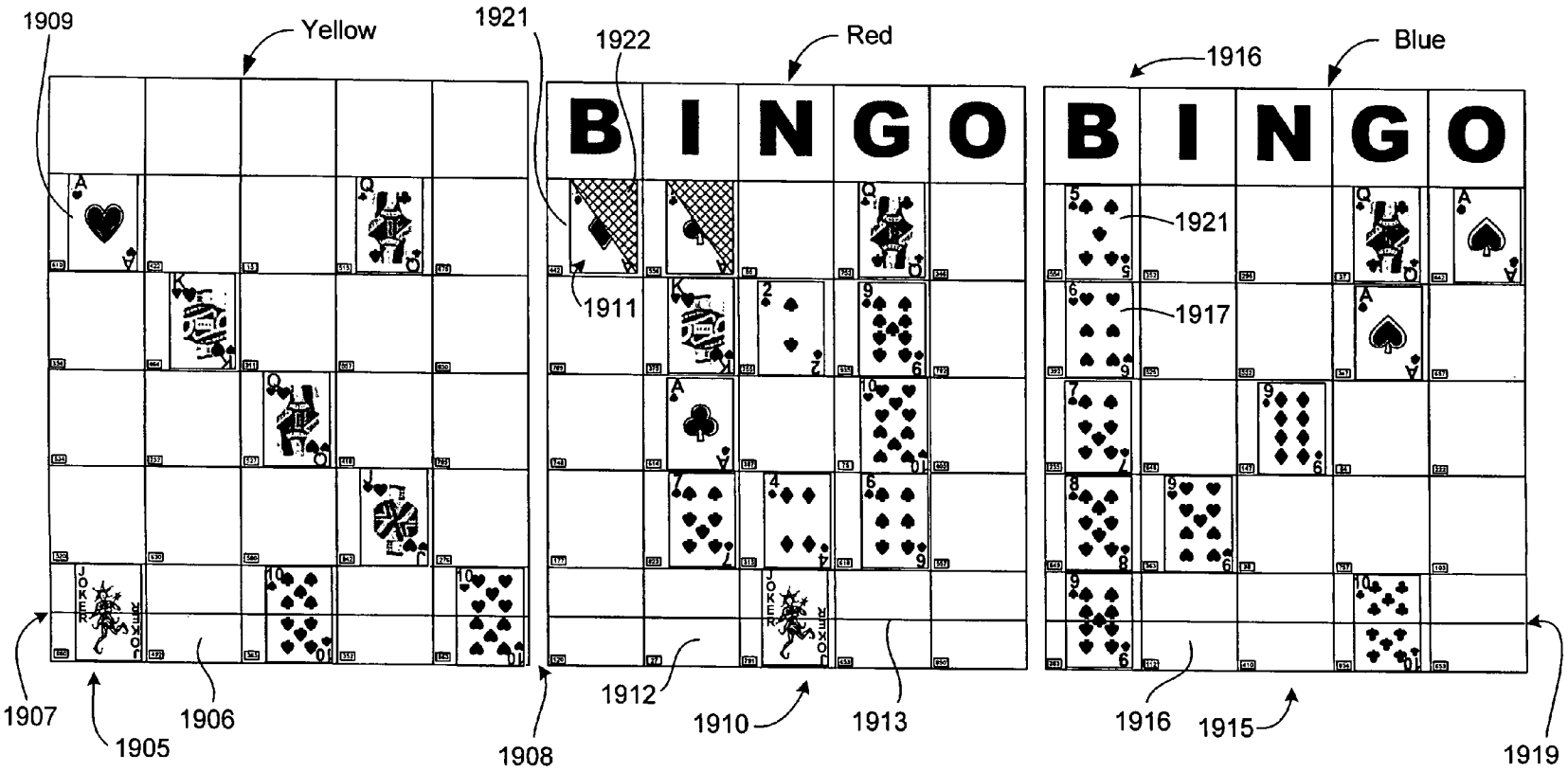
FIG. 19A depicts 3 bingo cards according to some implementations of the invention.

Some exemplary layering implementations will now be described with reference to FIG. 19A et seq. FIG. 19A depicts bingo cards 1905, 1910 and 1915, which are 5×5 bingo cards in this example. Here, hits in areas of bingo cards 1905, 1910 and 1915 are indicated by displaying playing card symbols in the respective areas. In some implementations of the invention, multiple bingo cards (e.g., 2 or more of bingo cards 1905, 1910 and 1915) may be played by a single player in a bingo game.

In this example, a player has chosen to play both yellow bingo card 1905 and blue bingo card 1915 of FIG. 19A. The player has also chosen to layer these cards for the purpose of making winning patterns. All playing cards shown are hits. In one "stud game" implementation, the cards along line 1907 of card 1905 can be combined with the cards along line 1919 of card 1915. The best 5 cards along both lines could be selected by the player or the machine (e.g., 4 Tens). However, this will not always provide the best outcome for a player. For example, the player's best hand is the Royal Flush along diagonal 1908 of card 1905. Preferably, only a part of the bingo cards (e.g., one line on each bingo card) can be combined. The part(s) of the bingo cards (e.g., lines or individual areas) that can be layered are preferably defined in advance. However, a player may or may not be aware of which parts may be layered.

Alternatively, or additionally, a single area of a bingo card may have more than one bingo number. Accordingly, for implementations wherein bingo numbers and/or areas are mapped to corresponding playing cards, a single area of a bingo card may correspond to more than one playing card. This is shown in FIG. 19A, for example, by the Six of Spades and the Six of Hearts that correspond to area 1917 of bingo card 1915.

Bingo cards 1905, 1910 and 1915 each have a corresponding color; the colors are yellow, red and blue, respectively, in this example. Although in some implementations these colors are simply used for decorative purposes, in other implementations the colors have significance. For example, in some implementations each bingo card corresponds with a playing card deck having a similar color. For example, bingo card 1910 may correspond with a card deck having red card backs, one of which is partially shown in area 1911.

Figure 19B:
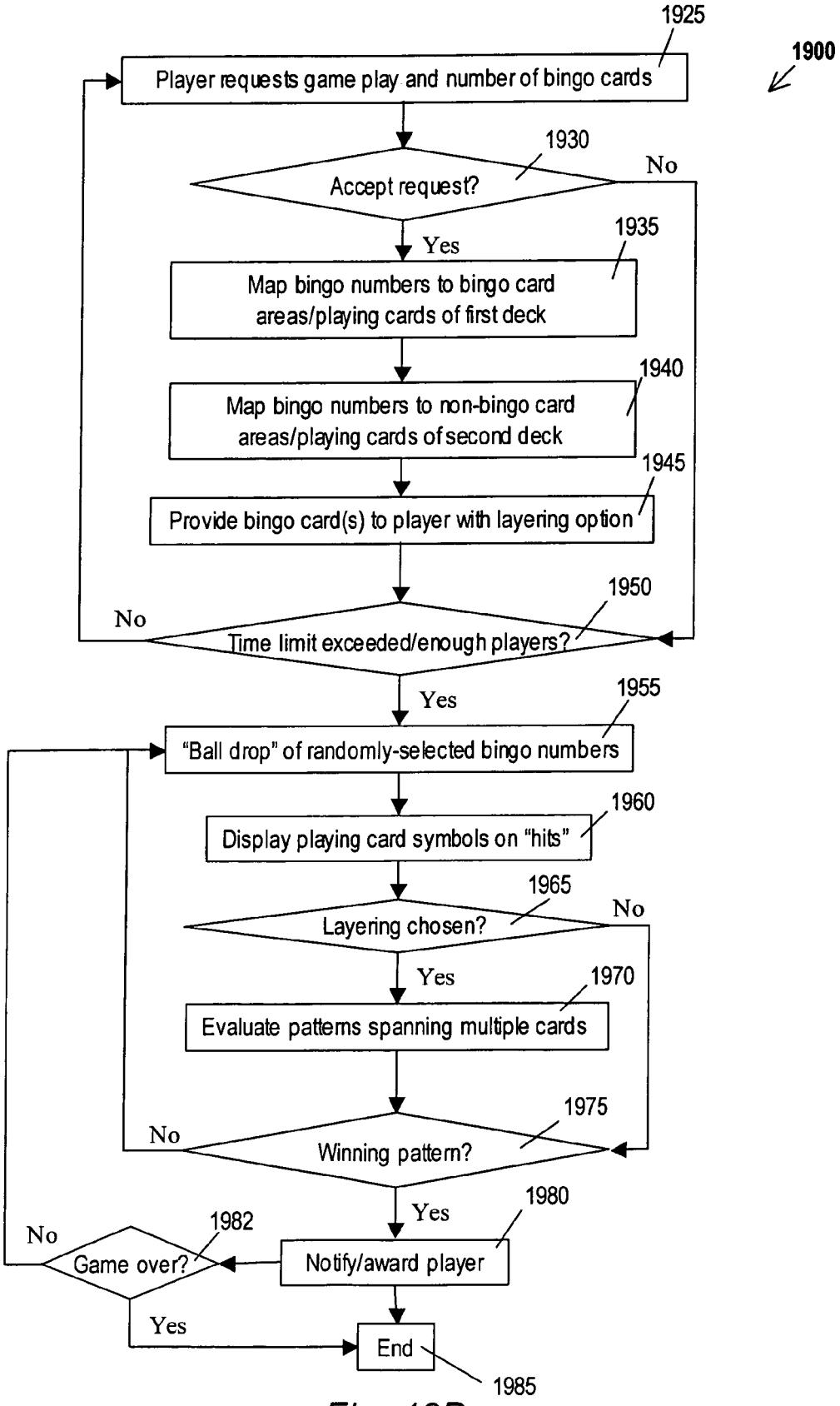
FIG. 19B is a flow chart that outlines some methods according to the present invention.

FIG. 19B is a flow chart that outlines method 1900, which is one example of implementing a bingo game involving layering. In step 1925, a player requests game play involving multiple bingo cards and specifies a desired number of bingo cards. The player may pay (or at least proffer) a wager in step 1925 or in a subsequent step. In step 1930, it is determined whether to accept the request, e.g., according to whether a device used by the player is authenticated, whether the player is an authorized player, etc., as described elsewhere herein. If the player's request is accepted, areas of the bingo card(s) are mapped to bingo numbers.

In this example, the areas are also mapped to playing cards so that the ensuing bingo game has aspects of a playing card game, such as a poker game. Here, the player has requested 3 bingo playing cards in step 1925. Accordingly, a playing card is mapped to each area of the 3 bingo cards in step 1935. In this example, a playing card is mapped to each area of bingo cards 1905, 1910 and 1915. In some such implementations, the playing cards mapped to areas of bingo card 1905 are from a deck having yellow card backs, the playing cards mapped to areas of bingo card 1910 are from a deck having red card backs and the playing cards mapped to areas of bingo card 1915 are from a deck having blue card backs. The mapping may include jokers, e.g. as indicated in FIG. 19A.

Moreover, in step 1940, additional bingo numbers are mapped to non-bingo card areas. In this example, step 1940 can also involve mapping additional bingo numbers to other cards of the same deck and/or to cards of another card deck. Whether or not the mapping involves another card deck will depend on how many cards are in the deck and how many randomly-selected numbers will potentially be drawn during the bingo game (e.g., the number of balls in the ball drop).

Implementing step 1940 (or a similar step) solves one problem that can arise when we have more bingo numbers drawn than cards in a deck. For instance, in some of the examples described above, a 52-card deck is used but more than 52 balls are dropped. For example, if we are using a 52-card deck, a 5 by 5 bingo card and have a 75-ball drop, we have only 27 extra cards (52−25=27) to match with the 50 "misses" (75−25=50). Therefore, it is possible that we have more than one instance of individual playing cards being shown to a player.

This effect can be ameliorated by having at most 52 areas on the bingo card (e.g., a 4 by 13 bingo card) and making all doubly-assigned cards "non-hits." However, the player could still see more than one instance of a card in the "non-hit" display (e.g., more than one Ace of Spades) and this could detract, to some degree, from a player's enjoyment of the game.

If we have more than one deck of cards, this problem can be solved. The "deck" can be indicated in various ways, e.g., by displaying a different color or pattern of a card back, by using a different style of playing cards, etc. In some implementations, only one of the decks results in usable "hits" on a player's bingo card. For example, in one such implementation, all hits on yellow bingo card 1905 would be indicated by "yellow deck" playing card symbols. In some such implementations, the color of the deck is indicated by the color of card backs that are shown, for example, before the playing card symbols are displayed.

Playing cards of another kind of deck (for example, a card deck having green card backs) could be used to illustrate at least some of the "misses." In this example, if we are using a 52-card yellow deck and have a 75-ball drop, we have only 27 extra cards (52−25=27) to match with the 50 "misses" (75−25=50), because bingo card 1905 is a 5 by 5 bingo card. Therefore, we could choose to use another deck (here, the green deck) for some or all of the misses. In some such implementations, playing cards from the second card deck are used for all of the misses.

In other implementations, the remaining cards of the first deck are used for some misses and the remaining misses are indicated by cards of the second deck. For example, the 27 extra cards of the first 52-card deck (here, the yellow deck) could be mapped to 27 of the misses and the remaining 23 misses could be mapped to cards of the second deck (here, the green deck). If more random numbers will be drawn (or could potentially be drawn), additional card decks could be used. As mentioned elsewhere herein, it will be appreciated by those of skill in the art that mapping steps 1935 and 1940 could be done at another time, e.g., prior to a player's request.

In step 1945, the bingo cards are presented to the player, e.g., on a display of a gaming machine or another device. In some implementations, areas of the bingo cards are shown as depictions of card backs until there is a hit. In other implementations, the areas are blank until there is a hit. In still other implementations, playing card symbols corresponding to each area are displayed before there is a hit; however, the display preferably changes when there is a hit on the area. For example, a playing card symbol may be "grayed out" before the area is hit and displayed in color after there is a hit.

In step 1945, the player is also given the option to "layer" the bingo cards. For example, the player may be prompted by means of a GUI indicating that the player has a predetermined time within which to choose the layering option. Preferably, the player is presented with an explanation and/or a graphical depiction of having hits on more than one bingo card being included in a winning pattern. In some implementations, if a player does not respond within the predetermined time, no layering will take place. In other implementations, all players who play the bingo game will be playing with layered bingo cards, so no selection is necessary.

In some implementations, the player's wager will be determined, in part, not only by the number of bingo cards being played but also by whether the "layering" option is chosen. Accordingly, in some implementations, the amount of the player's wager may be determined after receiving an indication from the player regarding the laying option.

The probability of hitting a layered pattern can be easily computed. If a bingo pattern contains one spot with 2 layers (each with a different bingo number), there are 2 chances, instead of the usual 1, for hitting that spot. Therefore, the probability of hitting the pattern is doubled. Thus, to compute the probability of hitting a layered pattern, one first computes the probability of hitting the pattern on a single layer. Then, for each spot that contains layers, the probability of hitting the pattern is multiplied by the number of unique bingo numbers contained on the layer. Note that if two layers on a single spot both contain the same bingo number, the probability of hitting that spot is the same as that of a single layer.

As an alternative embodiment, the layers aren't combined to form a single two-dimensional pattern, but remain distinct. The game can then reward the player for completing predetermined patterns on each card, which can be combined to form 3-dimensional patterns in some such implementations. For example, rather than reward the player for a 9-spot patterns composed of a 3×3 box on a single card, the game can reward the player for a 27-spot pattern composed of three 3×3 boxes, each on a different card or layer. The probability calculations for such a pattern are the same for any 2-D 27-spot pattern. Only the number of spots in the pattern matters—the size and 2-D or 3-D shape of the pattern is irrelevant in computing probabilities.

The players may or may not realize what parts of the bingo cards can be layered. However, player excitement can be enhanced by indicating what parts of the bingo cards can be layered. Accordingly, in some implementations, those parts of the bingo cards that can be layered are presented differently from other parts of the bingo cards, e.g. by using a different color, brightness, etc. For example, the outlines of areas that can be layered could be displayed in a characteristic fashion, e.g., flashing, glittering, showing a point of light tracing the outline of the area, etc. In yet other implementations, areas that can be layered will light in sequence, e.g., along a line that can be layered with corresponding lines of other bingo cards.

Figure 20:
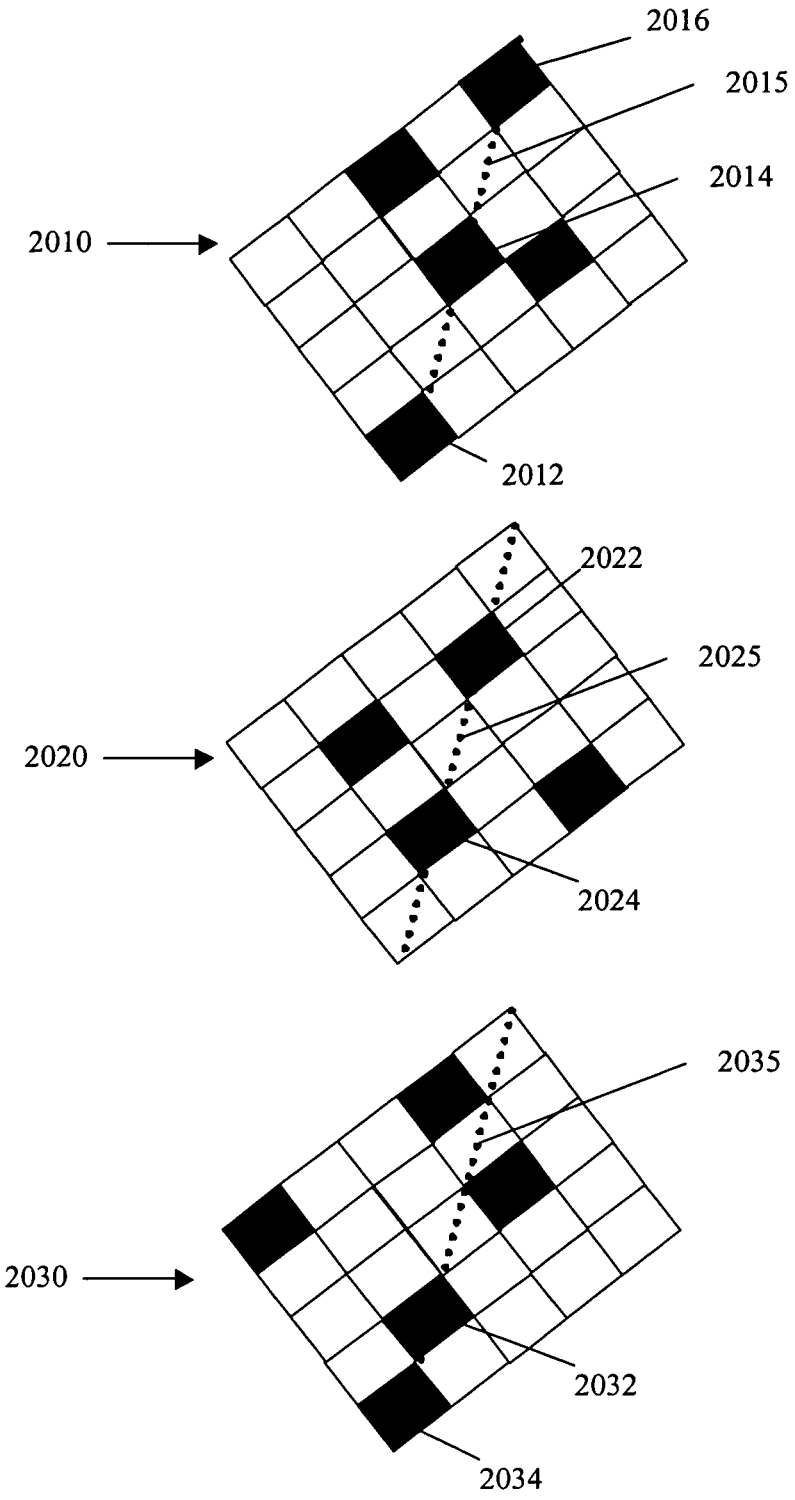
FIG. 20 depicts 3 bingo cards that are "layered" according to some implementations of the invention.

FIG. 20 indicates an alternative method of indicating what areas of bingo cards can be layered. In this example, a player is playing all of bingo cards 2010, 2020 and 2030 during a single game and has chosen a layering option. Here, hits in areas along corresponding lines of bingo cards 2010, 2020 and 2030 can be combined when determining whether a winning pattern has been achieved. Accordingly, diagonal "stacking lines" 2015, 2025 and 2035 are indicated on bingo cards 2010, 2020 and 2030, respectively.

In this example, stacking lines 2015, 2025 and 2035 are in corresponding parts of bingo cards 2010, 2020 and 2030. However, in alternative implementations, the orientations of stacking lines may differ from bingo card to bingo card. For example, in some such implementations, hits on a vertical stacking line of a first bingo card can be combined with hits on a diagonal stacking line of a second bingo card and hits on a horizontal stacking line of a third bingo card. Moreover, while stacking lines are automatically determined in preferred implementations, alternative implementations allow players to select stacking lines.

Stacking lines are preferably displayed in a conspicuous manner. For example, stacking lines 2015, 2025 and 2035 may be displayed in one or more bright colors, flashing, with each dot lit up in sequence to simulate a neon sign, or in some other conspicuous manner. However, in alternative embodiments, bingo cards will not have any initial indication of what areas can be stacked. For example, in some implementations, bingo cards that are combining hits along stacking lines do not indicate the stacking lines. Accordingly, players will not initially realize what areas were being stacked. Preferably, even in such implementations, the stacked areas are displayed to the player when a winning pattern is determined.

After a predetermined period of time has elapsed and/or after enough players have completed the foregoing steps, bingo numbers are randomly selected in step 1955. As previously mentioned, the number of randomly-selected bingo numbers that are drawn and the manner of drawing the numbers can vary according to the implementation.

In step 1960, hits are indicated on the bingo cards. In this example, hits are indicated by displaying playing card symbols in bingo card areas where there is a hit. The playing card symbol may depict part or all of a playing card. For example, the Ace of Hearts depicted in area 1909 of FIG. 19A indicates that a bingo number corresponding to area 1909 has been drawn.

In this implementation, the process of evaluating whether a winning pattern has been established will depend on whether a player has selected the laying option. Accordingly, in step 1965 it is determined whether the player has elected to layer his or her bingo cards. If so, patterns that include hits on multiple bingo cards are evaluated in step 1970.

Figure 21:
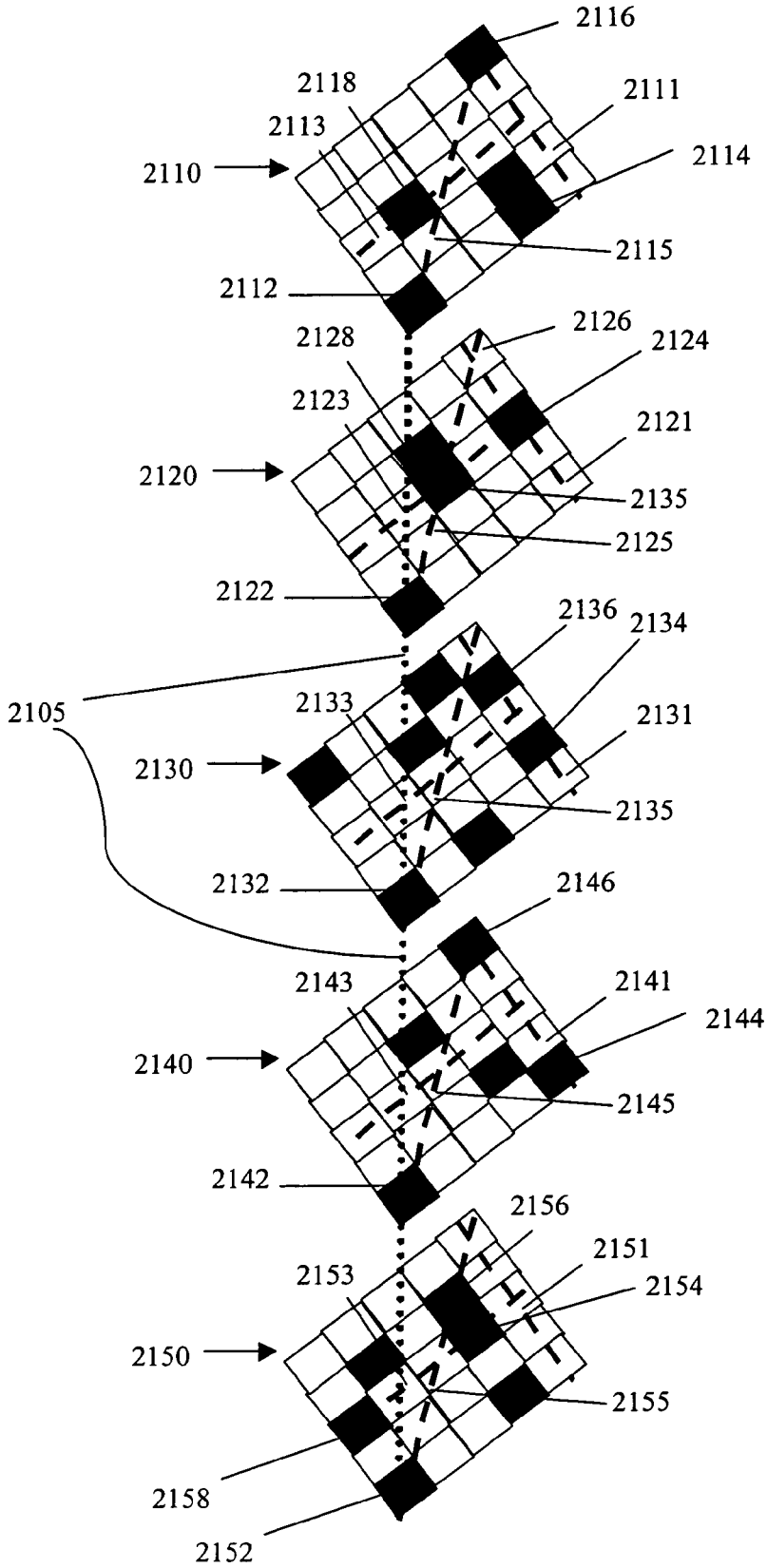
FIG. 21 depicts 5 bingo cards that are "layered" according to alternative implementations of the invention.

Some examples of layering are illustrated in FIGS. 20 and 21. Hits are depicted in FIGS. 20 and 21 as blackened areas; according to some implementations discussed herein, these hits would correspond to, and be displayed as, playing card symbols. As mentioned above, hits in areas along a diagonal line of bingo cards 2010, 2020 and 2030 of FIG. 20 can be combined when determining whether a winning pattern has been achieved. Accordingly, when determining whether there is a winning pattern, the playing cards corresponding to hits 2012, 2014 and 2016 of bingo card 2010, hits 2022 and 2024 of bingo card 2020 and hits 2032 and 2034 of bingo card 2030 will be considered.

In some implementations, there must be at least one hit on one of the bingo cards in each corresponding area of a line along which layering can occur. The hits shown in FIG. 20 would meet this requirement, because hits 2012, 2014 and 2016 of bingo card 2010, along with hits 2022 and 2024 of bingo card 2020, occupy all 5 areas along corresponding lines 2015 and 2025.

Alternative embodiments do not have this requirement. Referring to FIG. 19A, for example, suppose a player is playing all of bingo cards 1905. 1910 and 1915, and that hits along the lowest horizontal line of all bingo cards can be layered. In some implementations, the cards (including jokers) along line 1907 of card 1905 can be combined with the cards along corresponding line 1913 of bingo card 1910 and line 1919 of bingo card 1915, even if there is no hit in area 1906 or corresponding areas 1912 or 1916. The best 5 cards along all lines could be selected by the player or the machine (e.g., 5 Tens). In some such implementations, the first 5 hits along all stacking lines may be used to determine a winning pattern.

The stacking lines discussed with reference to FIGS. 19A and 20 include multiple areas of the same bingo card. Accordingly, such stacking lines are sometimes referred to herein as "intra-card stacking lines" or the like. FIG. 21 also includes a stacking line that combine a corresponding area of different bingo cards, sometimes referred to herein as an "inter-card stacking line" or the like. Here, stacking line 2105 indicates that a hit on area 2112 of bingo card 2110 can be combined with a hit on area 2122 of bingo card 2120, a hit on area 2132 of bingo card 2130, a hit on area 2142 of bingo card 2140 and a hit on area 2152 of bingo card 2150 in order to determine whether there is a winning pattern.

As with intra-card stacking lines, inter-card stacking lines may or may not actually be displayed to a player. Alternatively, intra-card stacking lines and/or inter-card stacking lines may be indicated by displaying the areas connected by such lines in a distinctive manner. For example, the areas comprising a stacking line could be displayed in a manner common to other areas of the same stacking line, but distinct from other areas that are not part of the stacking line. Alternatively, areas comprising a stacking line could blink, e.g., in sequence.

FIG. 21 also includes 3 different sets of intra-card stacking lines. Stacking line 2115 of bingo card 2110 corresponds with stacking line 2125 of bingo card 2120, stacking line 2135 of bingo card 2130, stacking line 2145 of bingo card 2140 and stacking line 2155 of bingo card 2150. Accordingly, if the bingo cards of FIG. 21 were used to implement method 1900 of the present invention (see FIG. 19B), the playing cards corresponding to areas 2112, 2116, 2122, 2135, 2132, 2142, 2146, 2152 and 2156 are all evaluated to determine whether a winning pattern or "hand" has been established in step 1970. Similarly, stacking line 2111 corresponds with stacking lines 2121, 2131, 2141 and 2151. Therefore, the playing cards corresponding to areas 2116, 2124, 2134, 2136, 2144 and 2146 are all evaluated to determine whether a winning pattern has been established in step 1970. Likewise, stacking line 2113 corresponds with stacking lines 2123, 2133, 2143 and 2153. Therefore, the playing cards corresponding to areas 2118, 2124, 2135, 2154 and 2158 are evaluated in step 1970.

In step 1975, it is determined whether a winning pattern has been established for at least one player. If so, the player is notified (e.g., by characteristic display of a winning hand and/or characteristic sounds) in step 1980. For example, the player's display may indicate playing cards being "dealt" from "hit" areas of a player's bingo card(s) to form a display of a winning hand. The playing cards (and/or the bingo cards)

of the display may be set in motion, e.g., spinning, may change shape or color, etc. Preferably, a winning pattern is also indicated by one or more characteristic sounds (e.g., a human voice congratulating the player) being emitted from speakers of a gaming machine or other device.

As noted elsewhere herein, winning patterns may be interim win patterns, which in some implementations can be won by more than one player during a single game. Accordingly, in step 1982 it is determined whether the winning pattern was a game-winning pattern. If not, more bingo numbers are drawn (step 1955). If so, the game ends. (Step 1985.)

Figure 22:
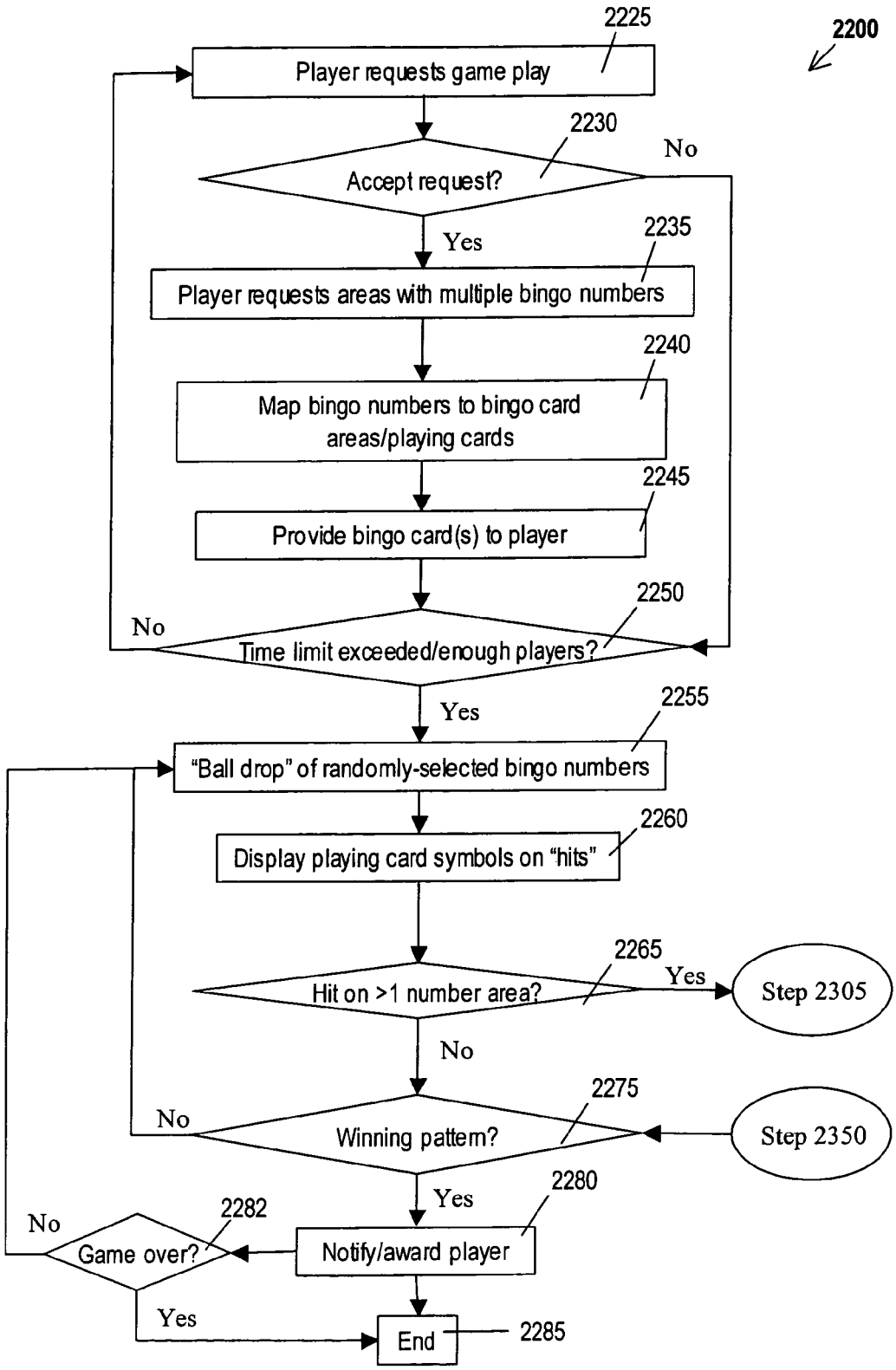
FIG. 22 is a flow chart that outlines some methods of the invention involving multiple bingo numbers being assigned to the same area of a bingo card.
Figure 23:
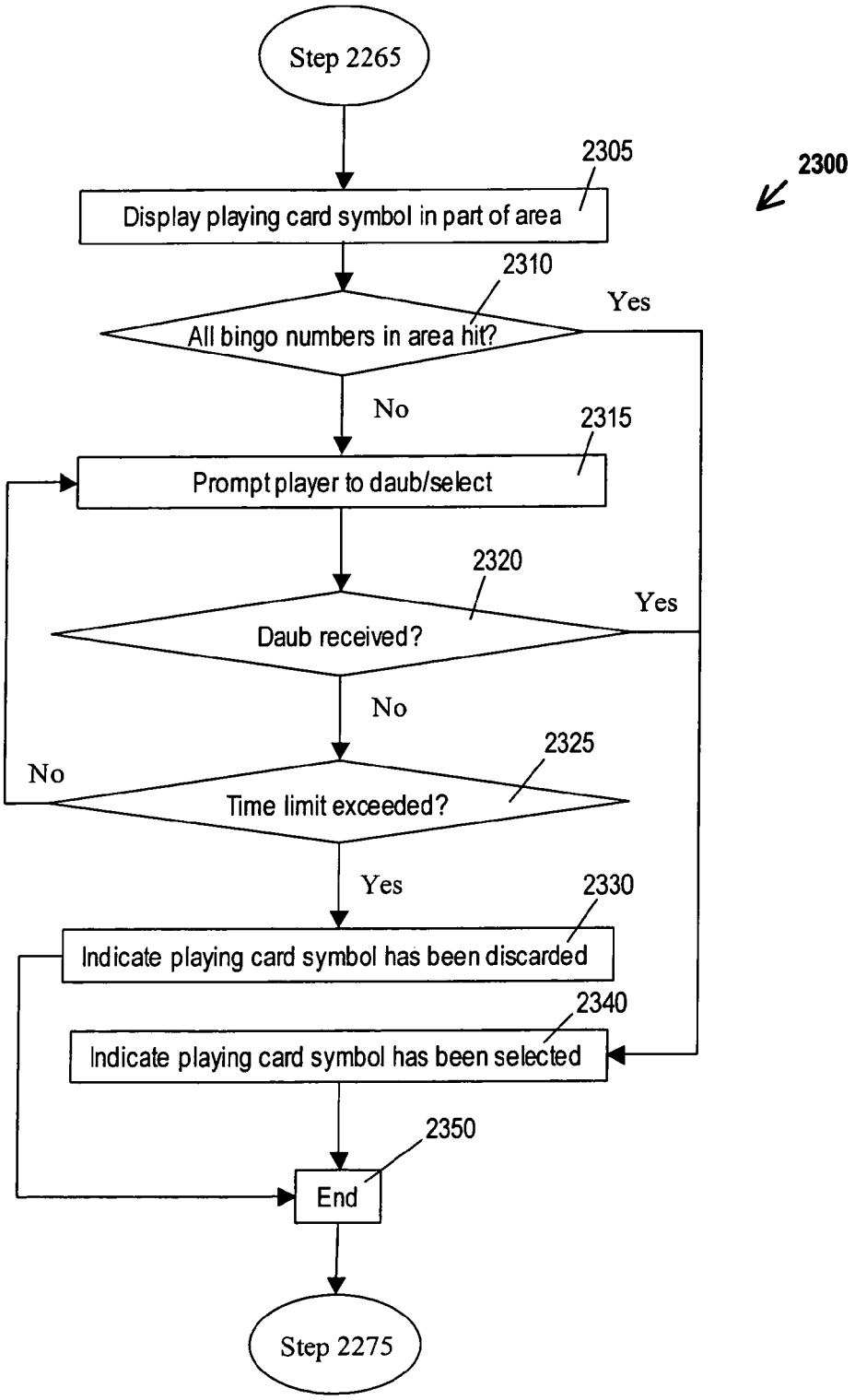
FIG. 23 is a flow chart that outlines some methods of the invention involving multiple bingo numbers being assigned to the same area of a bingo card.

As previously noted with reference to area 1917 of bingo card 1915 (see FIG. 19A), some implementations of the invention include bingo cards having at least one area with more than one corresponding bingo number. One exemplary method of providing a bingo game using such bingo cards will now be described with reference to the flow charts of FIGS. 22 and 23. The overall flow of method 2200 (FIG. 22) is similar that of previously-described methods, such as method 1900. Accordingly, only the differences between method 2200 and the previously-described methods will be discussed in detail.

In step 2225, a player requests game play and in step 2230 it is determined whether to accept the player's request. If the request is accepted, the player requests a bingo card having at least one area with more than one associated bingo number (step 2235). In some implementations, the player also has the option of selecting which area(s) will have more than one associated bingo number. In alternative implementations, the game automatically chooses one or more bingo card areas that will have more than one associated bingo number. In yet other implementations, all bingo cards played in the game will have at least one area having more than one associated bingo number; accordingly, a player does not need to request such a bingo card in step 2235.

If either of two numbers in a spot counts as a hit for that spot, the probability of completing that spot is doubled. Likewise for any pattern containing that spot. If both of the two numbers in a spot must be hit for that spot to count, then the probability is calculated as if it were a 2-spot pattern. The probability for any pattern containing that spot is calculated as if the pattern contained one more spot.

Then, bingo numbers are mapped to areas of at least one bingo card, depending on whether the player will be playing only one bingo card or multiple bingo cards. (Step 2240.) In this example, playing cards are also mapped to these areas in step 2240 and then the bingo cards are provided to the player (step 2245). As before, a determination is made as to whether a time limit has been exceeded and/or whether enough players are available to start the game (step 2250) before bingo numbers are drawn. (Step 2255.) In this implementation, playing card symbols are displayed in "hit" areas of a player's bingo card(s). (Step 2260.)

In step 2265, it is determined whether there has been a hit on an area having more than one associated bingo number. If so, the next step is step 2305 of FIG. 23. A playing card symbol is displayed in at least part of the area. (Step 2305.) For example, the display may appear similar to area 1911 of bingo card 1910 (FIG. 19A), wherein part 1921 of area 1911 displays a playing card symbol and part 1922 of area 1911 displays a card back.

In this implementation, a player must decide whether to keep or discard a playing card associated with the bingo number, unless all other bingo numbers associated with the area have previously been drawn. For example, referring now to area 1917 of bingo card 1915 (FIG. 19A), there might first be a hit on a bingo number corresponding to the Six of Hearts. If so, a player be presented with a choice between keeping the Six of Hearts and having a normal 9-high Straight or discarding the Six of Hearts and hoping for a hit that would result in a 9-high Straight Flush.

The player's choice may be influenced by whether the player is aware of the playing card associated with the other bingo number(s) associated with the area. In this example, the player can see that the other bingo number associated with area 1917 is the Six of Spades. Therefore, the player may be relatively more inclined to discard the Six of Hearts and try for the Straight Flush than if the player did not know that the other bingo number associated with area 1917 is the Six of Spades. In other implementations, the player does not know in advance what playing card is associated with the other bingo number(s) assigned to the area.

Moreover, alternative implementations simply display the playing cards associated with each bingo card drawn and allow a player to use either playing card to form a winning pattern. In some such implementations, the playing card used to form the winning pattern is selected by the player; in other such implementations, the playing card used to form the winning pattern is selected by the game.

However, according to the present example it is determined in step 2310 whether all bingo numbers associated with the area have now been drawn. If so, the playing card is treated as having been selected by the player (step 2340), method 2300 ends (step 2350) and the playing card will be available for a determination of whether a winning pattern has been established (step 2275).

If there are still other bingo numbers assigned to the area that have not yet been drawn, the player is prompted to decide whether to select or discard the playing card. (Step 2315.) If the player selects the card within a predetermined time, the flow proceeds to step 2340, as described above. In this example, if it is determined in step 2325 that the player has not daubed within the predetermined time, the playing card is treated as being discarded (step 2330) and method 2300 ends. As before, the flow proceeds to step 2275, wherein it is determined whether a winning pattern has been established. If no other bingo number associated with the area is subsequently drawn, no playing card will be associated with the area for the purpose of determining whether there is a winning pattern.

As before, a player is notified when there is a winning pattern (step 2280) and it is determined whether the winning pattern is a game-winning pattern. (Step 2282.) At that point, the process ends. (Step 2285.)

Figure 24:
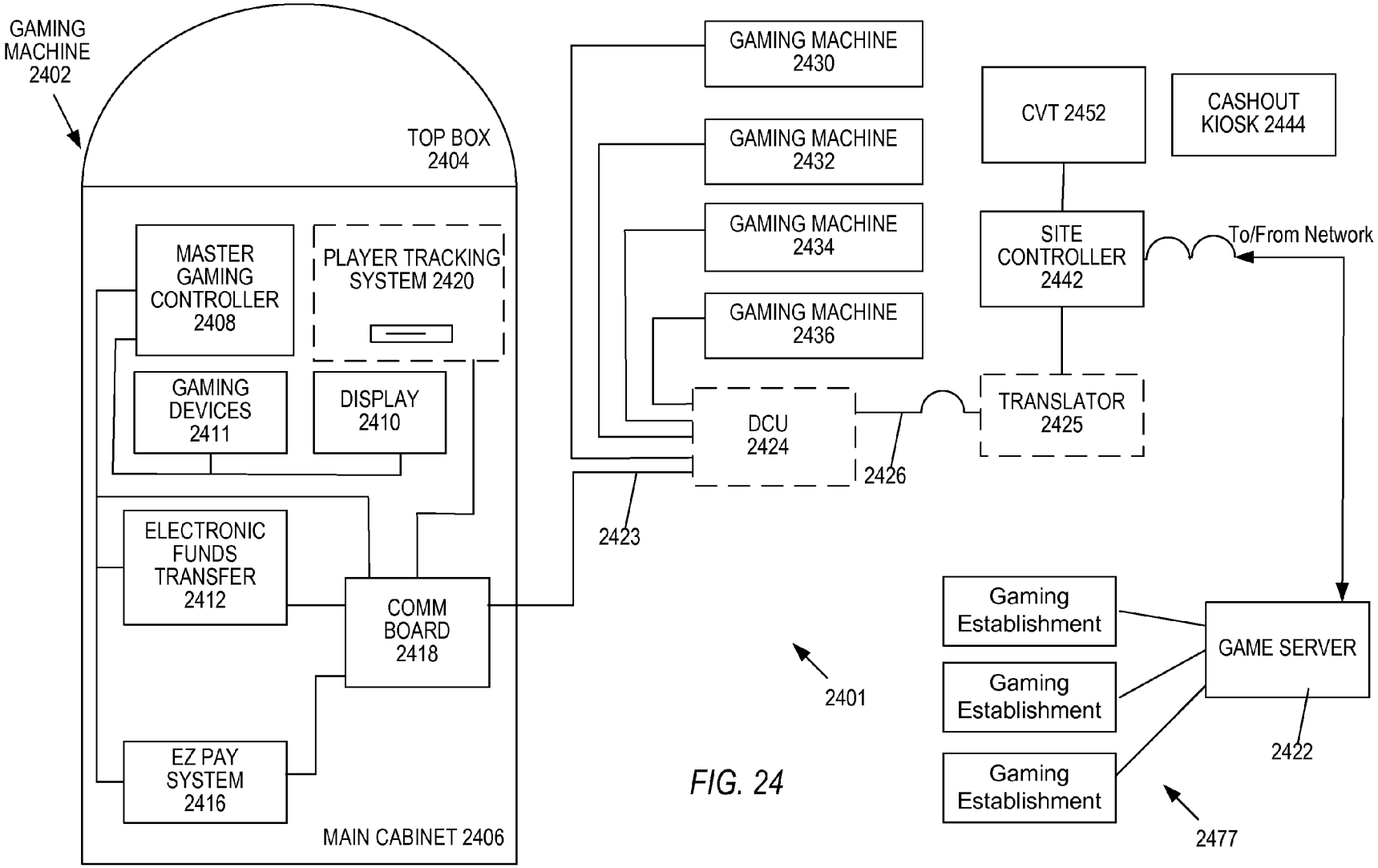
FIG. 24 is a block diagram of a number of gaming machines in a gaming network that may be configured to implement some methods of the present invention.

One example of a gaming machine network that may be used to implement methods of the invention is depicted in FIG. 24. Gaming establishment 2401 could be any sort of gaming establishment, such as a casino, a card room, an airport, a store, etc. However, the methods and devices of the present invention are intended for gaming networks (which may be in multiple gaming establishments) in which there is a sufficient number of Class II gaming machines for bingo play. In this example, gaming network 2477 includes more than one gaming establishment, all of which are networked to game server 2422.

Here, gaming machine 2402, and the other gaming machines 2430, 2432, 2434, and 2436, include a main cabinet 2406 and a top box 2404. The main cabinet 2406 houses the main gaming elements and can also house peripheral systems, such as those that utilize dedicated gaming networks. The top box 2404 may also be used to house these peripheral systems.

The master gaming controller 2408 controls the game play on the gaming machine 2402 according to instructions and/or game data from game server 2422 and receives or sends data to various input/output devices 2411 on the gaming machine 2402. Details of exemplary systems for using a game server to control a network of gaming machines to implement bingo games are described in U.S. patent application Ser. No. 60/503,161, filed Sep. 15, 2003 and entitled "Gaming Network with Multi-Player Bingo Game." This application is hereby incorporated by reference for all purposes. The master gaming controller 2408 may also communicate with a display 2410.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZ Pay™ marketing management, and data tracking, such as player tracking. Therefore, master gaming controller 2408 may also communicate with EFT system 2412, EZ Pay™ system 2416 (a proprietary cashless ticketing system of the present assignee), and player tracking system 2420. The systems of the gaming machine 2402 communicate the data onto the network 2423 via a communication board 2418.

It will be appreciated by those of skill in the art that the present invention could be implemented on a network with more or fewer elements than are depicted in FIG. 24. For example, player tracking system 2420 is not a necessary feature of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment.

Moreover, DCU 2424 and translator 2425 are not required for all gaming establishments 2401. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 2442 provides this function for gaming establishment 2401. Site controller 2442 is connected to a central system and/or other gaming establishments via one or more networks, which may be public or private networks. Among other things, site controller 2442 communicates with game server 2422 to obtain game data, such as ball drop data, bingo card data, etc.

In the present illustration, gaming machines 2402, 2430, 2432, 2434 and 2436 are connected to a dedicated gaming network 2423. In general, the DCU 2424 functions as an intermediary between the different gaming machines on the network 2423 and the site controller 2442. In general, the DCU 2424 receives data transmitted from the gaming machines and sends the data to the site controller 2442 over a transmission path 2426. In some instances, when the hardware interface used by the gaming machine is not compatible with site controller 2442, a translator 2425 may be used to convert serial data from the DCU 2424 to a format accepted by site controller 2442. The translator may provide this conversion service to a plurality of DCUs.

Further, in some dedicated gaming networks, the DCU 2424 can receive data transmitted from site controller 2442 for communication to the gaming machines on the gaming network. The received data may be, for example, communicated synchronously to the gaming machines on the gaming network.

Here, CVT 2452 provides cashless and cashout gaming services to the gaming machines in gaming establishment 2401. Broadly speaking, CVT 2452 authorizes and validates cashless gaming machine instruments (also referred to herein as "tickets" or "vouchers"), including but not limited to tickets for causing a gaming machine to display a game result and cashout tickets. Moreover, CVT 2452 authorizes the exchange of a cashout ticket for cash. These processes will be described in detail below. In one example, when a player attempts to redeem a cashout ticket for cash at cashout kiosk 2444, cash out kiosk 2444 reads validation data from the cashout ticket and transmits the validation data to CVT 2452 for validation. The tickets may be printed by gaming machines, by cashout kiosk 2444, by a stand-alone printer, by CVT 2452, etc. Some gaming establishments will not have a cashout kiosk 2444. Instead, a cashout ticket could be redeemed for cash by a cashier (e.g. of a convenience store), by a gaming machine or by a specially configured CVT.

Figure 25:
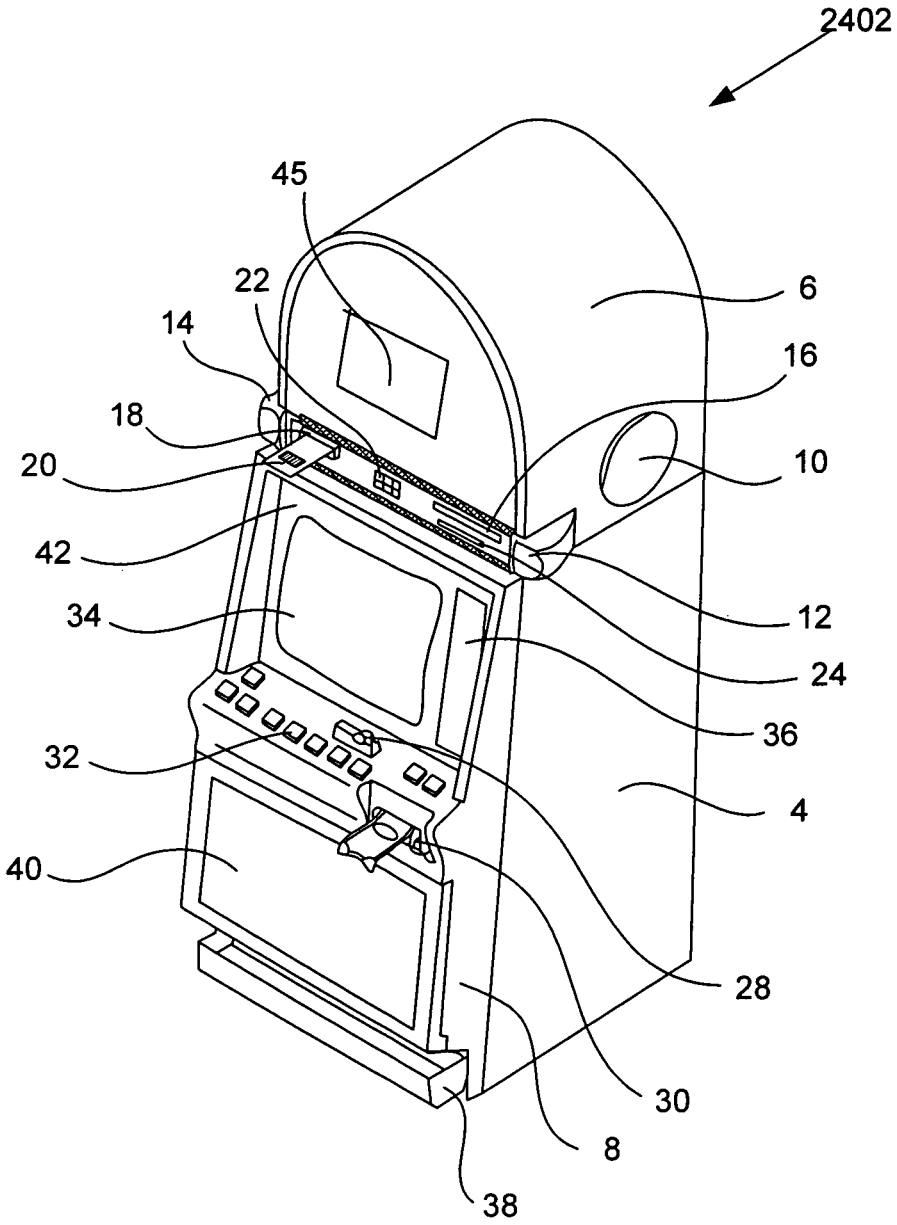
FIG. 25 illustrates an exemplary gaming machine that may be configured to implement some methods of the present invention.

Turning to FIG. 25, more details of gaming machine 2402 are described. Machine 2402 includes a main cabinet 4, which generally surrounds the machine interior (not shown) and is viewable by users. The main cabinet 4 includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, the number of coins played. The bill validator 30, player-input switches 32, video display monitor 34, and information panel are devices used to play a game on the game machine 2402. The devices are controlled by circuitry housed inside the main cabinet 4 of the machine 2402.

The gaming machine 2402 includes a top box 6, which sits on top of the main cabinet 4. The top box 6 houses a number of devices, which may be used to add features to a game being played on the gaming machine 2402, including speakers 10, 12, 14, a ticket printer 18 which may print bar-coded tickets 20 used as cashless instruments. The player tracking unit mounted within the top box 6 includes a key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 2402 is but one example from a wide range of gaming machine designs on which the present invention may be implemented. For example, not all suitable gaming machines have top boxes or player tracking features. Further, some gaming machines have two or more game displays—mechanical and/or video. Some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed. Moreover, some aspects of the invention may be implemented on devices which lack some of the features of the gaming machines described herein, e.g., workstation, desktop computer, a portable computing device such as a personal digital assistant or similar handheld device, a cellular telephone, etc. U.S. patent application Ser. No. 09/967,326, filed Sep. 28, 2001 and entitled "Wireless Game Player," is hereby incorporated by reference for all purposes.

Returning to the example of FIG. 25, when a user wishes to play the gaming machine 2402, he or she inserts cash through the coin acceptor 28 or bill validator 30. In addition, the player may use a cashless instrument of some type to register credits on the gaming machine 2402. For example, the bill validator 30 may accept a printed ticket voucher, including 20, as an indicium of credit. As another example, the card reader 24 may accept a debit card or a smart card containing cash or credit information that may be used to register credits on the gaming machine.

During the course of a game, a player may be required to make a number of decisions. For example, a player may vary his or her wager on a particular game, select a prize for a particular game, or make game decisions regarding gaming criteria that affect the outcome of a particular game (e.g., which cards to hold). The player may make these choices using the player-input switches 32, the video display screen 34 or using some other hardware and/or software that enables a player to input information into the gaming machine (e.g. a GUI displayed on display 34).

During certain game functions and events, the gaming machine 2402 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2402, from lights behind the belly glass 40 or the light panel on the player tracking unit 44.

After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 2402. In some embodiments, these tickets may be used by a game player to obtain game services.

IGT gaming machines are implemented with special features and/or additional circuitry that differentiate them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-change-able) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA RS232 serial interfaces provided by general-purpose computers. These interfaces may include EIA RS485, EIA RS422, Fiber Optic Serial, Optically Coupled Serial Interfaces, current loop style serial interfaces, etc. In addition, to conserve serial interfaces internally in the slot machine, serial devices may be connected in a shared, daisy-chain fashion where multiple peripheral devices are connected to a single serial channel.

IGT Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the trusted memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Gaming machines used for Class III games generally include software and/or hardware for generating random numbers. However, gaming machines used for Class II games may or may not have RNG capabilities. In some machines used for Class II games, RNG capability may be disabled.

Figure 26:
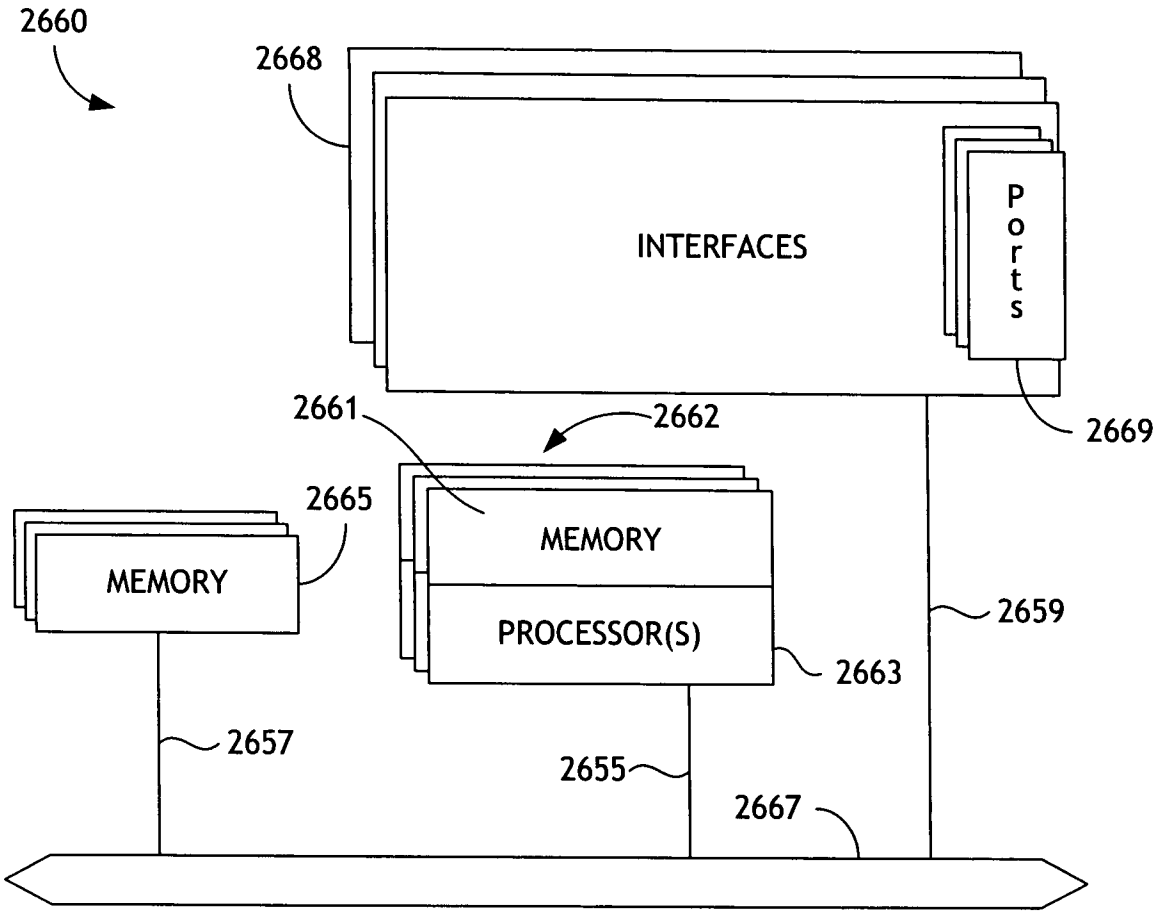
FIG. 26 is a block diagram of an exemplary network device that may be configured as a game server to implement some methods of the present invention.

FIG. 26 illustrates an example of a network device that may be configured as a game server for implementing some methods of the present invention. Network device 2660 includes a master central processing unit (CPU) 2662, interfaces 2668, and a bus 2667 (e.g., a PCI bus). Generally, interfaces 2668 include ports 2669 appropriate for communication with the appropriate media. In some embodiments, one or more of interfaces 2668 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 2668 control such communications-intensive tasks as media control and management. By providing separate processors for the communications-intensive tasks, interfaces 2668 allow the master microprocessor 2662 efficiently to perform other functions such as routing computations, network diagnostics, security functions, etc.

The interfaces 2668 are typically provided as interface cards (sometimes referred to as "linecards"). Generally, interfaces 2668 control the sending and receiving of data packets over the network and sometimes support other peripherals used with the network device 2660. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 2662 may be responsible for implementing specific functions associated with the functions of a desired network device. According to some embodiments, CPU 2662 accomplishes all these functions under the control of software including an operating system and any appropriate applications software.

CPU 2662 may include one or more processors 2663 such as a processor from the Motorola family of microprocessors or the MIPS family of microprocessors. In an alternative embodiment, processor 2663 is specially designed hardware for controlling the operations of network device 2660. In a specific embodiment, a memory 2661 (such as non-volatile RAM and/or ROM) also forms part of CPU 2662. However, there are many different ways in which memory could be coupled to the system. Memory block 2661 may be used for a variety of purposes such as, for example, caching and/or storing data, programming instructions, etc.

Regardless of network device's configuration, it may employ one or more memories or memory modules (such as, for example, memory block 2665) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 26 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 26) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention. For example, the "layering" techniques (e.g., as described above with reference to the flow chart of FIG. 19B) may be practiced in combination with other methods, e.g., those having more than one bingo number associated with an area of a bingo card.

Although the foregoing invention has been described in some detail for purposes of clarity of understanding, it will be apparent that certain changes and modifications may be practiced within the scope of the appended claims.

We claim:

1. A method of operating a gaming system, the method comprising:

causing a processor to execute a plurality of instructions to operate with a display device to display B bingo cards to a player, wherein B is greater than one and, for each of the B bingo cards, the bingo card includes a plurality of areas, each area being included in a layering part or a non-layering part of the bingo card;

causing the processor to execute the plurality of instructions to randomly select N bingo numbers;

causing the processor to execute the plurality of instructions to operate with the display device to indicate hits in areas corresponding to the selected bingo numbers; and causing the processor to execute the plurality of instructions to determine whether a winning bingo pattern can be formed based on any indicated hits in the areas of the layering parts of at least two of the B bingo cards.

2. The method of claim 1, which includes causing the processor to execute the plurality of instructions to operate with the display device to display the B bingo cards in a 3-dimensional arrangement with respect to each other.

3. The method of claim 1, wherein causing the processor to execute the plurality of instructions to operate with the display device to indicate the hits includes causing the processor to execute the plurality of instructions to operate with the display device to display a playing card on each area of the bingo cards where there is a hit.

4. The method of claim 1, which includes, after determining that the winning bingo pattern can be formed, causing the processor to execute the plurality of instructions to operate with the display device to display the winning bingo pattern.

5. The method of claim 3, wherein causing the processor to execute the plurality of instructions to operate with the display device to display a playing card on each area of the bingo cards where there is a hit includes:

causing the processor to execute the plurality of instructions to operate with the display device to display a simulation of dealing playing cards, the dealt playing cards corresponding to the areas corresponding to the hits forming the winning bingo pattern; and causing the processor to execute the plurality of instructions to operate with the display device to display a playing card hand from the dealt playing cards.

6. The method of claim 1, wherein the winning bingo pattern is one of an interim bingo win pattern and a game-winning bingo pattern.

7. The method of claim 1, wherein at least one area on at least one of the B bingo cards is associated with more than one bingo number.

8. The method of claim 7, wherein causing the processor to execute the plurality of instructions to operate with the display device to indicate a hit in an area associated with more than one bingo number includes causing the processor to execute the plurality of instructions to operate with the display device to indicate a hit only when there is a hit on all of the bingo numbers associated with the area.

9. The method of claim 1, which includes providing fewer than B bingo cards to a second player.

10. The method of claim 9, which includes causing the processor to execute the plurality of instructions to operate with at least one input device to receive a first wager from the player and a second wager from the second player, the first wager being greater than the second wager.

11. The method of claim 1, which includes causing the processor to execute the plurality of instructions to randomly select additional bingo numbers until a game-winning bingo pattern has been formed.

12. The method of claim 1, which includes causing the processor to execute the plurality of instructions to operate with the display device to display hits that form the winning bingo pattern in a manner that is distinct from hits that do not form the winning bingo pattern.

13. The method of claim 1, wherein the winning bingo pattern forms a non-linear pattern.

14. The method of claim 1, wherein causing the processor to execute the plurality of instructions to determine whether the winning bingo pattern is formed includes causing the processor to execute the plurality of instructions to combine any hits along a single line.

15. A method of operating a gaming system, the method comprising:

causing a processor to execute a plurality of instructions to operate with a plurality of gaming devices to, for each gaming device, enable a player of said gaming device to select a desired number of bingo cards, wherein, for each of the bingo cards, the bingo card includes a plurality of areas, each area being included in a layering part or a non-layering part of the bingo card, causing the processor to execute the plurality of instructions to operate with the plurality of gaming devices to, for each gaming device, display the bingo cards selected by the player of said gaming device, the selected bingo cards including a first bingo card and a second bingo card;

causing the processor to execute the plurality of instructions to randomly select N bingo numbers;

causing the processor to execute the plurality of instructions to operate with the plurality of gaming devices to, for each gaming device, for each selected bingo card of the player of said gaming device, indicate hits in areas of said selected bingo card corresponding to selected bingo numbers; and causing the processor to execute the plurality of instructions to operate with the plurality of gaming devices to, for each gaming device, determine whether a winning bingo pattern can be formed based on any indicated hits in the areas of the layering parts of at least two of the selected bingo cards of the player of said gaming device.

16. The method of claim 15, which includes causing the processor to execute the plurality of instructions to, for each gaming device, after determining that the winning bingo can be formed, display the winning bingo pattern.

17. The method of claim 16, wherein causing the processor to execute the plurality of instructions to, for each gaming device, after determining that the winning bingo can be formed, display the winning bingo pattern includes causing the processor to execute the plurality of instructions to display the winning bingo pattern as a hand of playing cards.

18. The method of claim 16, wherein causing the processor to execute the plurality of instructions to operate with the plurality of gaming devices to, for each gaming device, for each selected bingo card of the player of said gaming device, indicate hits in areas of said selected bingo card corresponding to selected bingo numbers includes causing the processor to execute the plurality of instructions to operate with the plurality of gaming devices to, for each gaming device, for each selected bingo card of the player of said gaming device, indicate hits that form the winning bingo pattern in a manner that is distinct from hits that do not form the winning bingo pattern.

19. The method of claim 15, wherein causing the processor to execute the plurality of instructions to operate with the plurality of gaming devices to, for each gaming device, for each selected bingo card of the player of said gaming device, indicate hits in areas of said selected bingo card corresponding to selected bingo numbers includes causing the processor to execute the plurality of instructions to operate with the plurality of gaming devices to display a playing card on each area of the bingo cards where there is a hit.

20. The method of claim 15, wherein causing the processor to execute the plurality of instructions to operate with the plurality of gaming devices to, for each gaming device, determine whether a winning bingo pattern is be formed includes causing the processor to execute the plurality of instructions to operate with the plurality of gaming devices to combine hits along a single line.

21. The method of claim 15, wherein causing the processor to execute the plurality of instructions to operate with the plurality of gaming devices to, for each gaming device, display the bingo cards selected by the player of said gaming device includes causing the processor to execute the plurality of instructions to operate with the plurality of gaming devices to, for each gaming device, display the bingo cards selected by the player of said gaming device in a 3-dimensional arrangement with respect to each other.

22. A non-transitory machine-readable medium storing a plurality of instructions which, when executed by a processor, cause the processor to:

cause a display device to display B bingo cards to a player, wherein B is greater than one and, for each of the B bingo cards, said bingo card includes a plurality of areas, each area being included in a layering part or a non-layering part of the bingo card;

randomly select N bingo numbers;

indicate hits in areas corresponding to the selected bingo numbers; and determine whether a winning bingo pattern can be formed based on any indicated hits in the areas of the layering parts of at least two of the B bingo cards.

23. A gaming system network comprising:

(a) a game server comprising:

(i) at least one logic device configured to form electronic representations of a plurality of bingo cards and to randomly select N bingo numbers, wherein, for each of the bingo cards, said bingo card includes a plurality of areas, each area being included in a layering part or a non-layering part of the bingo card; and (b) a plurality of gaming machines in communication with the game server, each of the plurality of gaming machines configured to:

(i) display the plurality of bingo cards, (ii) indicate hits on areas of the bingo cards corresponding to at least one of the selected N bingo numbers, and (iii) determine whether a winning bingo pattern can be formed based on any indicated hits in the areas of the layering parts of at least two of the B bingo cards.

* * * * *